US007404837B2

(12) United States Patent
Killion et al.

(10) Patent No.: US 7,404,837 B2
(45) Date of Patent: Jul. 29, 2008

(54) MOUNTAIN CLOUDWATER

(75) Inventors: David L. Killion, 8550 Allen Rd., Clarkston, MI (US) 48348; James E. Carr, Waterford, MI (US); Jesse D. Killion, Clarkston, MI (US); Joan A. Killion, Clarkston, MI (US); Steven L. Bruno, Clarkston, MI (US)

(73) Assignee: David L. Killion, Clarkston, MI (US)

( * ) Notice: Subject to any disclaimer, the term of this patent is extended or adjusted under 35 U.S.C. 154(b) by 0 days.

(21) Appl. No.: 10/855,051

(22) Filed: May 27, 2004

(65) Prior Publication Data

US 2005/0223719 A1 Oct. 13, 2005

Related U.S. Application Data

(60) Provisional application No. 60/473,531, filed on May 27, 2003.

(51) Int. Cl.
*B01D 47/00* (2006.01)

(52) U.S. Cl. ..... 55/421; 55/423; 55/466; 55/468; 55/495

(58) Field of Classification Search ..... 96/188; 55/421, 423, 466, 467, 468, 495; 62/93
See application file for complete search history.

(56) References Cited

U.S. PATENT DOCUMENTS 3,616,615 A * 11/1971 Woodbury ..... 96/395

OTHER PUBLICATIONS

Mukerji, Sitoo, et al., Fogwater Collection System, International Development Research Centre, Canada website, 1997, Ottawa, Canada.

U.S. Department of the Interior, Standard Fog Collector, U.S: Geological Survey website, Reston, Virginia, Apr. 23, 2002.

U.S. Department of the Interior, "Harp" type Fog Collector, U.S. Geological Survey website, Reston, Virginia, Nov. 13, 2001.

Patrick Wilson, News Release, University of East London website, May 27, 2002.

* cited by examiner

*Primary Examiner*—Robert A. Hopkins
(74) *Attorney, Agent, or Firm*—Dickinson Wright PLLC

(57) ABSTRACT

A method and apparatus for completing a natural solar distillation cycle (comprised of maritime trade winds being elevated over mountain formations to form orographic clouds) includes enabling the low cost harvesting of freshwater during time periods when weather conditions permit, despite the absence of rain. The cloud-catching wind management structures preferably incorporate minimal pressure drop gas cyclones to centrifuge condensate particles out of the air stream, and jet pump-like flow guide structures to help overcome pressure drop, for efficient, energy-passive production of freshwater utilizing only the stagnation pressure of natural wind velocity. The permanence (design and anchoring against natural disasters) of the structures provides for incorporation of water treatment means, and connection with permanent collection reservoirs and distribution systems, for large volume supply of potable freshwater for public and industrial use.

28 Claims, 27 Drawing Sheets

1A
1A
101
100
102
103
104
105
To Reservoir 140
141
144
145
146
143
142

MOUNTAIN CLOUDWATER

CROSS REFERENCE TO RELATED APPLICATIONS

This application claims benefit of U.S. Provisional Application No. 60/473,531 filed May 27, 2003, and entitled "Orographic Condensate Precipitation and Collection".

TECHNICAL FIELD

The present invention relates to fog collection, desalination, and the various fields of water resources management. Technologies employed include the fields of jet pumps or ejectors, gas cyclones, refrigeration and condensation, wind power, geodesic domes, filtration, and acoustics.

BACKGROUND OF THE INVENTION

Suitably pure freshwater is becoming increasingly valuable because of its scarcity, especially in populated areas where the general health of both people and livestock is influenced by the quality (or purity) of water used for drinking, cooking, washing, etc., and for agricultural irrigation where applicable. In 1986, the World Health Organization stated that an 80 percent decrease of illnesses would result if people in developing nations had access to pure drinking water (see *Water* 100% *Natural*, ©Rise L. Rafferty). The existence and continued production of poorly-sealed groundwater wells, such as those drilled by rotary methods, compounds the problem of groundwater purity in developed areas, by facilitating leakage to and from otherwise isolated groundwater veins. Many small islands in saltwater oceans are challenged to obtain sufficient freshwater economically, as current-technology desalination processes such as distillation and reverse osmosis tend to be capacity-limited, relative to their significant investment, maintenance cost, and service life limitations.

Collection of rainwater has long been a traditional source of low cost freshwater on a relatively small scale in non-arid locations, but in addition to being capacity-limited in most regions, the water quality produced by this method is influenced by air pollution, to the extent present in the surrounding atmosphere. The limitation of this source of supply to those time periods when weather patterns actually produce rain is what limits harvestable volumes to factors largely beyond the control of mankind.

Rain clouds are formed as moisture-laden air is elevated to altitudes of reduced atmospheric pressure, and cooled by this elevation and/or by movement of adjacent air masses, until the water vapor reaches a so-called saturation point, or dew point, where visible condensation, in the form of tiny aerosol droplets, begins to occur. Further cooling and/or pressure drops will increase the magnitude of condensation to the point of precipitation (rain) being formed by a process of droplet enlargement to sizes that allow gravitation to overcome air flow resistance, or so-called viscous effects. This typically occurs as a cold air mass or "cold front" meets warm air and, because of its greater density begins to flow under the warm air, both elevating and cooling it to produce the result of a transient period of rain.

Some geologic conditions, such as lakeshore bluffs or inland mountain ranges, act to produce clouds more or less continually as moisture-laden prevailing winds blow over and are elevated by them. A more or less constant threshold of cloud formation in these locations witnesses the fact of invisible water vapor in the moving air masses being both elevated to levels of lower atmospheric pressure, and cooled at these higher elevations, producing visible condensation such that freshly-formed clouds are consistently seen in proximity to the topographical features responsible for the elevation. The wind flows through the area of condensation, constantly regenerating cloud as the air rises and then dissipating it as the air descends on the other side of the landform or is warmed.

An example of such orographic conditions can be seen in the Caribbean island of St. Kitts, long known for its abundance of naturally-occurring mountain spring water. The prevailing Caribbean trade winds arrive after having traveled thousands of miles across the Atlantic Ocean, wherein "solar powered distillation" of ocean water occurs freely, and absent any significant sources of pollution, which tend to be land-based. These trade winds are deflected upward by the island's volcanic mountain range, which is providentially arrayed with respect to prevailing wind direction. The upwardly deflected flow reaches altitudes of over 2,000 feet ASL, where it tends to form clouds at the mountaintops. Numerous artesian wells on the sides of the mountains have traditionally supplied the towns and villages below with high quality water, and thus attest to the fact that these favorably created natural conditions are consistently near enough to the threshold of precipitation to enable the periodic rain from these clouds to be a reliable water source.

Such favorable orographic conditions offer, in the wind velocity and liquid water content of the clouds formed, copious quantities of freshwater for potentially energy-free harvest by an appropriately engineered precipitator-collector system. Such a "cloud catcher" water harvesting system offers the potential of producing voluminous quantities of freshwater directly from the clouds themselves (not being limited to the periodic precipitation associated with weather patterns), while being capable of also collecting naturally occurring precipitation, when it happens, as bonus water volume.

The practice of so-called fog collection in such localities is known, consisting of the placement of coarse mesh panels normal to wind direction, with collection troughs situated below the mesh panels to transport collected water to pipe manifolds leading to a reservoir. This technology has been shown to be effective in providing freshwater to small populations with very low investment cost, but suffers from the limitations of very low collection efficiency (counterproductive to spatial density, hence demanding of land area), and vulnerability to environmental (weathering, storm) damages so is poorly suited to reliably high volume production for areas of significant population density.

Accordingly, there exists a need for a more economical, durable, space-efficient production of voluminous quantities of freshwater than is provided by current technology, to benefit the many regions of the world where orographic cloud formations are in close enough proximity to user groups to enable cost-effective distribution of the new quantities of water thereby offered. Preferably, this would operate passively (without need for power sources), and with minimal operating and maintenance costs.

The technical challenges of collecting the liquid water of an orographic cloud or flowing fog lie firstly in the very small sizes of the droplet particles, and secondly in their low mixture density with the air that carries them. The sheer volume of flowing air mass, however, offers compensation for this relative rarity if reasonable collection efficiency can be achieved. A 10 m/s (22.37 mph) velocity orographic flow through a square window, 30 m (98.4 ft) per side can reasonably be estimated to pass water content on the order of 2334 $m^3$/day (2.33 million liters/day), or 616,639 gallons/day.

With sizes on the order of 0.020 mm, the aerosol particles tend to flow around filtration media fibers rather than collide with them, as their viscous relationship with the air strongly prevails over the inertia effects required to move them across the streamlines of the air flow path. This, when coupled with their sparse population (with total liquid water content of a maritime stratus cloud on the order of 0.3 $g/m^3$), makes particle impact with filtration media fibers quite low in frequency. Making the filtration media less coarse to increase fiber density is counterproductive to the extent that as flow resistance is increased, through-flow velocity is curtailed, making the (inertia-dependent) collisions with the fibers that much less probable.

A proven device for separating particles from air, which has been in use in industrial applications for over a century, uses centrifugal force to separate denser-than-air particles from a spiraling airflow path that is forced to spin within a cylindrical chamber. The so-called gas cyclone provides sufficient time for centrifugal force to migrate the bulk of condensate particles across the spinning air streamlines to the walls of the chamber where they collect and drain out at the bottom of the chamber.

These cyclone separators are passive, beyond the use of blowers or fans to produce sufficient airflow, in that no moving parts are required in their operation, but the pressure drop, or differential, between the inlet and the outlet required insure their successful operation is on the order of 100 mm of water, or 9.8 millibar (see A. C. Hoffmann & L. E. Stein; *Gas Cyclones and Swirl Tubes*; ISBN 3-540-43326-0, p. 312), much higher than the stagnation pressure of orographically-accelerated trade winds. Thus traditional-configuration cyclones are not suitable for the processing of voluminous quantities of cloud without the expenditure of inordinate amounts of power. In order to be passively powered by ambient air velocity directly, feasibility dictates that new, non-traditional configuration cyclones having very low pressure drop, on the order of 5% that of traditional devices, be proven effective in extracting liquid water from cloud aerosol. Such inventive cyclones are herein provided in conjunction with other preferred cloud catcher wind and water management structures, to enable substantially increased capture efficiency and productivity in comparison with traditional fog collection methodology. With design focus on volume of water collected, instead of dryness of output flow, these new non-traditional cyclones will not benefit the field of traditional-objective cyclones as configured in their entirety, although portions of the inventive structures may prove useful for alternative purposes.

SUMMARY OF THE INVENTION

It is an advantage of this invention to economically complete the solar distillation cycle provided in nature by orographic cloud formations in order to provide large quantities of pure water at low relative cost.

2. It is a further advantage of this invention to enhance quality of life on earth by the introduction of a new, reduced-cost means of producing potable freshwater.

3. It is a still further advantage of this invention to economically benefit all those who will participate in the production, distribution, and consumption of reduced-cost potable water.

4. It is yet another advantage of this invention to enhance, by dilution, the usefulness of marginally-useful water resources, by providing sufficiently plenteous, low cost freshwater with which they can advantageously be mixed.

5. It is still another advantage of this invention to include rainwater collection capability as an integral component of the proposed water-harvesting structures.

6. It is further still an advantage of this invention to provide for environmentally robust, safe, reliable, and aesthetically desirable implementation of the water harvesting device.

7. It is finally an advantage of this invention to minimize the consumption of imported energy and other natural resources in the implementation and operation of the water harvesting device.

The propensity of relatively cool surfaces to collect "condensation" or water droplets in the presence of moist air is well known, being evidenced by phenomena as universal as dew on grass that has been subjected to radiant cooling overnight. An array of cooled hollow vanes or tubes (or combination of tubular and vane surfaces wherein surface area may be increased, hereafter called a cooling array) may be employed to cool, and thus condense water from, moist air. Such "heat exchanger" type devices are well known in the art, including being used expressly for the production of freshwater from air e.g., H. Coanda et al, U.S. Pat. No. 2,761,292. When placed in a flow consisting of a mixture of air and water condensate droplets (as in a fog, or a cloud) such an array would act to both cool the air to produce further condensation, and to "catch" existing water droplets that may impinge on the surfaces of the array. Such a cooling array might well be considered an "active fog filter", because of its dual actions of catching and removing condensate droplets from the airflow, and its creation of new condensation droplets by further cooling the moisture-saturated air that carries the droplets through its air gaps. However, impinging droplets warm the surfaces of the cooling array, so to the extent that the surface temperature of the cooling array is maintained below ambient temperature, the energy spent to recover from droplet warming is lost to the higher purpose of cooling the array's surfaces to create condensation. Thus, while a cooling array would have utility in both the capture of existing orographic condensate particles and in the creation of new condensate (both at its surfaces and within the passing saturated flow), energy efficiency in a cloud catcher application would be served by the upstream removal of existing condensate content. The combination of passive fog collection means upstream of a cooling array, for the purpose of removing existing condensate content in a cloud collector application of a cooling array is not known in the art, so is herein provided, as is downstream means of collecting the newly-enriched condensate content of the further-cooled airflow.

Passive fog filters, performing droplet capture functionality but without need for energy-consumptive cooling means are clearly also feasible, as evidenced by the visibility of a spider web under foggy conditions, and the historic practice of fog collection. Such passive means hold ecological and environmental advantages to the extent that they are able to compete with cooled arrays but without the operating costs of refrigeration systems, and without environmental penalty such as exhaust gasses. It can be seen that an array of many closely spaced layers, of spider webs would effectively provide fog filter functionality if located within a suitably low airflow velocity. Increased depth of the array, by way of additional layers in the direction of airflow, would increase its droplet capture efficiency, but would of course be subject to diminishing returns with depth increase as the droplet mixture density was reduced by prior capture, and as flow velocities were degraded by increased flow resistance.

The flow resistance of a fog filter can be reduced in comparison with current technology by increasing the ratio of filter area to frontal area (the area facing normal to airflow direction). Although the current technology vertical plane model simplifies collection by reducing drain area requirements to a single line, it costs dearly in terms of flow resistance and the related ratio of frontal area to filter flow area. This flow resistance must be managed, in this model, by a very low fiber to opening area density ratio, with its resultantly low capture efficiency, in order to avoid filter-circumventing "flow around", due to buildup of stagnation pressure over the frontal area. If, given the same frontal area, the filter flow area is increased, preferably in conjunction with slanting, and/or pleating of the filter surface, the resultant reduction in flow resistance would allow for finer mesh size or multiple layering, or both, offering increased probability of droplet capture while still increasing through-flow rates. Such flow area increase, over frontal area, is provided by at least partially enclosing the filter within air guide surfaces that allow for the elongated filter dimensions behind/below the inlet area while preventing flow-around locally. The aforementioned pleating of mesh array surfaces into vertical undulations to conserve space and/or increase surface area as is common with fluid filters also facilitates drainage of product water and reduces the extent of flow resistance increase (across mesh array) due to as-yet undrained product water in the case of relatively fine mesh sizes that by means of capillary attraction might otherwise suffer blockage. While "pleated" is disclosed, it is to be understood that a variety of mesh configurations may be utilized which have substantial flow area increase over current art flat panels, and which further may hold advantage for serviceability. An example of such an alternative configuration to be considered equivalent to the term "pleated" is a truncated pyramid shape that might be prefabricated in modular elements about mounting frames that could be square, triangular, or hexagonal in intake area shape. Such modular elements could be arrayed to fill, like wind socks, with air, or alternatively have spatial shape maintained by sub frame members, and facilitate removal for cleaning, repair, or replacement with less effort than larger panels.

Employment of suitably shaped air guide surfaces comprising a wind management enclosure not only offers the ability to improve cloud droplet collection efficiency, but also offers substantial opportunity for spatial densification by reduction in the ratio of frontal area to flow area over that of traditional fog collection methods.

Such an enclosure also offers the ability to collect rainwater when it occurs coincidently.

An apparatus capable of separating water from a flowing air and aerosol water condensate mixture (i.e., cloud or fog, hereafter called "cloud"), whether passively (by means of one or more filtration layers hereafter called "mesh array" or by cyclonic action within at least one gas cyclone, hereafter called a cyclone array, or some combination thereof), or actively (by means of a heat exchanging cooling array in inventive series combination with one or more of these passive means), which is at least partially enclosed by air guide surfaces having inlet opening area generally facing, or orientable towards, prevailing orographic winds and discharge opening area shrouded from or facing generally away from said winds will hereafter be referred to as a "precipitator" for purposes of inventive apparatus identification by broad function.

The combination of such a precipitator with collection means of gathering condensate, and transport means such as a drainpipe or pipe array will hereafter be called a "precipitator-collector", and hereafter referred to as a "P-C".

The placement of a high capacity P-C at a normally cloud-enshrouded altitude of a geologic formation that is subjected to relatively steady prevailing winds in order produce voluminous quantities of pure water at minimal cost by completing an otherwise fully natural distillation process is not known in the art, and is thus inventively disclosed.

Such an inventive combination (P-C on cloud-enshrouded geologic formation) may be made more productive by further reduction of the air pressure within the P-C enclosure (beyond that due to the elevation and velocity increases inherent to the moving air's deflection by the mountain), whether to induce the creation of further condensation by lowering of the dew point, or to offset the flow resistance of the precipitator elements, or both.

Inventive structures that passively reduce internal pressure to create additional condensation and/or offset precipitator element flow resistances are herein disclosed as comprising inlet area generally facing or in communication with the prevailing wind, and discharge area substantially shrouded from the prevailing wind, said discharge area incorporating jet pump (or "ejector")-like features in combination with adjacent venturi-like features that increase flow velocity to "power" the jet pump, in order to produce a partial vacuum, or pressure reduction to below that of ambient pressure, on the P-C's precipitation chamber.

The venturi-like features accelerate airflow to velocities higher than the prevailing wind velocity by gradually reducing flow area from that of their intake(s), which, by facing the prevailing wind, are subject to its velocity pressure. The high velocity flow discharged from the venturi features is directed away from the precipitation chamber and towards a throat section and diffuser section that mix the initially low velocity precipitation chamber discharge flow with the high velocity venturi discharge flow, and then gradually slow the velocity of the momentum-averaged mixture to near that of ambient flow by means of a diffuser section that maintains the pressure gradient from that of the precipitation chamber back up to near ambient, according to jet pump design practice known in the art. This venturi-powered jet pump configuration thus uses the kinetic energy of the prevailing wind or moving air masses to produce continual depression of precipitation chamber pressure by "pulling" on the precipitation chamber's discharge flow areas with continuously-generated partial vacuum. Alternative jet pump configurations are herein provided as appropriate to suit the specifics of the design situation, including but not limited to; "inside out" architectures wherein the high velocity jet (or nozzle) flow is distributed about the periphery of the flow to be accelerated thereby; adjustably variable jet nozzle area to maintain more constant discharge velocity while adapting to variations in supply pressure, preferably automatically actuated by air pressure; and bypass flow supply of jet nozzle pressure, where a common inlet pressurizes both the jet nozzle and the liquid water extraction means.

Alternative inventive structures that actively reduce internal pressure to create additional condensation and/or offset precipitator element flow resistances are herein disclosed as comprising an inlet area generally facing or in communication with the prevailing wind, and a discharge area substantially shrouded from the prevailing wind, said discharge area incorporating wind-powered fans, turbines, or blowers capable of sufficient flow volume as necessary to maintain a partial vacuum on the precipitation chamber. Utilization of prevailing trade wind energy by means of wind turbines for the powering of refrigeration apparatus, or for pumping of liquids is also herein provided, in conjunction with the inventive P-C combination defined above as actively separating water from a flowing air and aerosol water condensate mixture by means of a cooling array in inventive combination with aforementioned passive means.

While the placement of a mesh array or cyclone P-C means upstream of a refrigerated array would serve to reduce the power consumption needed to maintain refrigerated array temperature gradient below ambient, by "pre-cleaning" the moist air of many condensate particles which otherwise would, upon impingement on the array, serve to warm it needlessly, the further placement of an additional mesh array or cyclone downstream of said refrigerated array would serve to collect water from the further precipitation (into condensate particles) that resulted from the cooling, and any pressure reductions acting on the cloud mass as it flowed through the structure. Such a downstream collection means is thus provided.

The greatest droplet capture efficiency requires the employment of gas cyclone technology, wherein the extended time duration needed for inertia forces on the droplets to prevail over the typically more dominant viscous forces is provided. The pressure drop of conventional gas cyclones, which can achieve nearly complete drying of discharge flow, prohibits their effectiveness for passive (i.e., stagnation pressure-driven) harvesting of orographic cloudwater. Accordingly, there exists need for inventive new cyclone architecture that can extract liquid water from aerosol cloud flows under flow and pressure differential conditions that consistently present themselves in nature so that cost effective harvest of this water can be realized.

Fortunately, the harvest of mountain cloudwater does not dictate dryness of discharge flow. Thus, many of the traditional cyclone's sources of pressure drop may be avoided in order to focus on volume of product water alone. In order to maximize product water production, the cyclone's flow resistance must be minimized, concurrently with maximizing time spent under maximum possible centrifugal loading. The flow resistance minimization goal is served by providing a very gradual angular acceleration rate to initiate and develop the rotation of the air mass in the cylindrical body of the cyclone, and by minimizing sources of flow restriction or resistance. Additionally, the use of pressure recovery means as have been proven successful in the discharge path of conventional cyclones should be utilized to minimize the overall pressure drop between inlet and discharge. Such means include deceleration of the swirl velocity to recover invested kinetic energy, and gradual expansion, venturi-like, to recover pressure by slowing axial flow velocity.

Towards these ends, an inventive very low pressure drop (VLPD) gas cyclone is hereby disclosed, with features that facilitate low cost fabrication into multiple cyclone layer arrays to maximize air flow volume processing capacity in the inventive P-C. Principal features of this inventive VLPD cyclone are:

the deliberate absence of either reverse flow or any central "plug" obstruction features, which act to detract from directional continuity and axial momentum preservation of the swirling flow: this feature, which enables axial advance more or less uniformly across the cross-section of the cyclone, means that the cyclone is of the through-flow type, thus related to a so-called swirl tube, and that if an axial inlet with swirl vane is utilized, said swirl vane will preferably be of double helix circular helicoid construction, having no central plug, but rather a centerline section that is essentially a thin, straight line such that uniform axial advance of air volume with so-called "rigid body" rotation are induced. Pressure drop minimization would be preferably served by said double helix helicoid (hereafter simply called helicoid) being of variable pitch construction, wherein the angular acceleration of the flow would be gentle and steady (i.e., constant) initially, then transitioning to substantially zero if needed for a duration required to properly bound the flow above and below at the desired exit helix angle, with said constant acceleration rate being of such magnitude as to result in sufficiently gradual constriction of flow area in the direction of streamlines as to not exceed known good practice, as in for instance, low loss flow measurement venturi design practice, when used in conjunction with an inlet horn or cone. Said variable pitch helicoid is preferably mounted in (so as to mate sealingly with) an inlet horn or cone of sufficiently small convergence rate as to result, in combination with the helicoid's area constriction due to helix angle increase, in a known low loss rate of flow area reduction in the direction of streamlines, so as to end at a distance before the small end of the inlet horn that compensates for the flow restriction represented by the helicoid such that this flow restriction is not greater than that of the smallest cross sectional area of the inlet horn;

either a long, very gradually tapering body, such that loss of tangential flow velocity due to wall friction does not result in excessive loss of centripetal acceleration over its axial length, or a long straight-bore tube having intermediate "resetter" helicoids as needed to avoid the phenomenon known as "natural vortex length", by reinvigorating swirl velocity lost to wall friction;

multiple spiral grooves in the inner surface of the body whether a cone or constant diameter (hereafter "bore") to allow accumulated water flow to migrate, or "sipe" (tire tread terminology), substantially parallel to flow direction but "below" (outside) the inner surface of the bore, gutter-like, to the bottom of the bore exit region, thus substantially avoiding the "hydraulic roughness" (swirl resistance, or wall friction increase) that accompanies sheeting liquid water that has no such "gutters" into which to congregate;

a diverging cone or horn diffuser that gradually expands cross-sectional area in low loss venturi flow meter-like manner from the bore, to slow the axial flow rate in order to recover pressure as is known in the art;

a variable pitch helicoid vane to gradually "rectify" the rotation of the swirling flow to substantially pure axial flow for pressure recovery and thus pressure drop reduction as is known in the art, located enough after the flow's entry into the diverging cone to avoid introducing undue flow restriction, said helicoid and diverging cone geometries being coordinated to have appropriately gradual angular deceleration rate and resultant in-flowpath area expansion rate;

a non-conical "transition piece"—like expansion section having similarly gradual rate of area increase to that of the diverging cone diffuser, and of coordinated (with rectifier helicoid and diverging cone) rate of area expansion in order to complete the overall minimization of pressure drop by increasing the static pressure of the exit flow to nearly that of the ambient static pressure of the exit plenum, said expansion section transitioning from the circular cross section of the diverging cone to either a hexagonal or square or triangular shape as required to mate sealingly with adjacent VLPD cyclones in an array having cyclone spacing as compact as appropriate expansion magnitude permits, and rounded or bell mouth entry transitions to inlet horns or cones, preferably of construction comprising full radii fully tangent to inlet cones, for avoidance of flow contraction loss effects as is known in the art.

In situations where the stagnation pressure of prevailing winds is insufficient to assure consistent productivity using the above VLPD cyclone, an inventive variation that reduces wall losses by spinning (a variant of) the VLPD cyclone itself is provided as a further option in the interest of "fully passive"

functionality. The cyclone, which in this case preferably retains a round cross-section expansion section, is preferably rotated by wind velocity acting on ducted fan arrays on the way from above an upper stator assembly, housing an upper bearing means, to below a lower stator assembly, housing a lower bearing means, and preferably a second ducted fan array, wherein both of the stator arrays provide the ducting and mount the stator fan blades in jet engine-like array fashion as is known. Alternate ways of rotating the cyclone in cases of low wind velocity, such as electric motor driven cyclones, are provided where appropriate to the situation and could be arranged to only operate in the event of low wind velocity. Additionally, the alternative of rotating a portion of the cyclone's wall, for instance with respect to at least one stationary end portion is provided.

The reduction in wall friction losses afforded by rotation of the cyclone itself provides for increased centrifuge time for a given pressure drop, or reduced pressure drop for a given centrifuge time, or a combination of the above. In addition, the cyclone's wind-powered rotation enables a portion of its inlet vane's flow resistance to be offset by the propeller action of its leading edge region, which is preferably designed to enter the incoming flow at appropriate angle of attack based on typical rates of inlet flow and cyclone rotation. To the extent that the helicoid's leading edge creates a propeller-like lift component that tends to stuff the cyclone, it offsets a portion of the flow resistance of the remainder of the vane, which, like the stationary VLPD cyclone, acts to angularly accelerate the incoming flow with respect to the cyclone's body tube.

The constant angular acceleration functionality of the helicoid vanes is served, in this instance of spinning cyclone assemblies, by vane designs that differ from the stationary VLPD cyclone's in that purely axial (i.e., non-rotating) airflow in the former requires reversed vane curvature corresponding to the helical rate of advance of the flow with respect to the spinning vane. In that the air approaches the cyclone without spin, and ideally exits the cyclone in the same fashion, the leading edge of the inlet vane and the trailing edge of the rectifier vane need to correspond to the helical rates of advance which correspond to the respective flow rates at these entry and exit locations.

An alternative configuration of the VLPD cyclone concept, whether stationary or spinning, introduces slots to provide for transport of water away from the bore of the cyclone's body tube (or cone), in order to minimize the hydraulic roughness effect (of increasing wall friction and reducing swirl velocity), said slots preferably being of width so proportioned to wall thickness as to support capillary action retention of water in the slot, as means of minimizing pressure loss due to air leakage out the slots. The water which escapes the cyclone bore through the slots is captured and transported to the diffuser cone area by a substantially concentric "containment tube" that also serves to help support the static pressure at the bore, to enable the capillary action-plugged slots to be as wide as possible without incurring blowout leakage. The diffuser cone in this instance preferably starts (again) at the bore but is locally interrupted by the preferably small air gap between the cyclone body and the containment tube before continuing on in preferably coincident "cone location" with that of the initial diffuser cone portion starting from the bore.

The variability of wind velocity over time is a performance factor for passively powered cyclones in a fixed inlet area cloud catcher, in that cyclone performance will suffer from insufficient inlet pressure when the wind dies down if the permeability, or leakiness, of the cyclone array remains unchanged.

In case of such a cyclone array type P-C, the through-flow velocity of individual cyclones may be enhanced, in the event of relatively low wind velocity, by shutting off one or more of the cyclones within the common-inlet array, thus increasing or restoring the air pressure in the inlet plenum. This inventive strategy may be most effectively embodied by means of valves in one or more of the cyclone array inlet or discharge plenum areas. A preferred embodiment would be having so-called "butterfly valves" in conjunction with one or more of the cyclone array inlet or discharge plenum areas. Butterfly valves are inherently well balanced, pressure and force-wise, so require minimal power to actuate. To avoid undue flow resistance or backpressure (pressure drop) increase, said butterfly valves would preferably be housed within increased-area sections of the cyclone array inlet or discharge plenum (s).

In this application, butterfly valve position should essentially "toggle" between fully open and fully closed without permitting substantial time duration at "part throttle" (or partial closure), in order to maintain cyclone operating efficiency. This functionality is sometimes referred to as a bistable valve. The ideal of a "totally passive" mountain cloudwater harvesting apparatus would be served by wind-powered valve actuation means sensitive to wind velocity or inlet plenum pressure or both, with provision, by design, for substantial avoidance of the partial closure condition, under which cyclone efficiency suffers. Many differing mechanisms can accomplish this end. The wind-sensitive toggle means for valve operation is thus provided, on the "generic" basis of combining various machine elements known in the art, in combination with the valving of cyclone separator cyclone array inlet or discharge plenum areas.

The simplest class of "toggle" function mechanisms would enlist gravity to bias the valve closed, and wind velocity to overcome, the gravity closing bias, with the relatively rapid "toggle" functionality provided by the (at least one) wind velocity actuated member having increased mechanical advantage over the (at least one) gravity biased member, with movement away from a first closed valve position toward a second fully open valve position, or alternatively by having the gravity biased member(s) movement or reorientation away from said first closed position result in reduced restoration/biasing torque (towards said first position), or a combination of both increased mechanical advantage and reduced biasing torque with movement from said first closed position towards said second open position. For purposes of further discussion, both increased mechanical advantage and reduced biasing torque with movement towards the second position will be assumed.

This class of mechanism would thus be deliberately "unstable" in all intermediate positions (between the open and closed "end" positions) and so would produce bias, in said intermediate positions, towards either the closed position or the open position depending upon wind velocity. The toggling mechanism thus configured would require a threshold wind velocity to open the affected (at least one) valve, and would, at this wind velocity, fully convey the valve to its open position, so would then require a reduced, second, wind velocity to enable the reduced gravity bias to overcome the increased mechanical advantage in order to initiate motion back towards the first closed position. A clear design objective of said toggle mechanism would preferably be to not "overdo" the combination of mechanical advantage increase and bias torque decrease associated with the second closed position, in order to manage the wind velocity reduction needed to initiate motion back towards the first position from the second position, to a desired value such that the mechanism is not overly insensitive to the wind velocity reduction which would preferably initiate valve closing at the differential velocity just outside the gust (velocity variation) magnitude typical to the site. Said toggle mechanism would preferably include motion damping near its two end positions to avoid noise and/or damage due to impacts.

Acoustic excitation of cloud masses flowing through a filter mesh holds the potential to substantially increase condensate droplet capture/separation efficiency, by creating relative motion between the air (with its viscously coupled droplet content) and the mesh, thus effectively reducing the mesh size without increasing flow resistance. Alternatively, acoustic excitation could be used to reduce flow resistance at constant capture efficiency, or enable a specific combination of flow resistance reduction and capture efficiency increase. The energy inherent in the velocity, or stagnation pressure, of the moving air mass is preferably harnessed to produce acoustic excitation within said mesh array-containing P-C, whether by resonantly vibrating reed-like structure(s), rotating paddle wheel type flow interruption, or by the low frequency "buffeting" motion created by whistle-like excitation of at least one Helmholtz-like resonator cavity, or by some combination of similar known elements.

In order to minimize the foreign material collected by the inlet plenum of a cyclone array-containing P-C, a screen array is provided. The outermost barrier is preferably a grid of bars or channels capable of preventing large hurricane-loosened debris from entering the structure. Progressively finer screens, for example chain link fencing, followed by e.g., chicken wire, followed by e.g., bug screening, would deflect smaller debris, prevent birds from roosting, and keep all but the smallest of insects from entering and contaminating the plenum. Such a screen array would preferably be self-cleaning, to the extent possible, by suitably forward-leaning attitude and having separation distances embodying spaces for cleaning troughs at their bases. The exception to this forward leaning attitude could be in case of water-collecting channels being employed as the outermost grid. These are preferably of rounded V-shape section for best streamlining, and nearly vertical but leaning slightly rearward to maintain the capture of rainwater that impinges them. Small filter basins at the base of each water-collecting channel are provided in order to clean the rainwater of particulate matter before introduction into the collection pipe array. Alternatively, the collected water may be joined from more than one channel before filtration for layout simplicity and service expediency, as desired.

The pressure drop associated with the finest, "bug screen" type inlet plenum screen, even with the increased area afforded by pleating, may in some cases be avoided without significant detriment by the strategy of simply enlarging water filter capacity and/or increasing service frequency in lieu of the fine inlet screen. Alternatively, the inlet plenum may serve as a combination inlet, for both cyclone array and jet pump ejector nozzle, thus providing an exit path with sufficient "through flow" velocity to continually sweep most small insects and airborne debris out of the plenum through the ejector nozzle, thus avoiding the need for fine screen to deter accumulation of insect debris.

The P-C's drain area preferably employs a mesh array, sand bed, or other renewable filtration medium to trap undesirable sedimentary precipitates before they enter the collector pipe or pipe array. Serviceability of mesh type filtration media would be enhanced by quick-change filter elements, retained by sealing and pressure-withstanding "clamping rings" (or non-circular) clamping structures.

Protection of product water supplies from contamination during the filter element change process would be facilitated by having a run-off tray, to block the inlet to the collector system, which was automatically positioned over said inlet by the act of opening an access door to permit changing of the filter.

At least one movable or hinged panel, at the P-C's inlet duct, to close off said inlet duct, and thus further flow through the P-C, is provided to facilitate filter servicing processes. The utilization of said at least one movable panel for the purpose of limiting water intake to desirable flow rates in case of excessively stormy conditions can be automated by means of a flow meter in the collector pipe or a water level sensor above, or adjacent, said filter element, and/or an anemometer subject to wind velocity.

Features to enable the P-C's intake(s) (and discharge) to be rotated to (respectively) face toward (and orient away from) the wind as it shifts, in weathervane fashion, require the "moment balancing" of structural elements or masses about their rotational centerline to minimize offset loading of support structures, but are provided where applicable to enable increased output in localities where wind direction is less constant than that of trade winds. The aforementioned wind turbine powered exhaust fan-assisted discharge flow architecture is more adaptable to this rotating type P-C than is the jet pump assisted discharge flow architecture, because of the latter's requirement for an elongated diffuser section as being integral to jet pump efficiency. The fan-assisted discharge is also capable of being engineered to create greater magnitudes of discharge plenum vacuum than that of the "more passive" jet pump-assisted configuration.

DETAILED DESCRIPTION OF THE DRAWINGS

Figure 1:
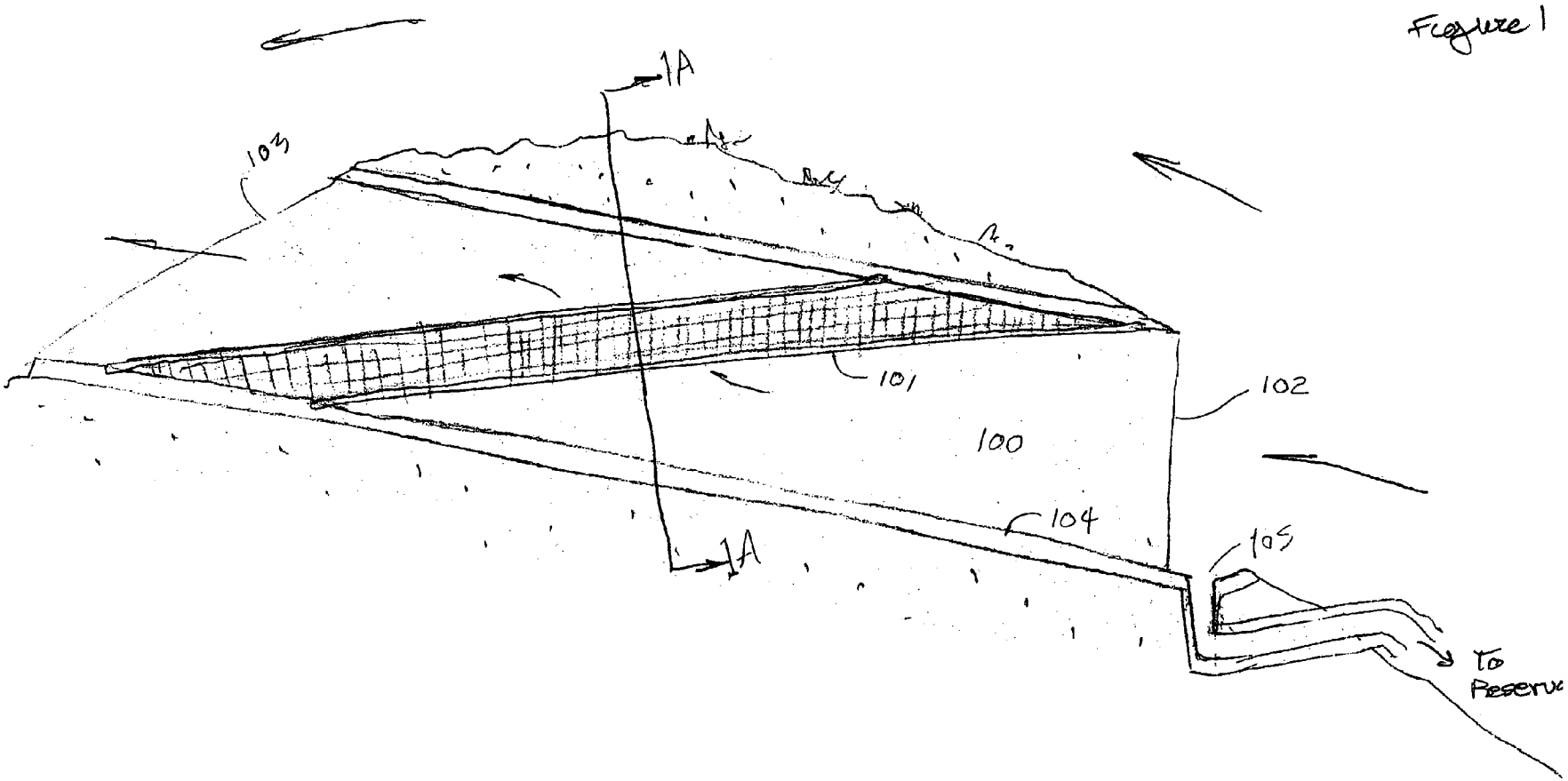
FIG. 1 is a schematic cross-sectional illustration of an orographic cloud catcher in accordance with the present invention, having an enlarged-area pleated mesh array sheltered from sunlight, and subject to wind stagnation pressure, with water collection area distributed under the entirety of the mesh array.

Preferred embodiments of the present invention are situation-specific, depending upon factors such as the magnitudes of prevailing winds, the extent to which rainfall, insects, animals and airborne debris are to be expected, spatial density and investment priorities, risk of natural disasters and their types, and the like, as will be understood by those of ordinary skill in the art. Examples of inventive system elements are shown in the drawings; it is to be understood that not all useful permutations of these elements are illustrated, and that these drawings are merely illustrative of concept, not to be interpreted as limiting in scope. Moreover, while various illustrations are shown, it will be understood that the various components of the system can be interchanged or combined as desired to suit the specifics of an application or situation.

Referring now to FIG. 1, an improvement over current fog collection art is provided by enclosing at least one layer of condensate collection mesh 101 in air guide enclosure 100 having air inlet area 102 oriented to generally face the prevailing orographic airflows and air discharge area 103 oriented away from the prevailing airflow direction. The air guide enclosure has a lower surface 104 extending fully below the condensate collection mesh to serve as a water collector. Apparatus 105 for collecting liquid water and transporting it to water treatment, storage, and distribution means (not shown) is also provided.

Figure 1A:
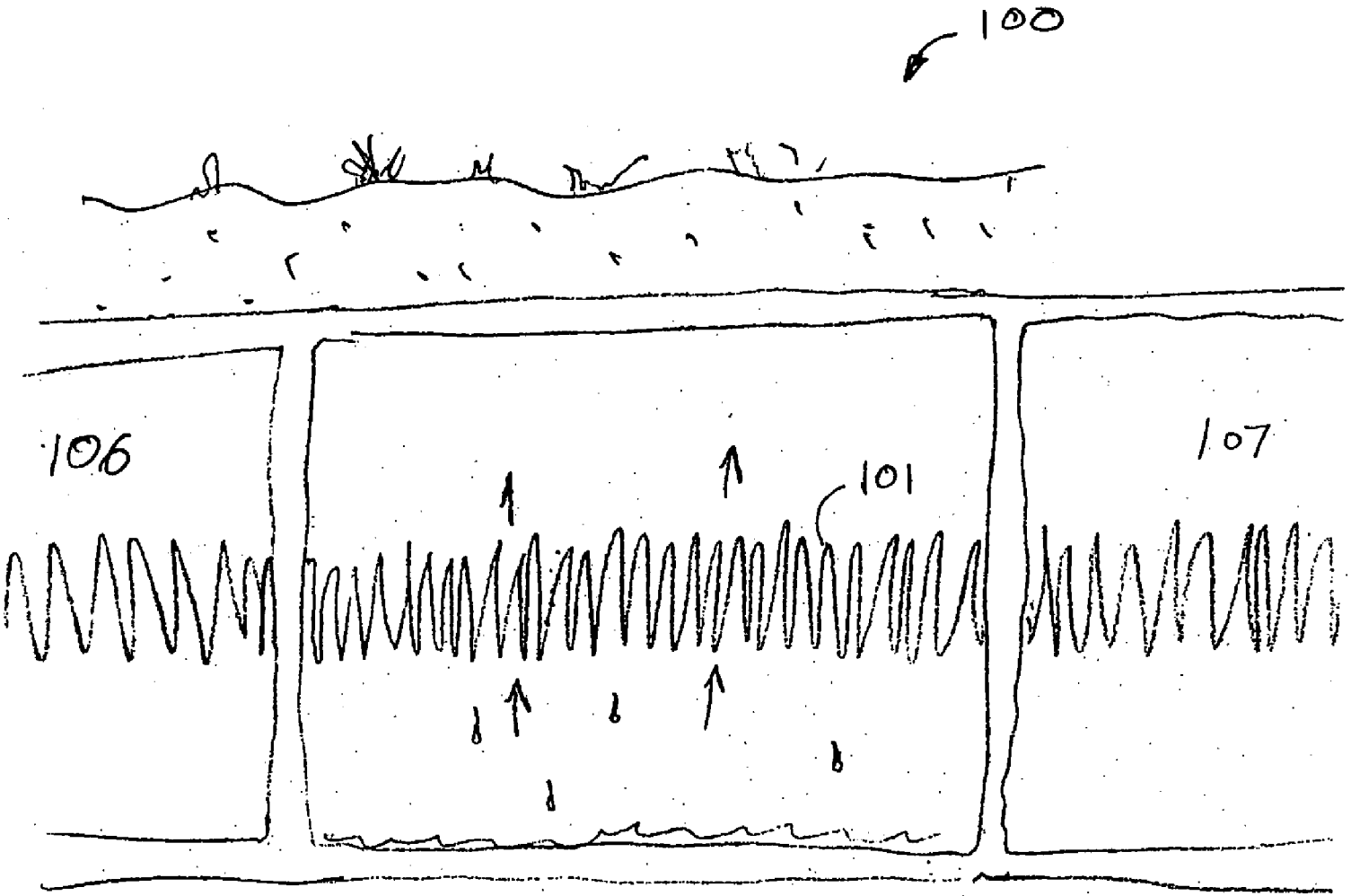
FIG. 1A is a schematic cross-sectional illustration of the orographic cloud catcher of FIG. 1 in the direction of the arrows 1A-1A

The condensate collection mesh 100 is preferably pleated in a generally vertical direction to facilitate both airflow and drainage, as seen in FIG. 1A, a sectional view of FIG. 1 taken in direction of arrows 1A-1A. The substantial increase in mesh area due to pleating and array inclination allows for improved droplet capture efficiency concurrent with reduction in flow resistance compared to current art. Also shown in FIG. 1A are adjacent cloud catchers 106, 107 in side-by-side array to maximize spatial density.

Figure 2:
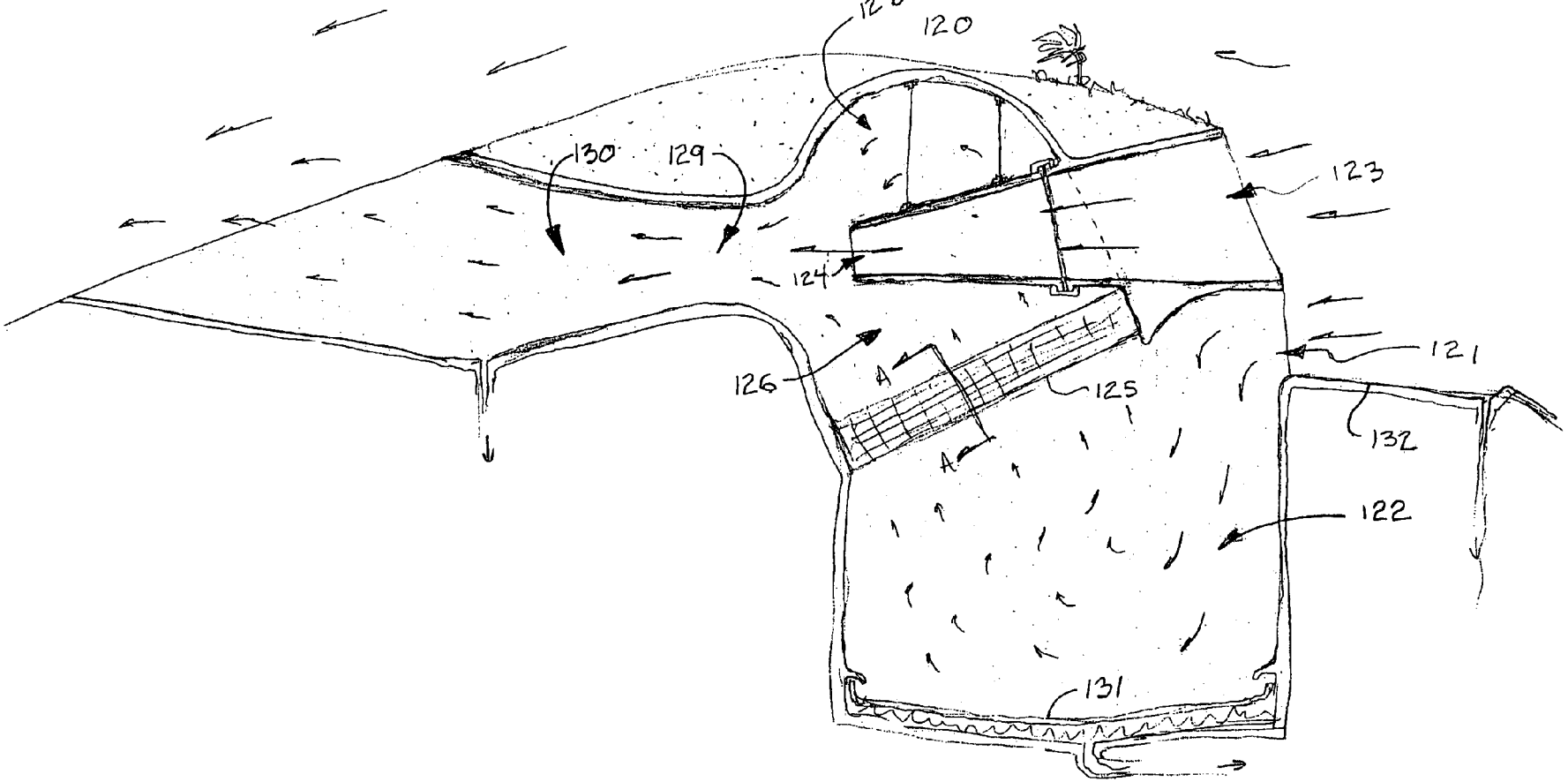
FIG. 2 is a schematic cross-sectional illustration of an orographic cloud catcher in accordance with a preferred embodiment of the present invention, having an enlarged-area pleated mesh array sheltered from sunlight and protected from airborne debris by an upstream settling chamber, the mesh array being subject to both wind stagnation pressure and discharge side vacuum by means of a jet pump whose nozzle is powered directly by the prevailing wind.

In FIG. 2, an orographic cloud catcher 120 has two air inlet openings, the lower opening 121 leads to a settling chamber 122 and the upper opening 123 leads to a jet pump nozzle 124, both of which are oriented to generally face prevailing winds. Airborne debris settles out of the airstreams as it encounters the increased flow area of a settling chamber, as is known in the art. This pre-cleaning reduces debris fouling of a pleated mesh array 125 to maintain separation performance by avoiding increase in flow resistance, and thereby extend service maintenance intervals. Aerosol cloud flows through the pleated mesh array 125 under pressure differential due to both stagnation pressure acting on lower inlet opening 121 and partial vacuum in discharge chamber 126 created by the jet pump system comprised of a jet nozzle 124, a distribution chamber 128, a throat 129, and a diffuser 130, which pressure differential acts to maximize the aerosol mixture flow volume passing through and being processed by the cloud catcher. The flow area expansion of the diffuser 130 acts to slow the airflow velocity for recovery of static pressure prior to rejoining ambient air pressure, for the purpose of minimizing the overall pressure drop, between the entry area and the discharge area, encountered by the orographic flows in order to maximize through flow volume, with its liquid water content. A renewable filtration media bed 131 is provided on the floor of the settling chamber 122 to trap foreign matter from proceeding out with the flow of output water. A device for rainwater capture is provided by an entry apron 132 and the floor of diffuser expansion section 130.

Figure 3:
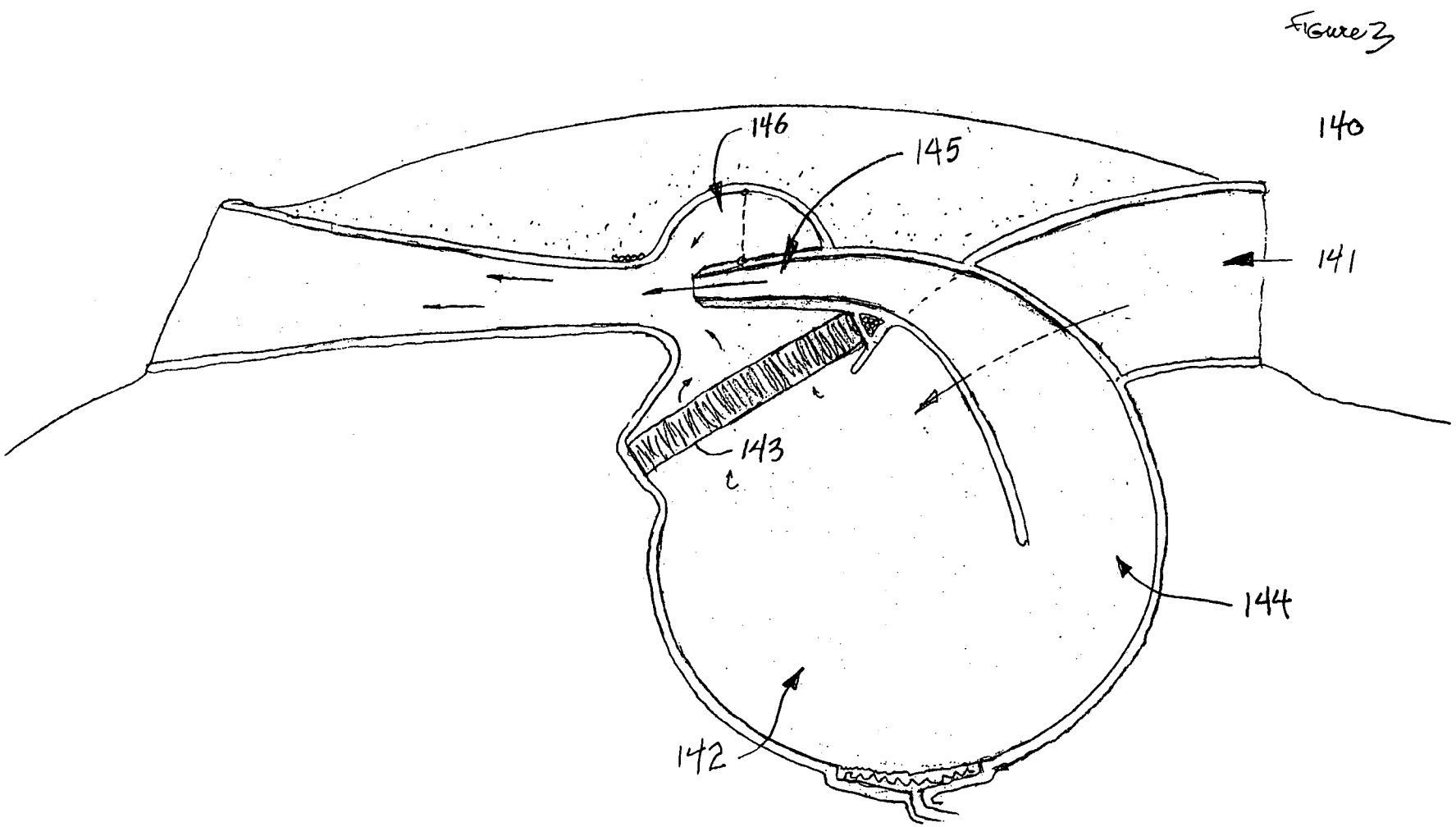
FIG. 3 is a schematic cross-sectional illustration of an orographic cloud catcher in accordance with a preferred embodiment of the present invention, having an enlarged-area pleated mesh array sheltered from sunlight, and subject to both wind stagnation pressure and discharge side vacuum by means of a jet pump whose nozzle is powered with bypass flow from a self-scavenging settling chamber.

In FIG. 3, an orographic cloud catcher 140 has an oversized, horizontally branched inlet opening 141 leading to a settling chamber 142 which provides enough air flow volume to both pressurize the pleated mesh array 143 and the inlet 144 of a bypass jet nozzle 145, which in turn helps depressurize a distribution chamber 146 to increase the pressure differential across the liquid water capture media pleated mesh array 143 as well as enable the smoothly rounded settling chamber 142 to scavenge itself of much of the light airborne debris that otherwise risks plugging the pleated mesh array 143. The inlet air from branched inlet opening 141 flows around both sides of the bypass jet 145 on its way to the settling chamber 142. The inlet 144 to the bypass jet 145 is preferably flared in width below the branched settling chamber inlet opening 141, to be more effective in its scavenging functionality.

Figure 4:
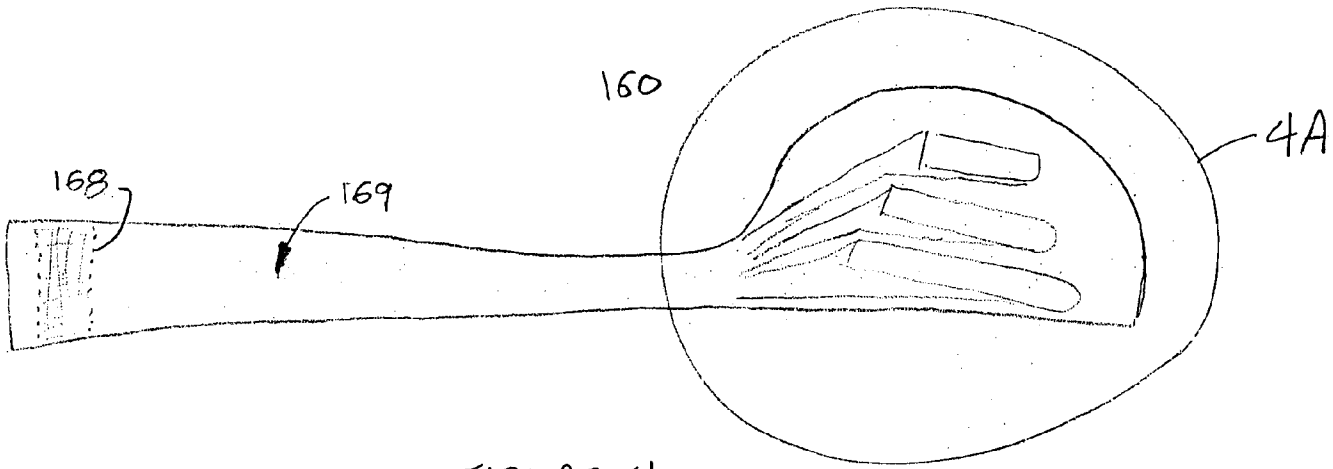
FIG. 4 is a schematic cross-sectional illustration of an orographic cloud catcher in accordance with a preferred embodiment of the present invention, having a tiered array of Very Low Pressure Drop (VLPD) cyclone arrays subject to both wind stagnation pressure and discharge side vacuum by means of an inverted multi-layered jet pump whose nozzle areas are powered with bypass flow, the air guide surfaces preferably including enclosure by geodesic dome-based structures.
Figure 4B:
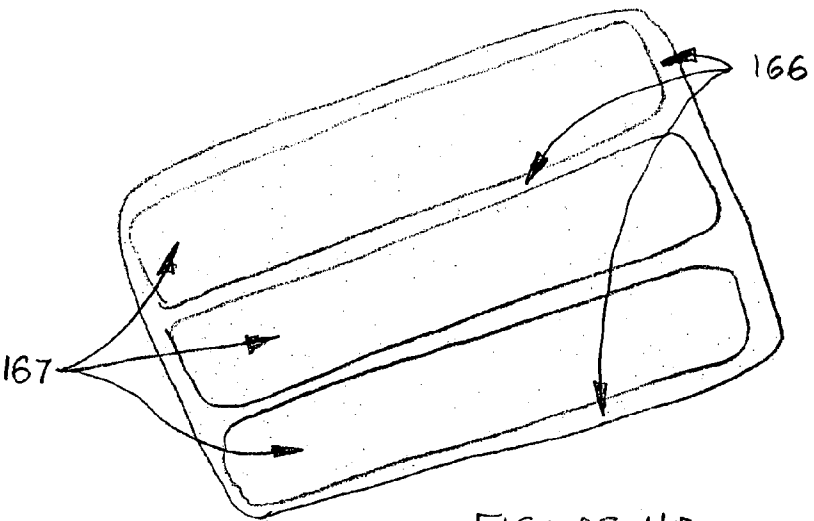
FIG. 4B is a cross-sectional view of the orographic cloud catcher of FIG. 4A in the direction of the arrows 4B-4B.
Figure 4A:
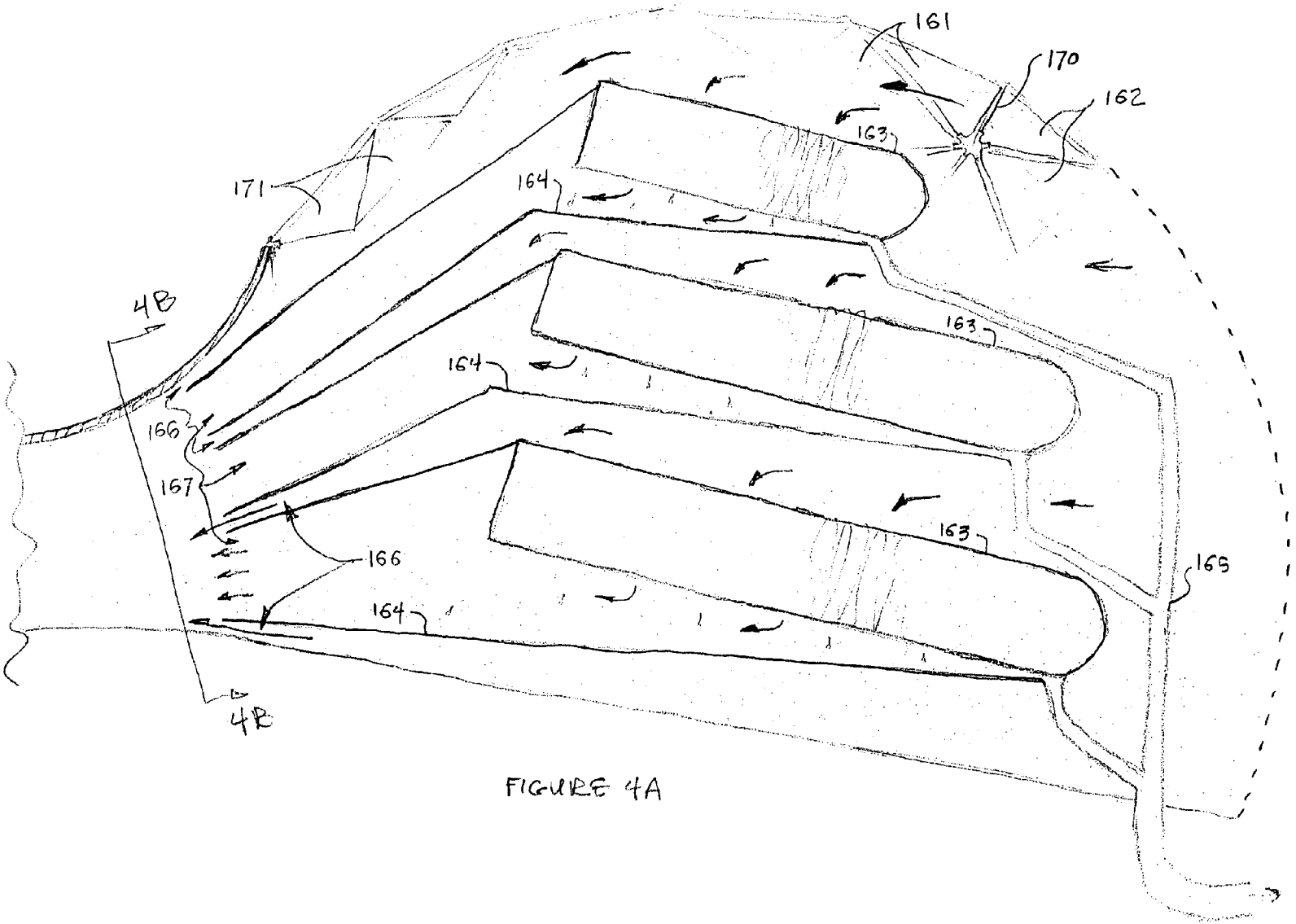
FIG. 4A is an enlarged view of the orographic cloud catcher of FIG. 4 contained in the circle 4A.

FIG. 4A is an enlargement of the inlet end of orographic cloud catcher 160 shown in FIG. 4. In FIG. 4A, the outer wind management air guide surfaces 161 of cloud catcher 160 are preferably formed by sailcloth triangular panels 161 secured to generally mast-like tubular struts 170 of a geodesic dome structure which employs bird netting or other more durable mesh 162 on the prevailing wind side to serve as intake air filter. A mechanism (not shown) is preferably provided for opening, in controlled fashion, hinged triangular panels 171 on the substantially vertical portions of the dome surface to vent excess air pressure in the event of hurricanes or similar high wind situations.

A tiered array of Very Low Pressure Drop (VLPD) cyclone arrays 163 is provided along with internal air guide surfaces 164 that both direct orographic cloud flows to the tops of cyclone arrays 163 and permit bypass flow to proceed to jet pump nozzle structures 166 for pressure differential maximization across the cyclone arrays 163. The internal air guide surfaces 164 preferably double as water collection and drainage surfaces, by being inclined such that "downhill" to the liquid water is towards the front of the cloud catcher 160, away from the discharge flow as it proceeds to the jet pump nozzle areas. Accordingly, water drainage piping 165 is provided to convey the collected water to a common outlet drain for further processing, storage, and distribution. It will be understood that a filter element (not shown) can be located upstream of the treatment, storage and distribution mechanisms for purification purposes. The filter element is preferably located in the water drainage piping. Prior to removing the filter element, a drainage tray should be positioned between the filter element and the treatment, storage and distribution mechanisms to inhibit contaminants from entering the collection mechanism. FIG. 4B is a cross-sectional view of FIG. 4A in direction of arrows 4B. In FIG. 4B, the "inside-out" jet pump nozzle configuration preferred for this architecture can be seen, having nozzle areas 166 arrayed both outside and within discharge areas 167 which correspond to the distribution areas 128 and 146 of the conventional architecture jet pumps shown in FIGS. 2 and 3 respectively. Referring back to FIG. 4, a low pressure drop pleated mesh array 168 is preferably provided at the end of the expansion section 169 to prevent birds, etc. from contaminating the internal workings of the apparatus.

Figure 5:
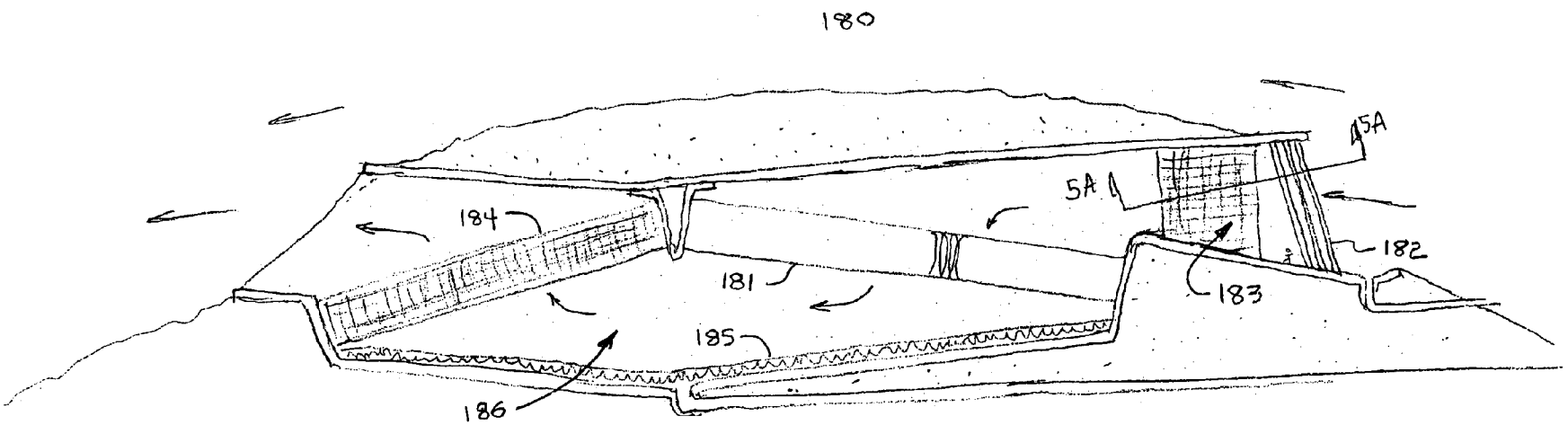
FIG. 5 is a schematic cross-sectional illustration of an orographic cloud catcher in accordance with a preferred embodiment of the present invention, having a cyclone array protected from airborne debris by both V-section grille members that also collect rainwater, and a pleated mesh array, and followed by a pleated mesh array to prevent birds from nesting inside, with renewable water filtration media applied to drainage areas.
Figure 5A:
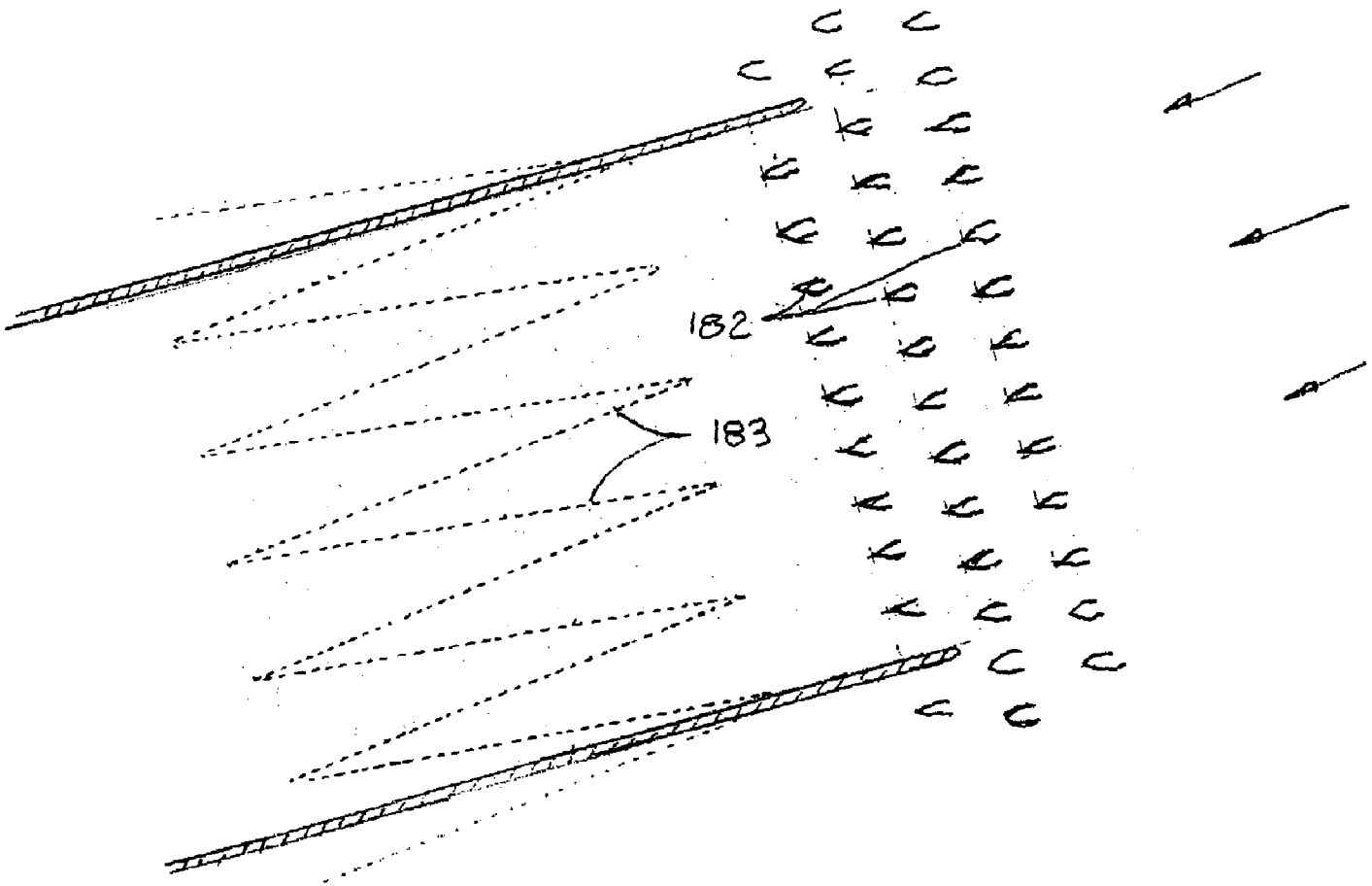
FIG. 5A is a cross-sectional illustration of the orographic cloud catcher of FIG. 5 in the direction of the arrows 5A-5A.

In FIG. 5, within orographic cloud catcher 180, a cyclone array 181 is protected from airborne debris by both (preferably rounded V-section) grille members 182 as also shown in FIG. 5A, that also collect rainwater, and a pleated mesh array 183, and is followed by pleated mesh array 184 to prevent birds from nesting inside. Renewable water filtration media 185 is applied to internal drainage areas 186.

FIG. 5A is a cross-sectional view in the direction of arrows 5A-5A in FIG. 5. It shows the preferably rounded V-section channels 182 and pleated mesh array 183 which are provided to stop large and small airborne debris respectively while capturing rainwater when available.

Figure 6:
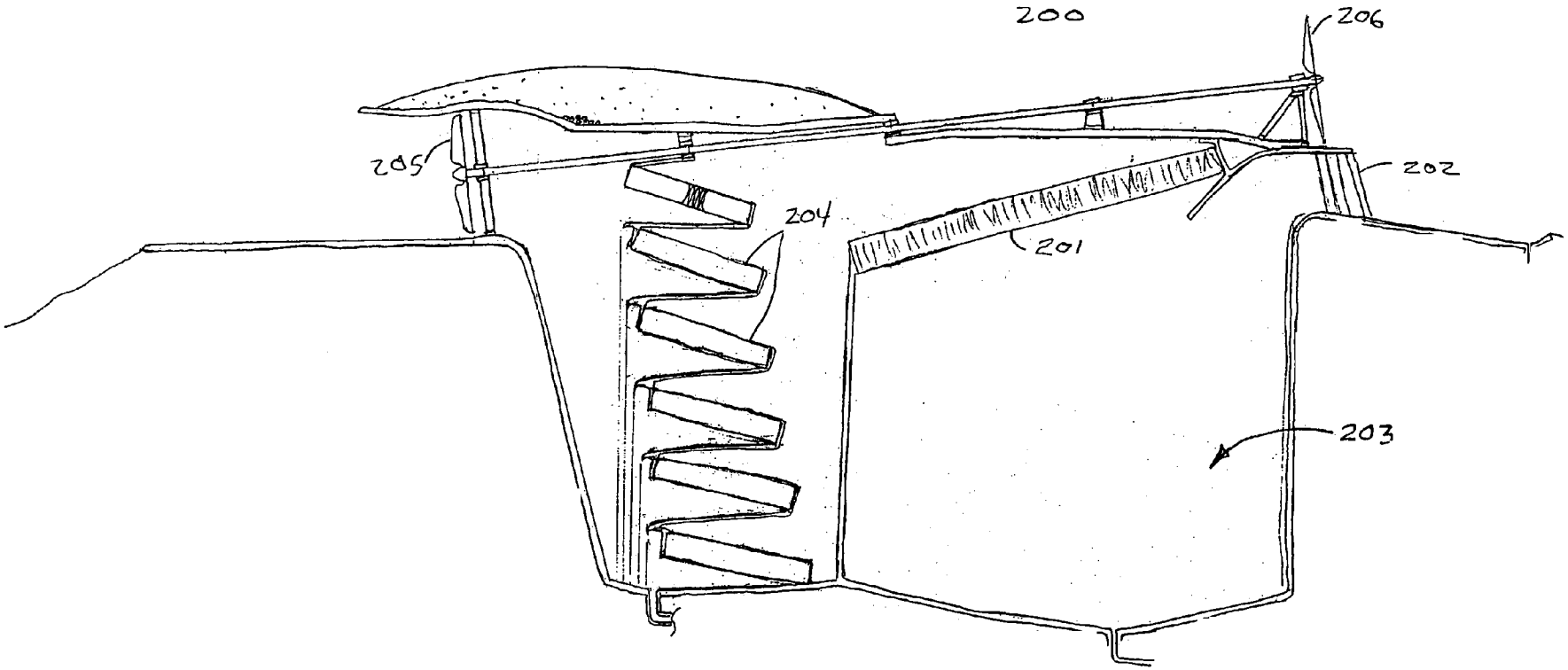
FIG. 6 is a schematic cross-sectional illustration of an orographic cloud catcher in accordance with a preferred embodiment of the present invention, having an enlarged-area pleated mesh array sheltered from sunlight and protected from airborne debris by a settling chamber, and a tiered array of VLPD cyclone arrays, with the series combination subject to both wind stagnation pressure and discharge side vacuum by means of a exhaust fan powered directly by the prevailing wind.

In FIG. 6, an orographic cloud catcher 200 has an enlarged-area pleated mesh array 210 sheltered from sunlight and protected from airborne debris by both preferably V-section grille bars 202 and settling chamber 203. A tiered array of VLPD cyclone arrays 204 follows, with the series combination subject to both wind stagnation pressure acting at the inlet opening, and discharge side vacuum by an exhaust fan 205 which is powered by a windmill 206 facing the prevailing wind.

Figure 7:
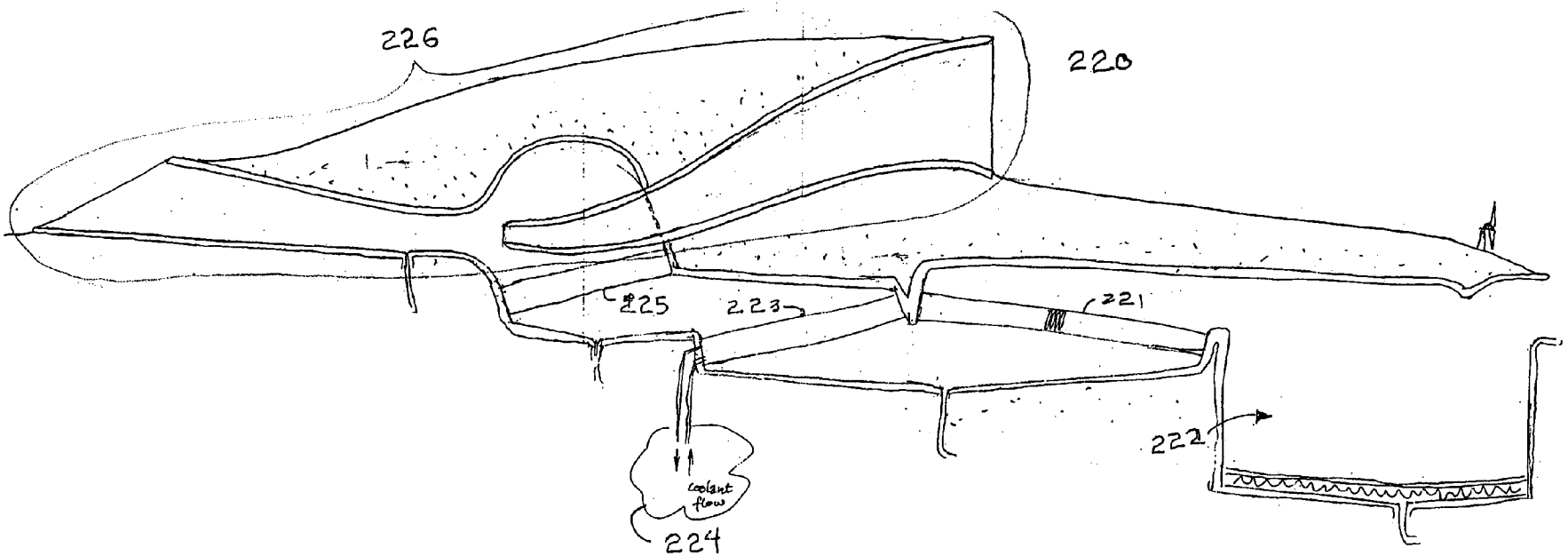
FIG. 7 is a schematic cross-sectional illustration of an orographic cloud catcher in accordance with a preferred embodiment of the present invention, having a cyclone array protected from airborne debris by a settling chamber, a cooling array supported by a wind powered refrigeration system (not shown), and a pleated mesh array, the series combination subject to both wind stagnation pressure and discharge side vacuum by means of a jet pump whose nozzle is powered directly by the prevailing wind.

In FIG. 7, an orographic cloud catcher 220 includes a cyclone array 221 protected from airborne debris by a settling chamber 222. A cooling array 223 supported by a refrigeration system 224, is followed by a pleated mesh array 225. The series combination is subject to both wind stagnation pressure and discharge side vacuum by way of a jet pump 226 whose nozzle is powered directly by the prevailing wind.

Figure 8:
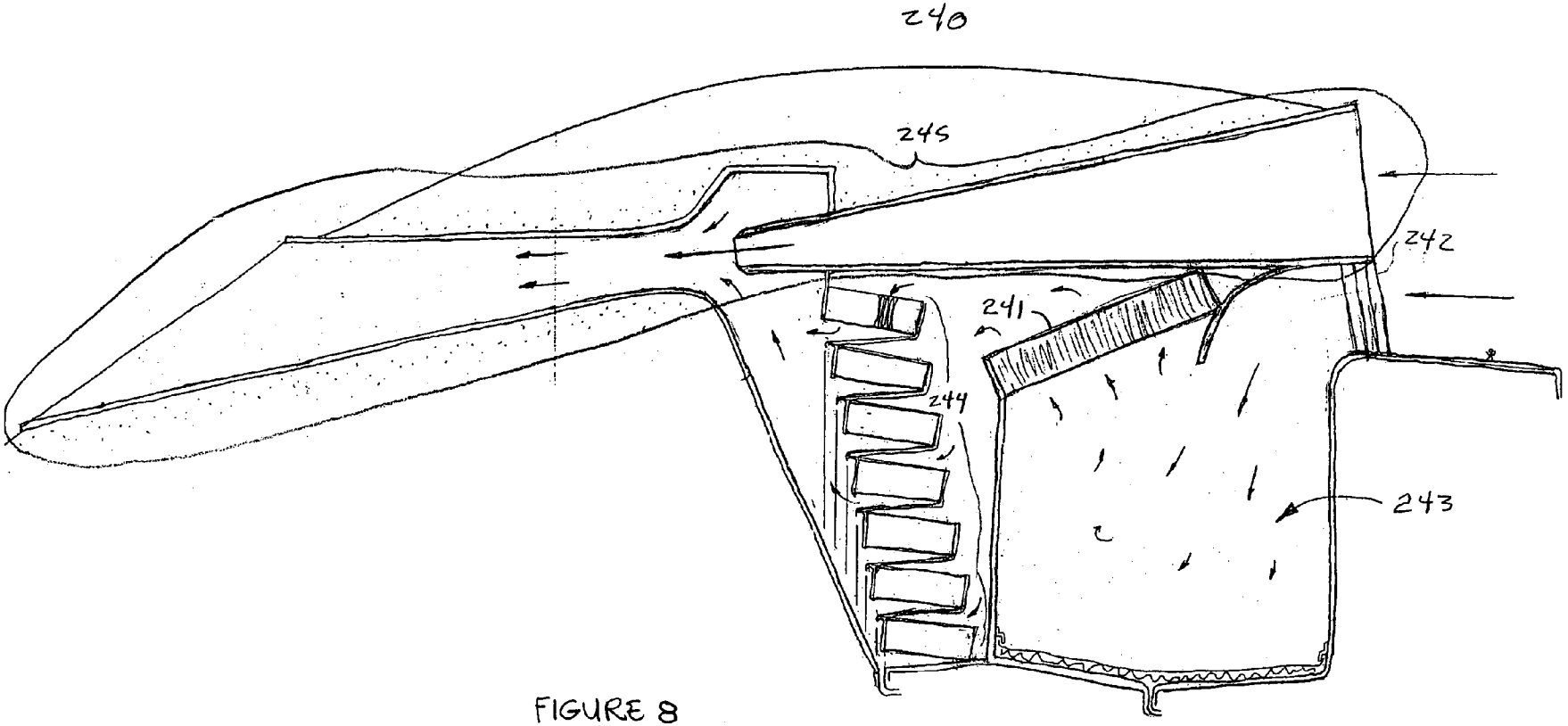
FIG. 8 is a schematic cross-sectional illustration of an orographic cloud catcher in accordance with a preferred embodiment of the present invention, having an enlarged-area pleated mesh array sheltered from sunlight and protected from airborne debris by a settling chamber, and a tiered array of VLPD cyclone arrays, with the series combination subject to both wind stagnation pressure and discharge side vacuum by means of a jet pump whose nozzle is powered directly by the prevailing wind.

In FIG. 8, an orographic cloud catcher 240 has an enlarged-area pleated mesh array 241 sheltered from sunlight and protected from airborne debris by V-section grille bars 242 and a settling chamber 243, and is followed by a tiered array 244 of VLPD cyclone arrays. The series combination is subject to the maximized passive system pressure differential of both wind stagnation pressure acting on the entry opening, and discharge side vacuum by way of a jet pump 245 whose nozzle is powered directly by the prevailing wind.

Figure 9:
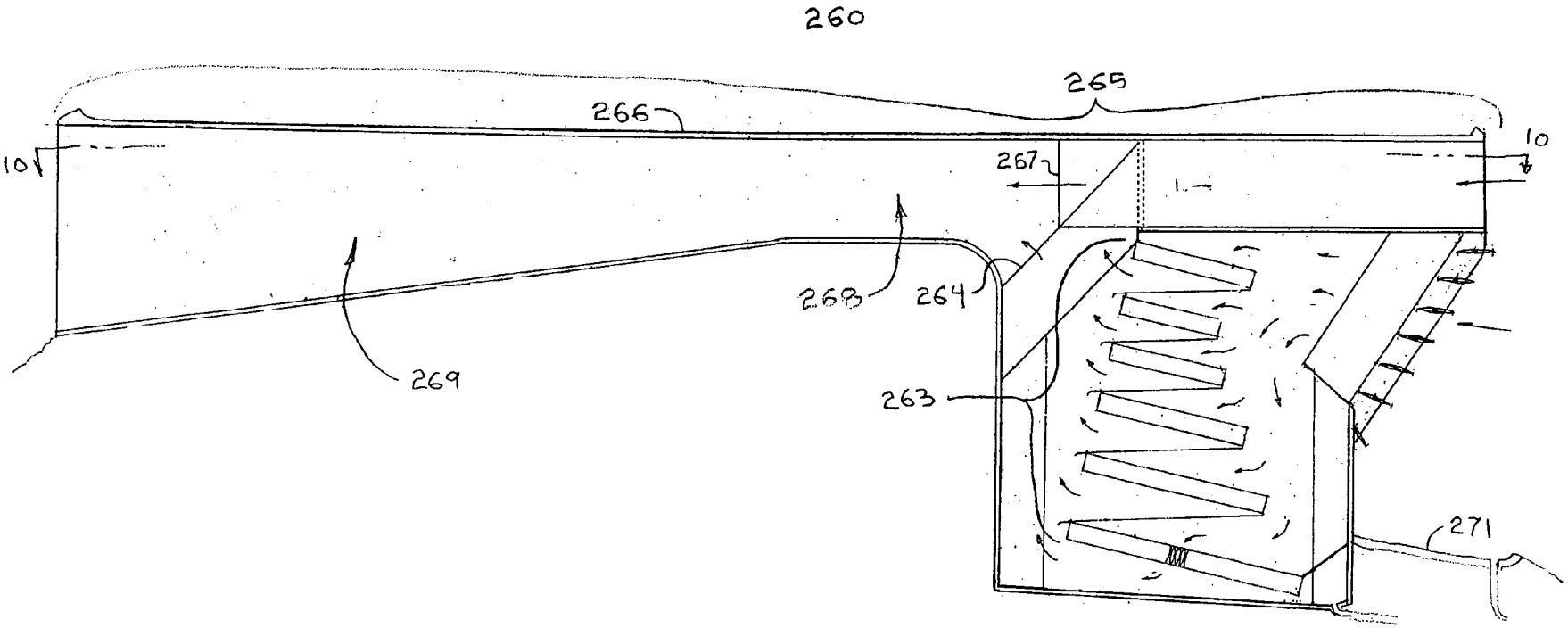
FIG. 9 is a schematic cross-sectional illustration of an orographic cloud catcher in accordance with a preferred embodiment of the present invention, having an enlarged-area pleated mesh array sheltered from sunlight and able to shed airborne debris downward, to be carried away through gaps with adjacent cloud catchers, rotateable louvers capable of closing off inlet flow, a tiered array of cyclone arrays, and a pleated mesh array for both water capture and bird protection, the series combination being subject to both wind stagnation pressure and discharge side vacuum by means of a jet pump whose nozzle is powered directly by the prevailing wind.
Figure 10:
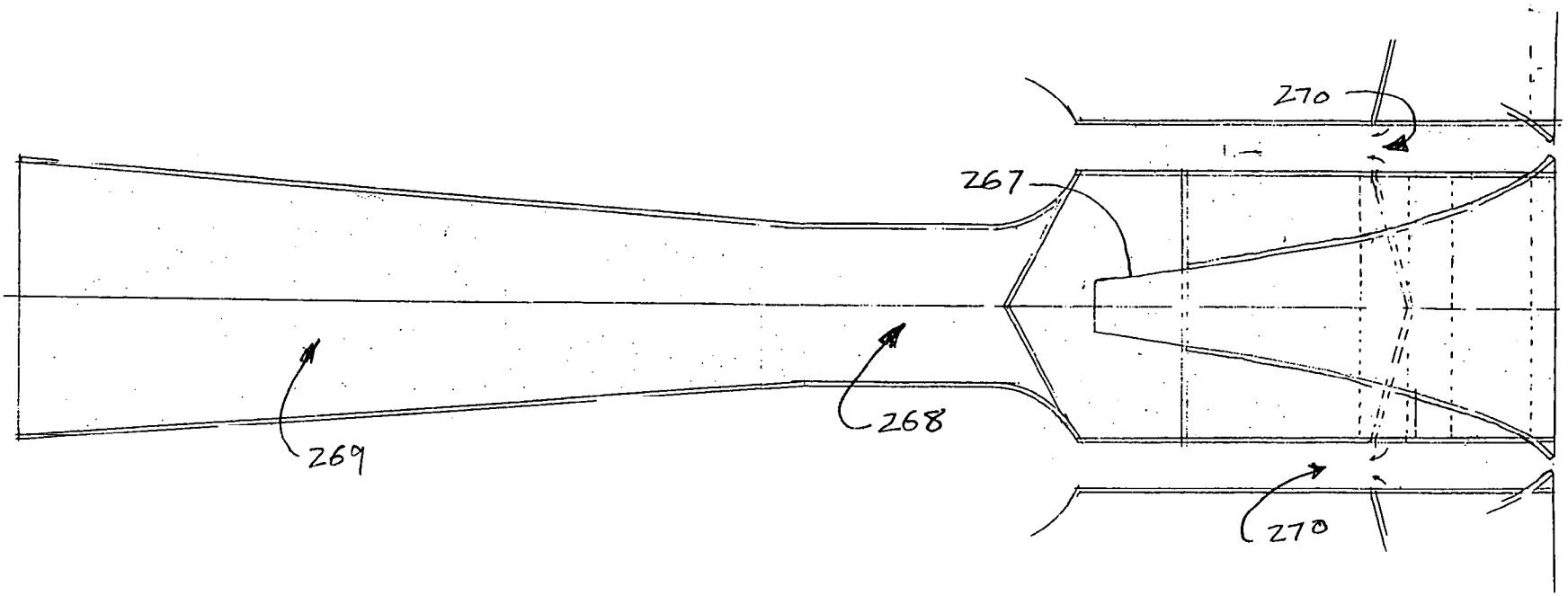
FIG. 10 is a top view section of the cloud catcher of FIG. 9, showing the jet pump nozzle which discharges into the jet pump mixing throat which in turn discharges into an elongated expansion section. Also shown are the gaps between adjacent cloud catchers whereby airborne debris is allowed to escape downwind rather than accumulating in a settling chamber for periodic removal.

In FIG. 9, an orographic cloud catcher 260 has an enlarged-area pleated mesh array 261 sheltered from sunlight and able to shed airborne debris downward, to be carried away downwind through gaps with adjacent cloud catchers as shown in FIG. 10, to provide an approximation of self-scavenging settling chamber functionality. A plurality of rotateable louvers 262 located upstream of the pleated mesh array 261 are capable of closing off inlet air flow for mesh service, and in case of severe weather, a water drainage apron 271 collects the water that falls from mesh array 261. A tiered array of cyclone arrays 263, is followed by pleated mesh array 264 for both water capture and bird encroachment protection, the series combination being subject to both wind stagnation pressure and discharge side vacuum by way of a jet pump 265 whose nozzle is powered directly by the prevailing wind. The jet pump 265 is configured for ease of construction by means of a flat roof 266 and a preferably stainless steel sheet metal nozzle extension 267, with requisite jet pump flow area changes being confined to contouring of vertical walls as shown in FIG. 10.

FIG. 10 is a top view section of the cloud catcher of FIG. 9, showing the jet pump nozzle 267 which discharges into the jet pump mixing throat 268 which in turn discharges into an elongated expansion section 269. Also shown in this figure are gaps 270 between adjacent cloud catchers whereby airborne debris is allowed to escape downwind rather than accumulating in a settling chamber for periodic removal.

Figure 11:
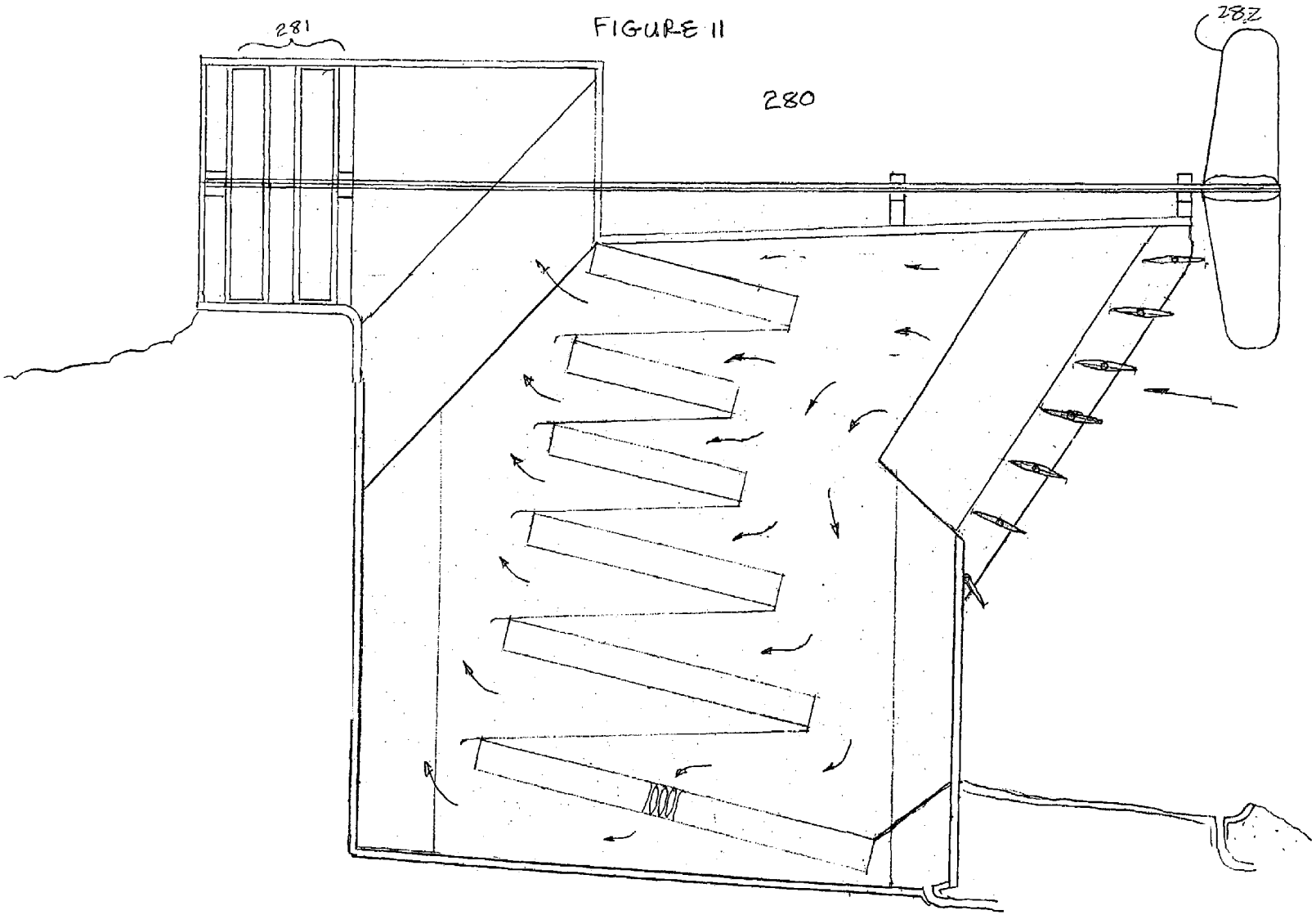
FIG. 11 is a schematic cross-sectional illustration of an orographic cloud catcher in accordance with a preferred embodiment of the present invention, having an enlarged-area pleated mesh array sheltered from sunlight and able to shed airborne debris downward, to be carried away through gaps with adjacent cloud catchers, rotateable louvers capable of closing off inlet flow, a tiered array of cyclone arrays, and a pleated mesh array for both water capture and bird protection, the series combination being subject to both wind stagnation pressure and discharge side vacuum by means of an exhaust fan array powered by a windmill subjected to the prevailing wind.

In FIG. 11, an orographic cloud catcher 280 can be seen to be identical with that of FIG. 9 except for the discharge side vacuum being supplied by way of an exhaust fan array 281 which is powered by windmill 282, subjected to the prevailing wind.

Figure 12:
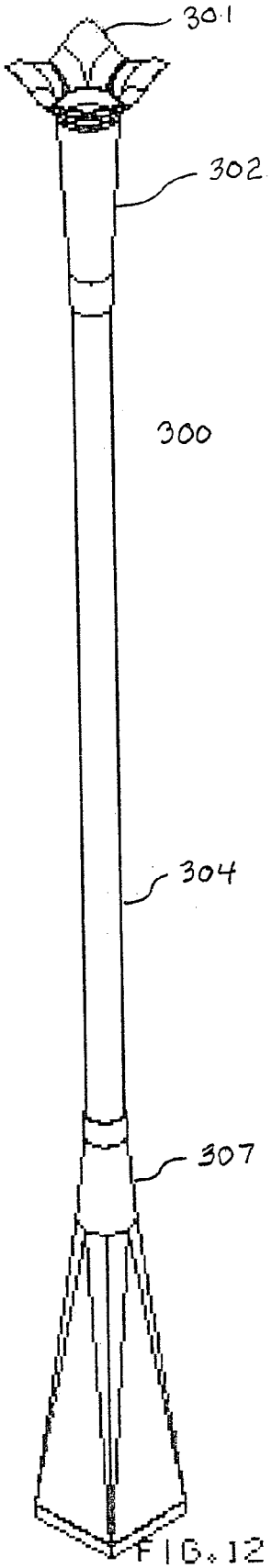
FIG. 12 is a schematic illustration of the very low pressure drop cyclone in accordance with a preferred embodiment of the present invention, having expansion section configured for being sealingly joined with adjacent cyclones in a square array.
Figure 12A:
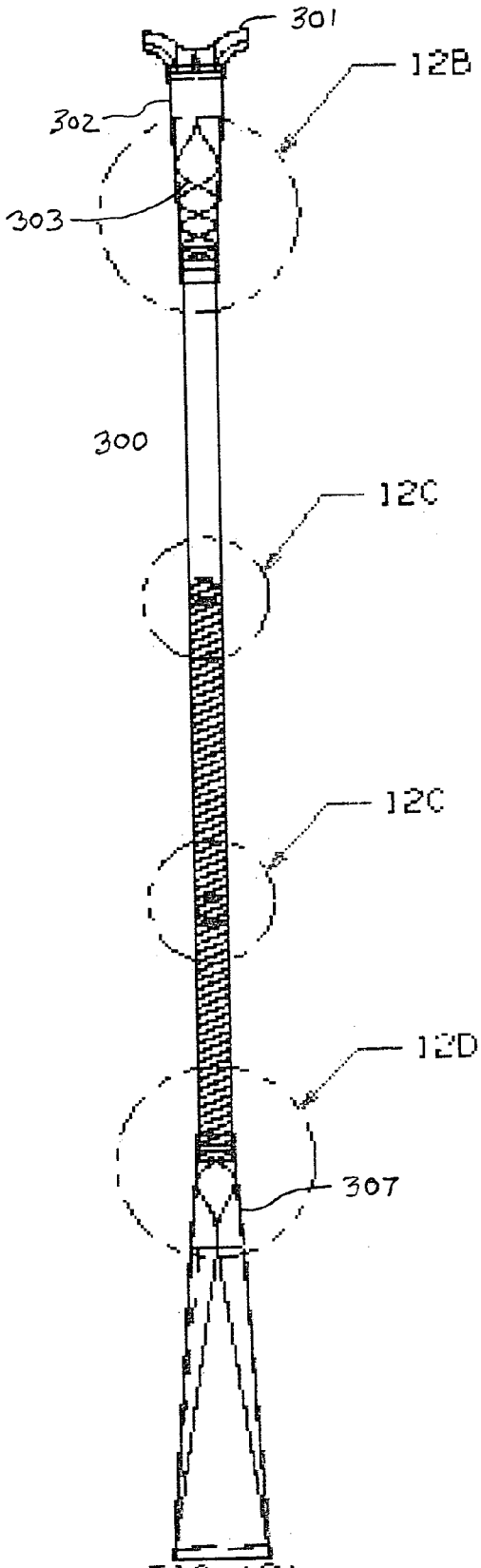
FIG. 12A is a cross-sectional view of the very low pressure drop cyclone of FIG. 12.
Figure 12B:
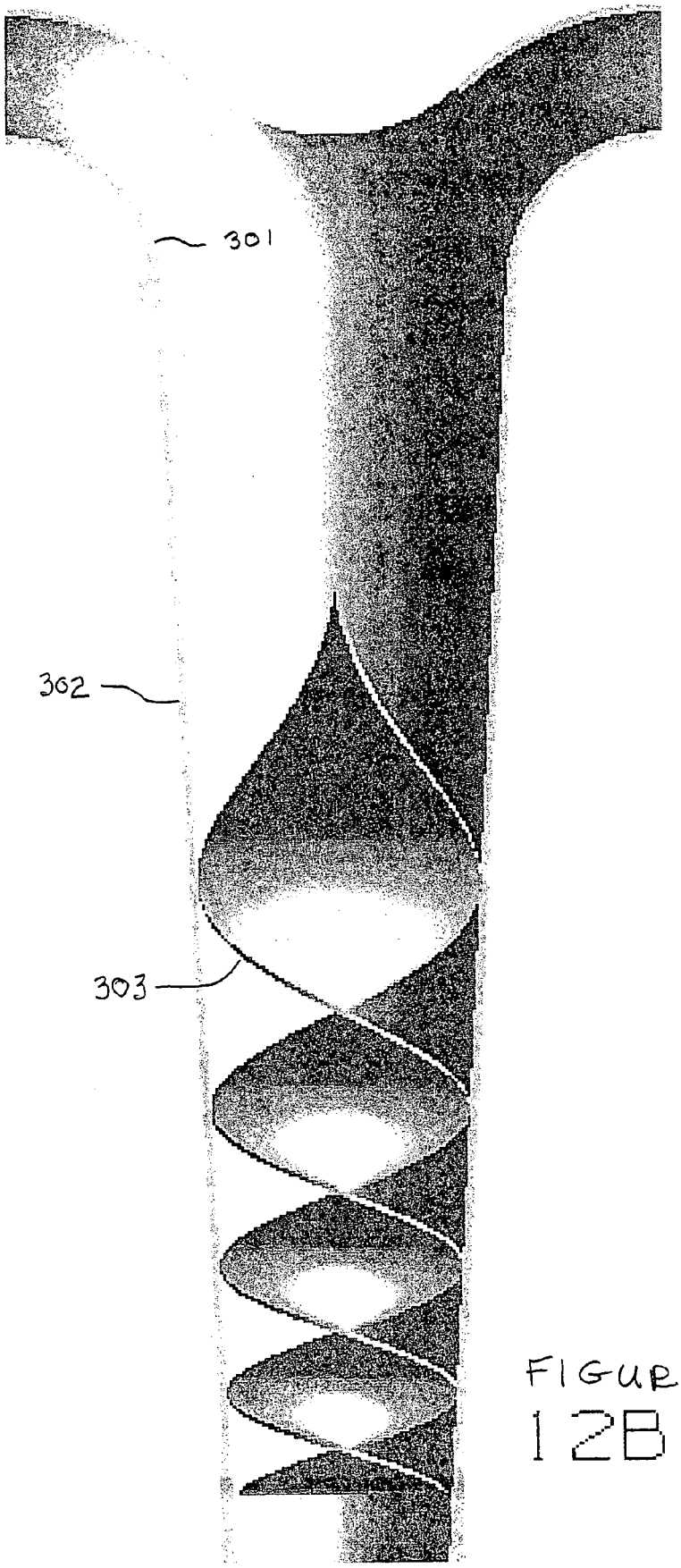
FIG. 12B is an enlarged cross-sectional view of the upper portion of the very low pressure drop cyclone of FIGS. 12 and 12A.
Figure 12C:
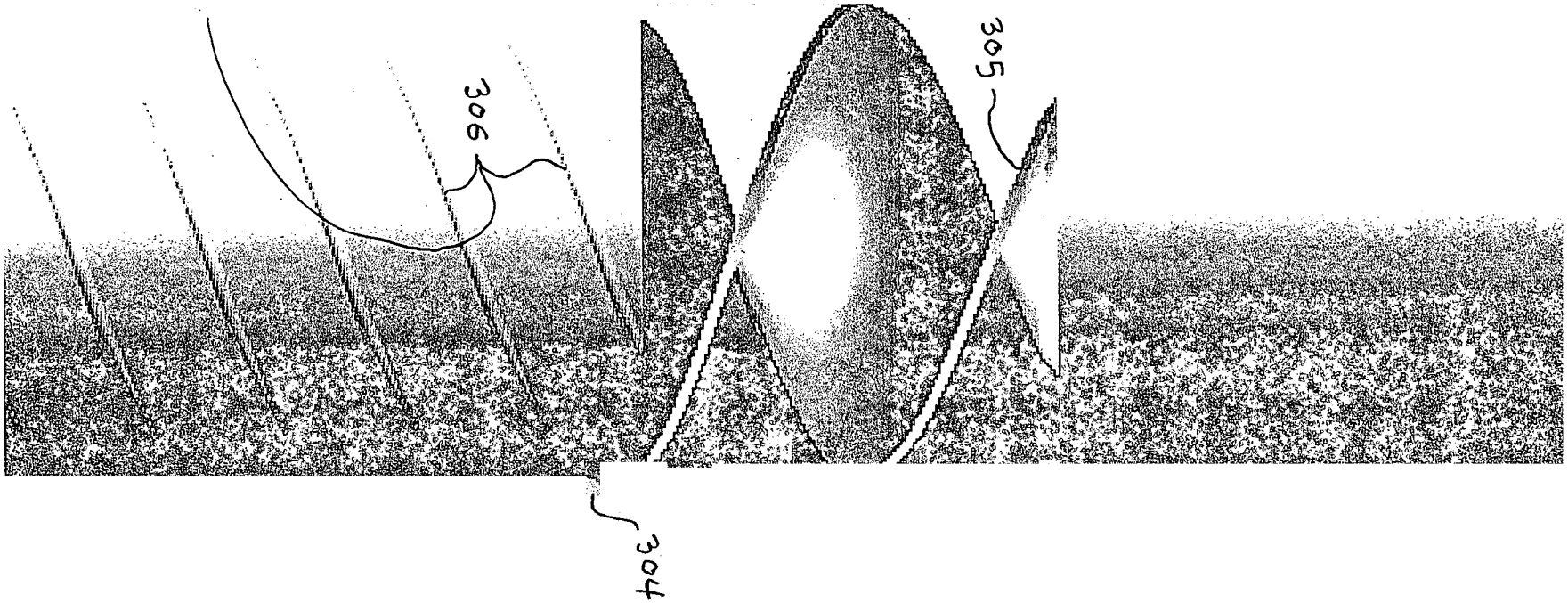
FIG. 12C is an enlarged cross-sectional view of the resetter vanes in middle portions of the very low pressure drop cyclone of FIGS. 12 and 12A.

In FIG. 12 and its partially sectioned counterpart FIG. 12A, the very low pressure drop cyclone 300 receives pressurized cloud flow from a rounded inlet array member 301 which is preferably sealingly joined with comparable adjacent cyclones. The aerosol flow enters an inlet cone 302 and encounters a helicoid inlet vane 303 which provides smoothly uniform angular acceleration to the point of significant rotational velocity. The inlet vane 303 preferably ends before the area contraction of the inlet cone 302 is complete at its union with the bore of body 304, to avoid compounding flow restrictions, as more clearly shown in enlargement view FIG. 12B. The swirling flow works to centrifuge aerosol condensate particles to the bore over time, but suffers angular deceleration due to wall friction with the bore. Accordingly, a resetter vane 305, also detailed in FIG. 12C, is provided after a period of axial advance, to reinvigorate spin velocity before the swirling flow pattern degrades to a precessing tornado tail-like stall-out phenomenon known as natural vortex length. In FIG. 12C, a plurality of helical grooves 306 formed in the bore preferably enable accumulated water to advance under motivation of both gravity and the swirling flow to the bottom of the body with minimal build-up at the inner surface of the bore, which is preferably conditioned to promote "wetting" as opposed to "beading" of separated water.

Figure 12D:
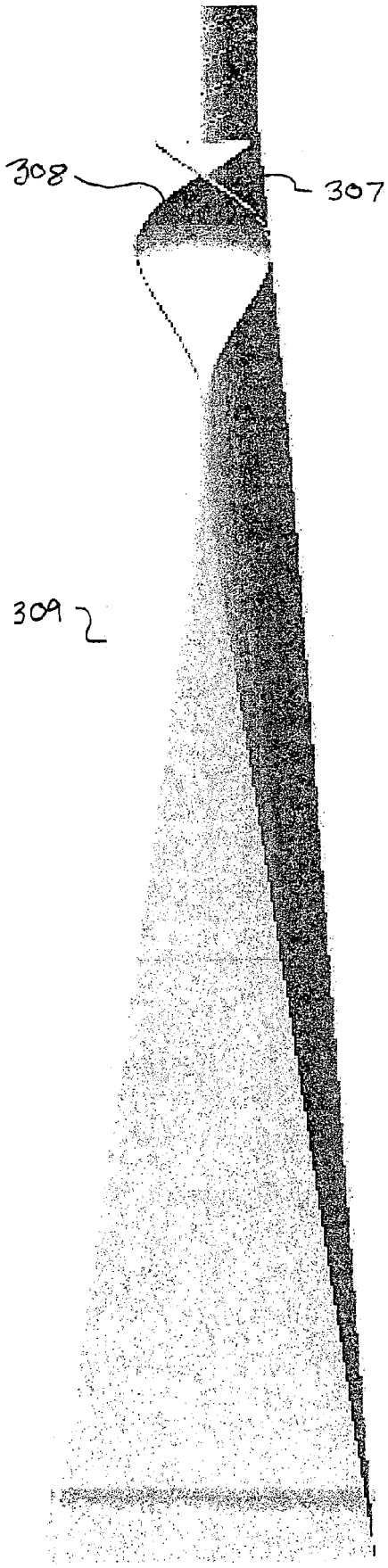
FIG. 12D is an enlarged cross-sectional view of a lower portion of the very low pressure drop cyclone of FIGS. 12 and 12A.

After appropriate time and swirl distance, the body 304 transitions into a diffuser cone 307, also detailed in enlargement view FIG. 12D, which gradually slows axial advance by its increase in cross-sectional area. The area increases in this manner before the swirling flow enters the region of the rectifier vane 308, in order that the rectifier vane 308 does not represent a compounding flow restriction with the small diameter end of the diffuser cone 307. The rectifier vane 308 acts to gradually reduce spin velocity with axial advance, in order to recover kinetic energy from the rotating inertia as invested by the inlet vane 303. This spin reduction/energy recovery acts to increase static pressure thereby reducing differential pressure, or pressure drop, between inlet and discharge ends of cyclone 300.

Further, gradual expansion of the now substantially axial (non-rotating) flow to further increase static pressure to a value closer to that at the entry cone is provided by an expansion section 309, with its "transition piece" configuration smoothly transitioning to a (square in this instance) shape that can be self-sealingly joined with comparable cyclones in an array that separates inlet pressure from discharge pressure with minimal leakage such that the maximum pressure differential works to cause flow through the cyclones 300. Water that has been separated from the aerosol flow by centrifugal force simply drains from the walls of the expansion section 309 to drip on the collection means which in turn conveys it to treatment, storage, and distribution means (not shown). The novel single internal surface construction of the VLPD cyclone differs from traditional cyclones, which have smaller concentric "vortex finder" tubes (with centrifugal pressure differential penalty associated with the radial displacement) sealingly mounted in a water-collecting "tube sheet", so-called, in order to gain dryness of outlet flow, because simple water collection functionality does not require dry outlet flow.

Figure 13A:
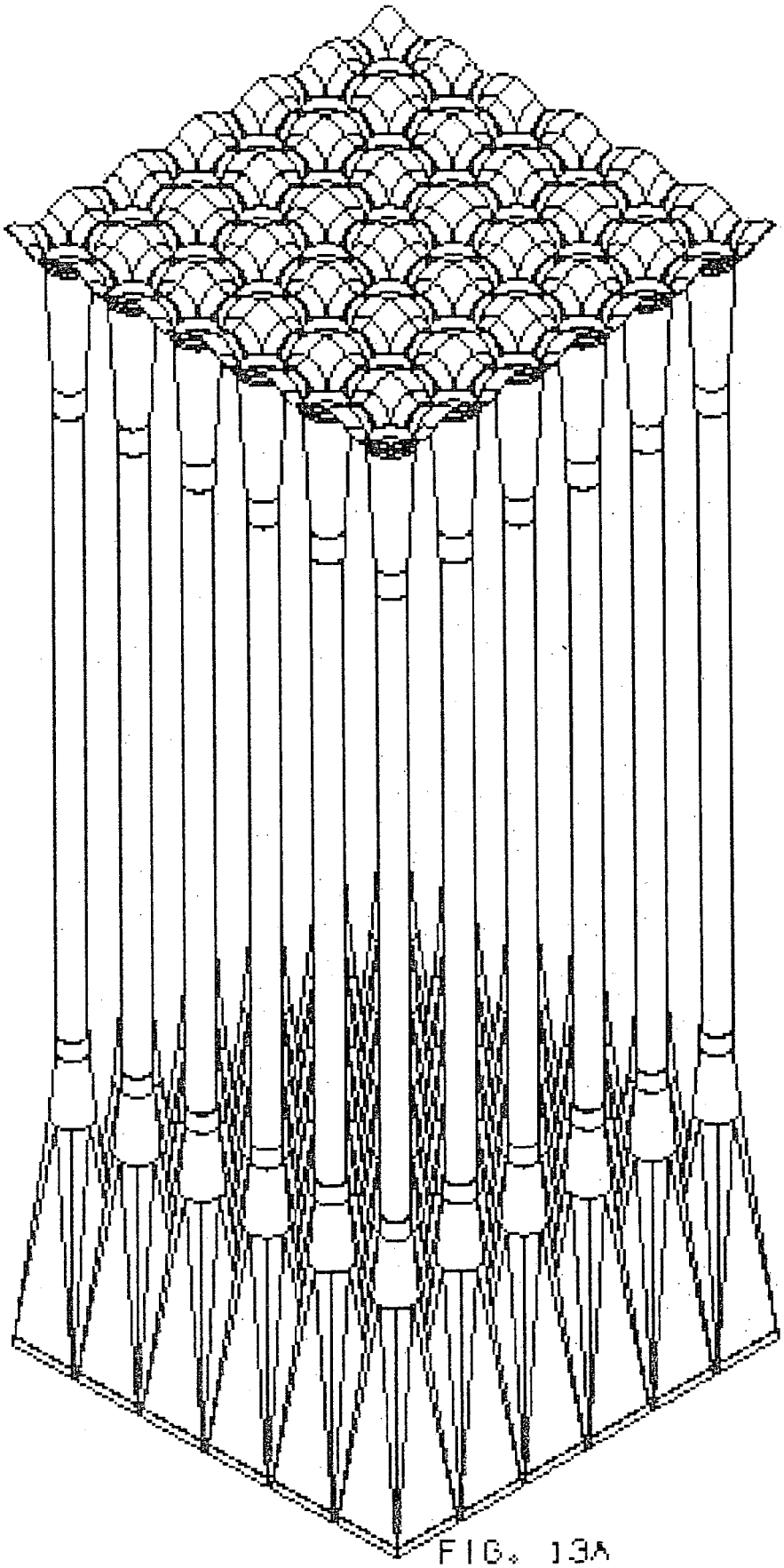
FIG. 13A is a schematic illustration of the very low pressure drop cyclone in array with duplicates of the present invention, having rounded inlet members sealingly joined with adjacent cyclones in square array; x

FIG. 13A shows a partial array of the very low pressure drop cyclones 300 of FIG. 12 being preferably sealingly joined with adjacent cyclones in a square array.

Figure 13B:
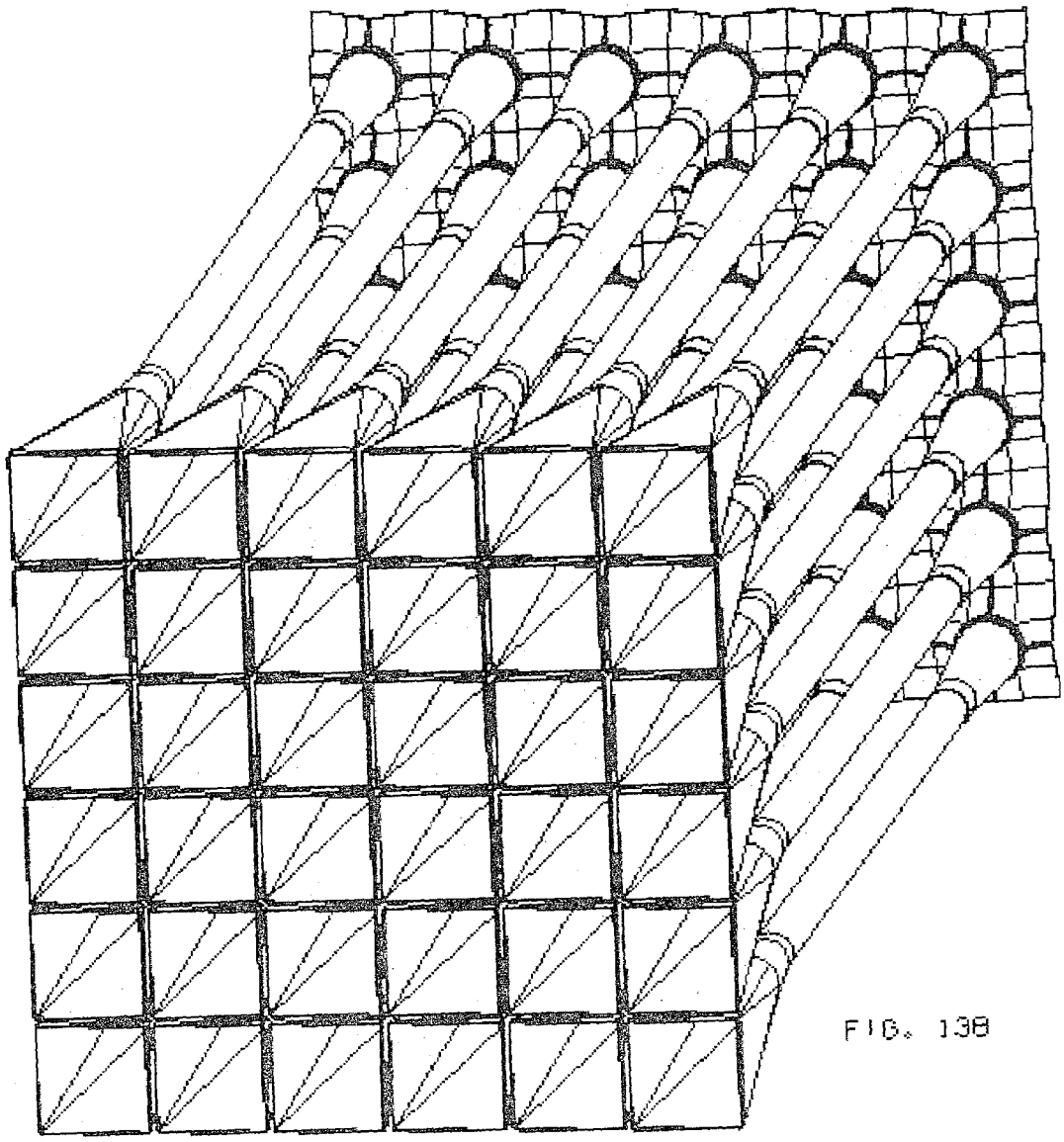
FIG. 13B is a schematic illustration of the very low pressure drop cyclone in array with duplicates of the present invention, having expansion sections sealingly joined with adjacent cyclones in square array.

FIG. 13B shows this same partial array viewed from below, revealing the preferred sealingly joined arrangement which separates the inlet-pressurized air above the array from the discharge plenum pressure air below.

Figure 14:
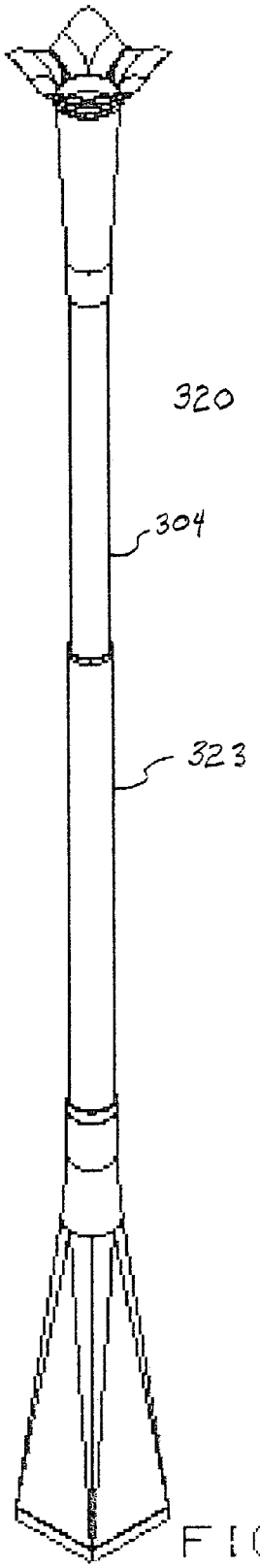
FIG. 14 is a schematic illustration of a variant of the very low pressure drop cyclone in accordance with a preferred embodiment of the present invention, having water bleed slots from the bore to an outer enclosure.

FIG. 14 shows a variant 320 of the very low pressure drop cyclone in which water bleed slots from the bore to an outer enclosure 321 are provided to minimize the hydraulic roughness of water build-up in the bore.

Figure 14A:
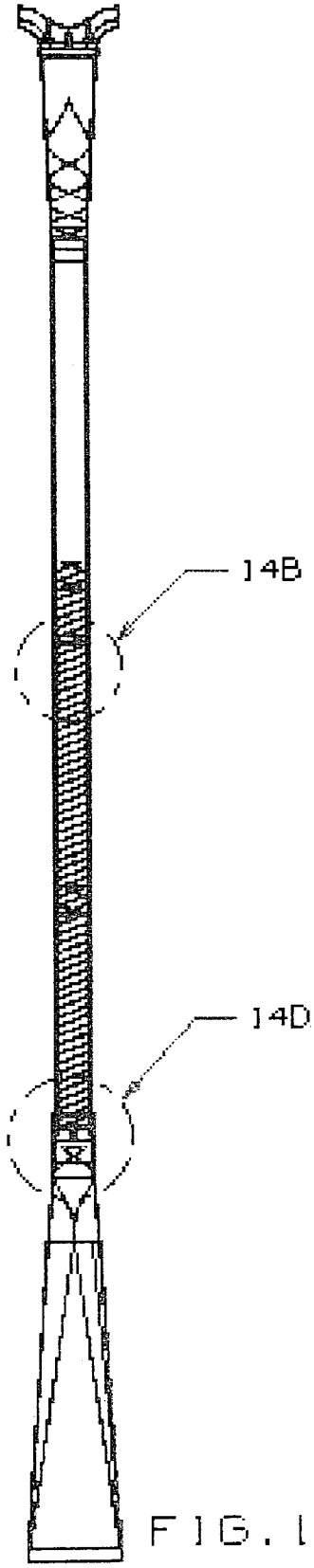
FIG. 14A is a cross-sectional view of the very low pressure drop cyclone of FIG. 14.

FIG. 14A shows the enclosing elements of the very low pressure drop cyclone 320 sectioned away to reveal details of its construction.

Figure 14B:
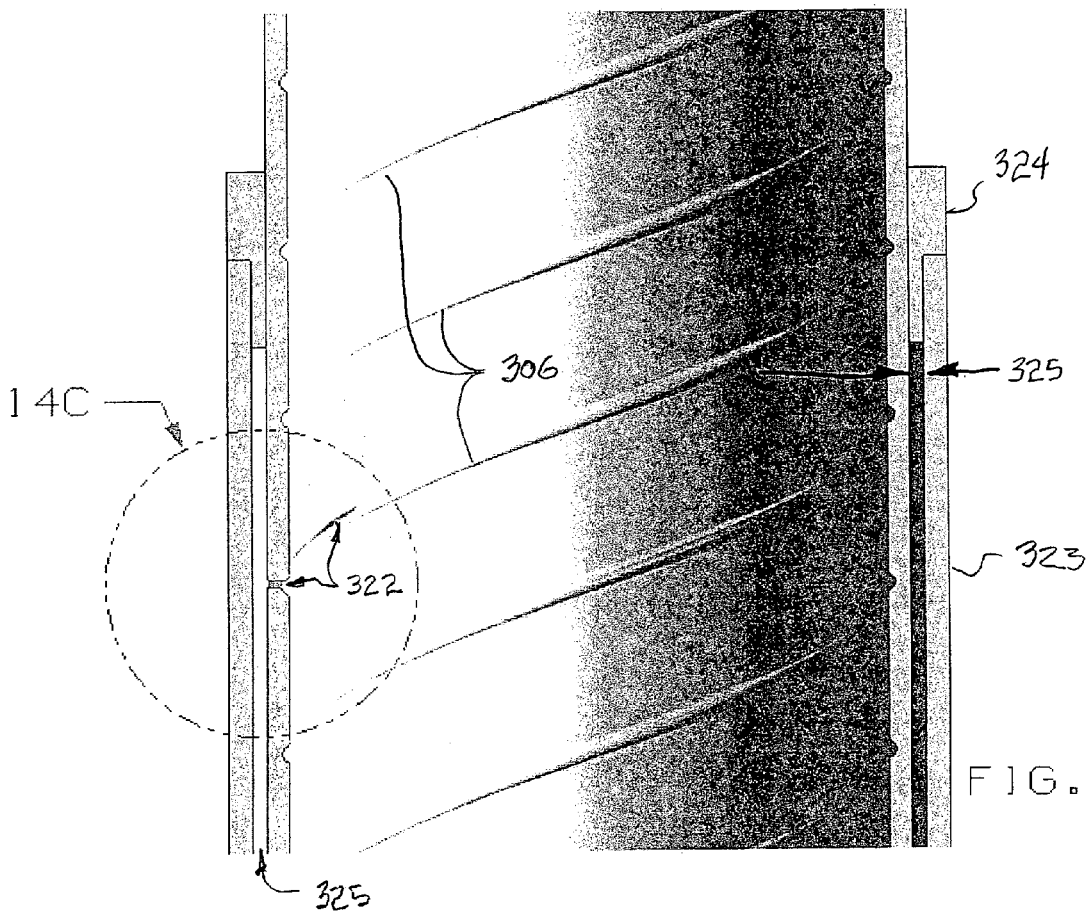
FIG. 14B is an enlarged view of circle 14B in the middle portion of the very low pressure drop cyclone of FIG. 14A.
Figure 14C:
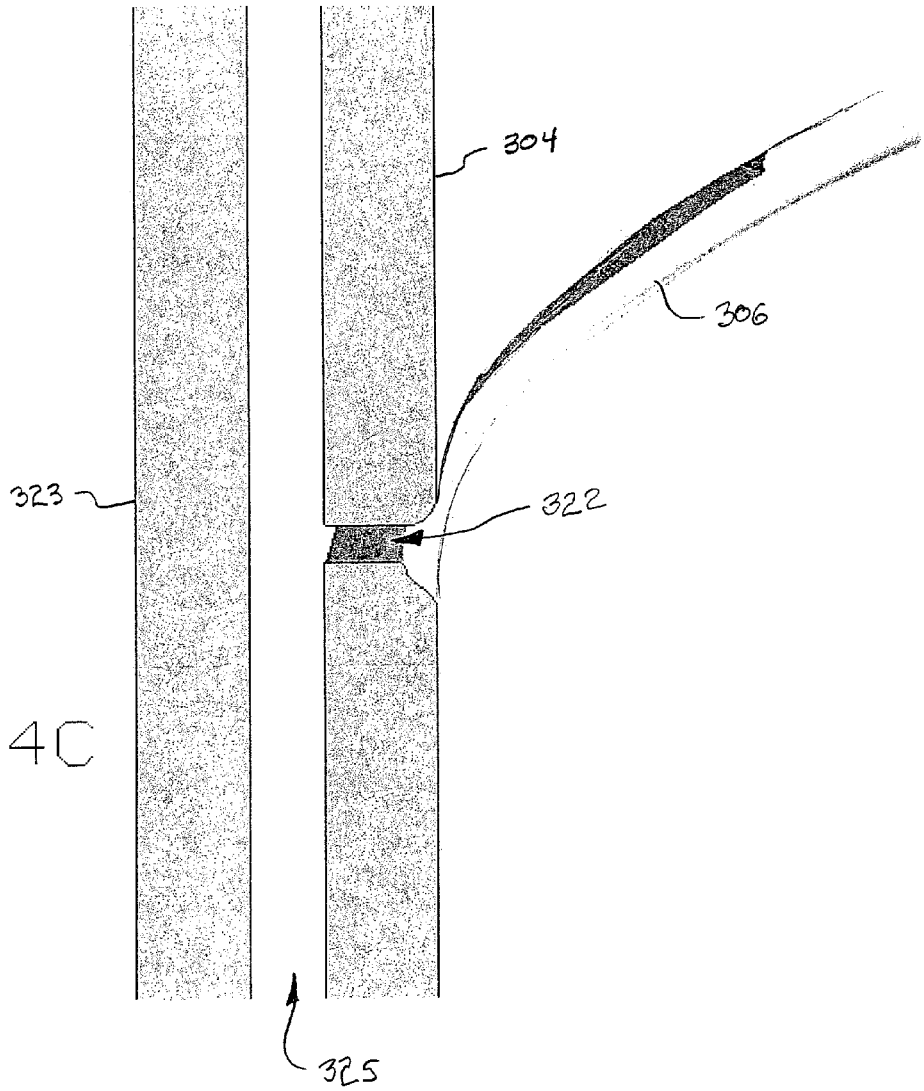
FIG. 14C is a further-enlarged detail view of circle 14C in FIG. 14B

FIG. 14B, located by circle 14B in FIG. 14A, again shows helical grooves 306, and a capillary bleed slot 322, one of a plurality, preferably entirely within a groove as further detailed in enlargement FIG. 14C, which is located by circle 14C in FIG. 14B. Also shown in FIG. 14B are outer containment tube 323 and collar 324 which locates and seals outer containment tube 323 to body 304 with gap 325 between them.

FIG. 14C shows, in close-up enlargement, a capillary bleed slot 322 in its preferred location at the bottom of preferred helical groove 306, where it can allow built up water to escape the groove rather than filling it.

Figure 14D:
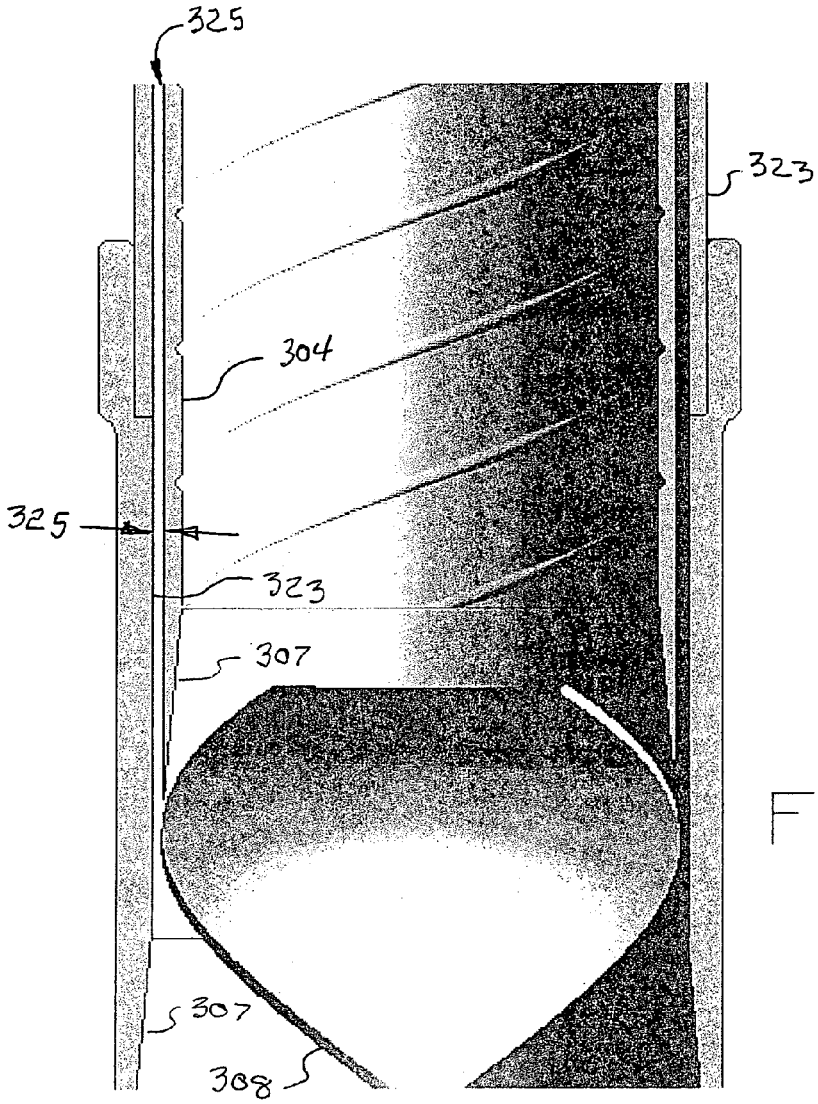
FIG. 14D is an enlarged view of a lower portion of the very low pressure drop cyclone as located in circle 14D of FIG. 14A.
Figure 15A:
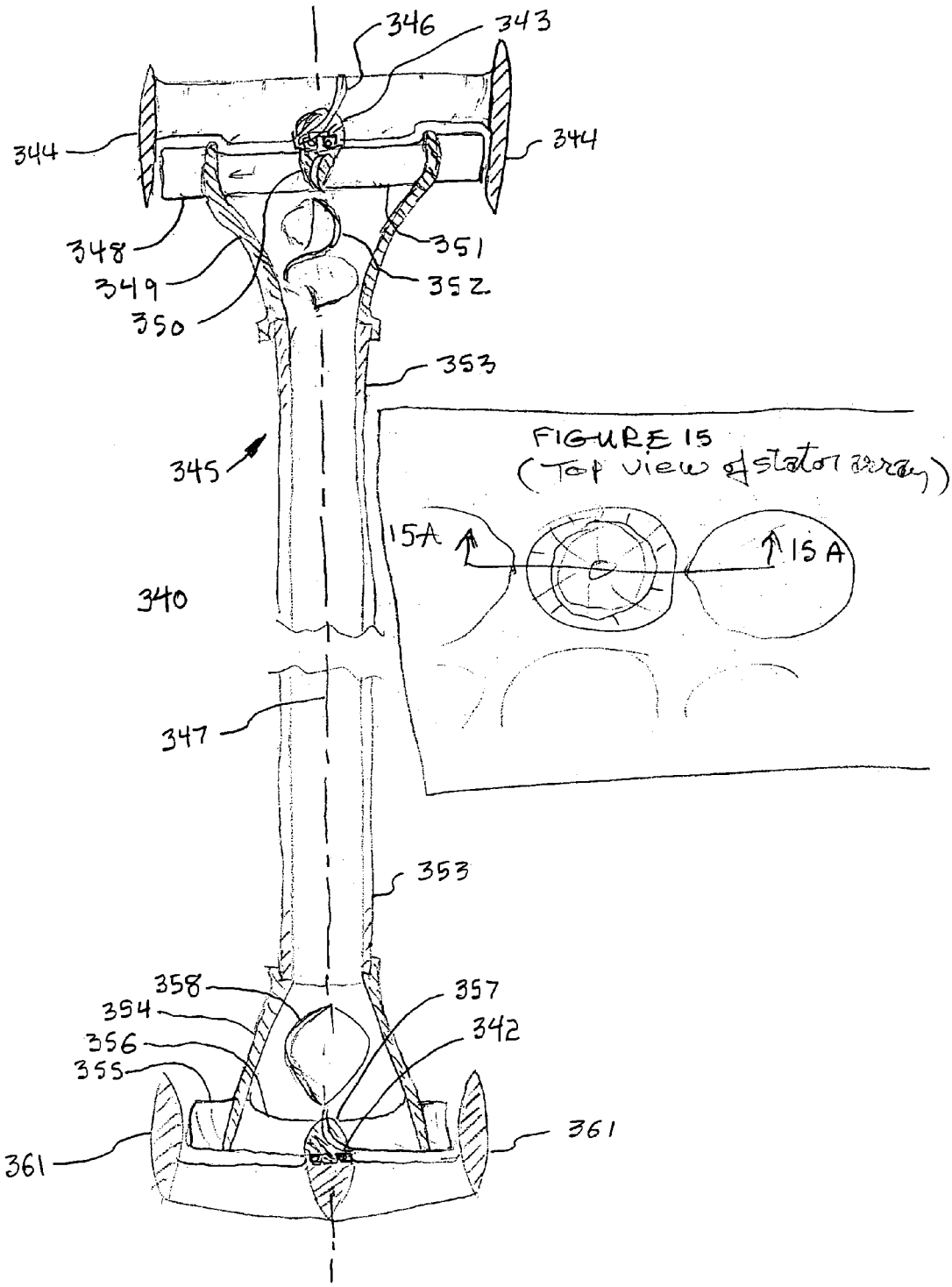
FIG. 15 is a schematic illustration of the spinning very low pressure drop cyclone, in accordance with a preferred embodiment of the present invention.

FIG. 14D, located in FIG. 14A by circle 14D, shows body 304 begin at the same diffuser cone area expansion as in the preferred construction of FIG. 12, until reaching the gap to outer containment tube 323, which preferably continues the area expansion begun in body 304 with coincident cone locations. The gap 325 is thus preferably an interruption in what would otherwise be a continual conical inner diffuser surface, as is the case in the cyclone of FIG. 12D.

Figure 15:
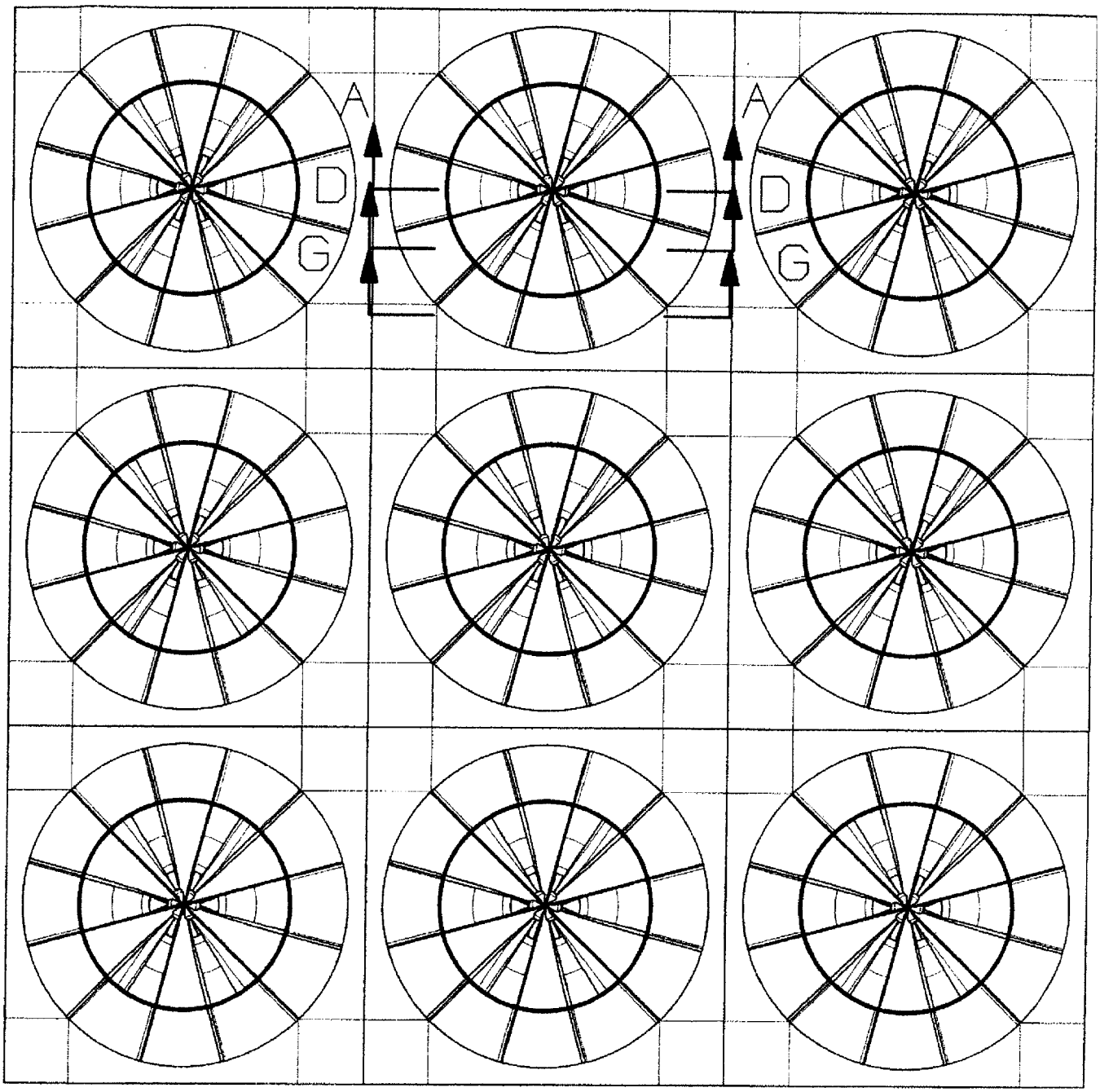
Figure 15A:
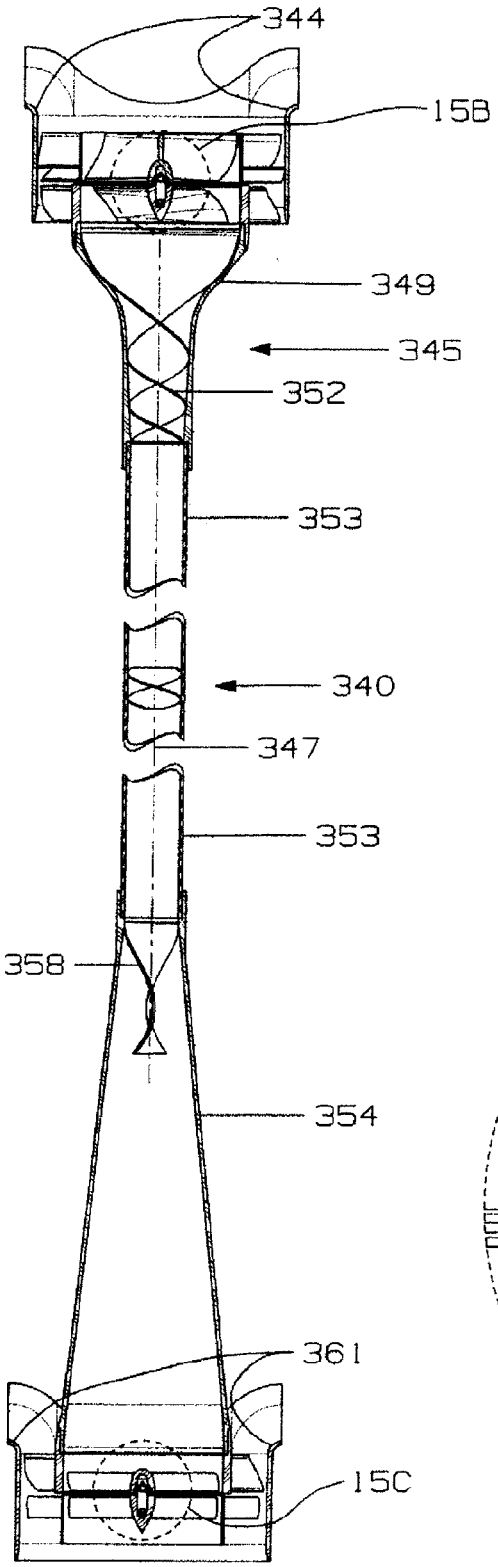
Figure 15B:
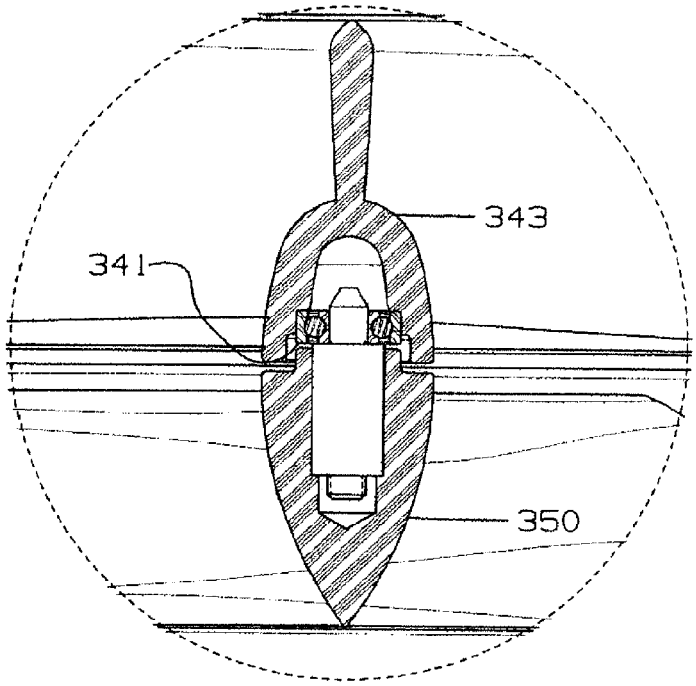
Figure 15C:
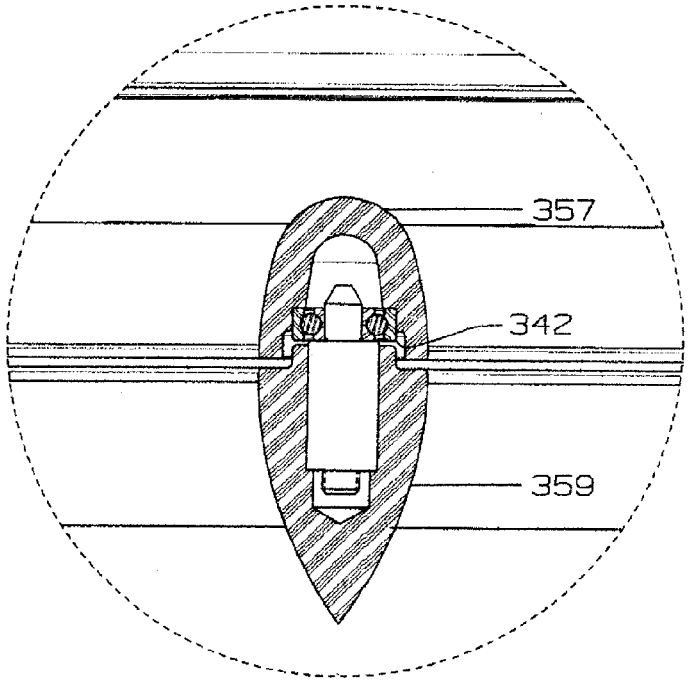
Figure 15D:
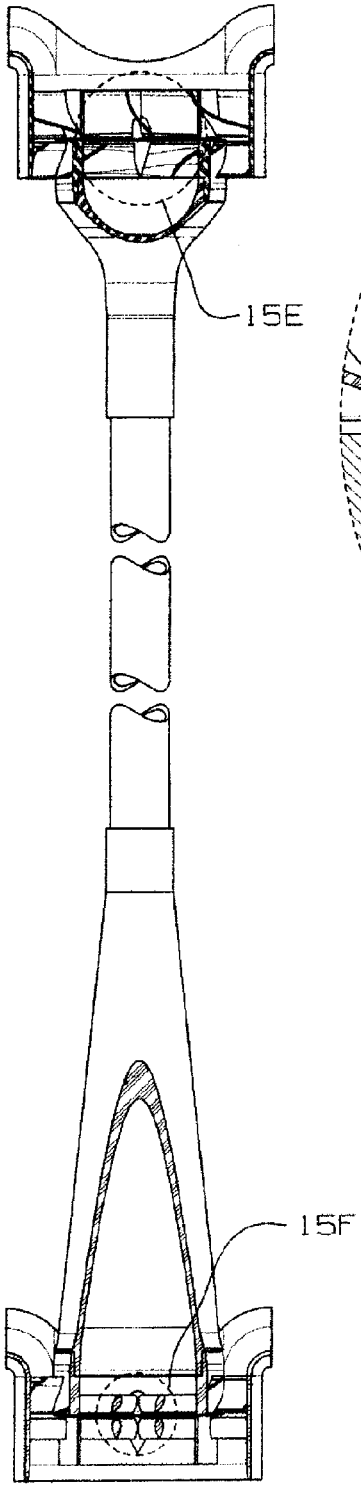
Figure 15E:
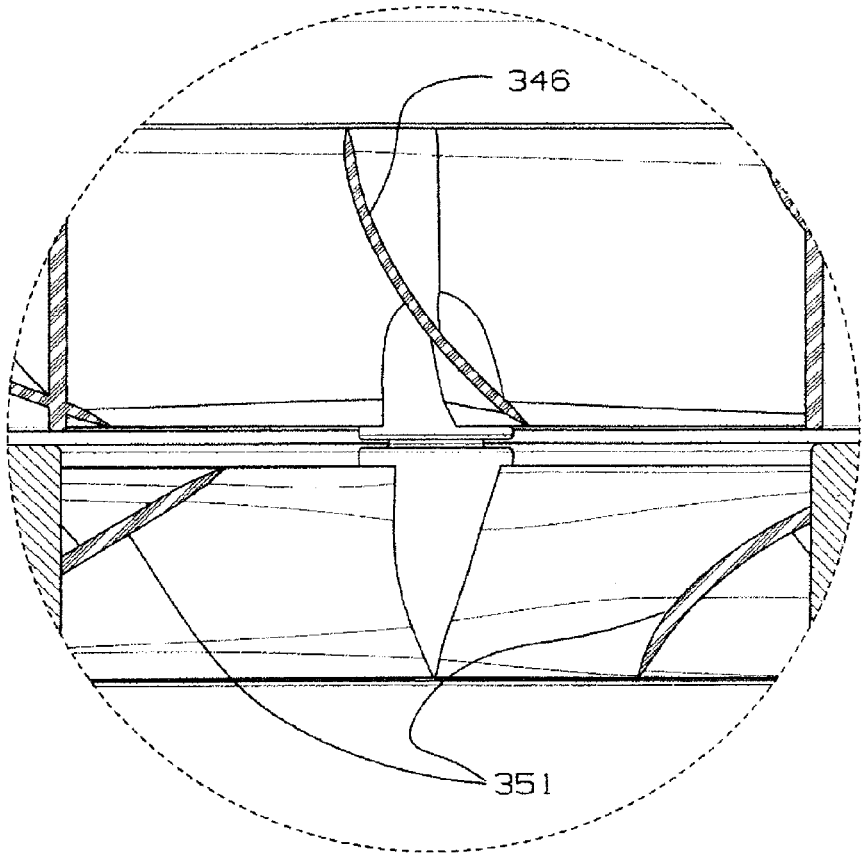
Figure 15F:
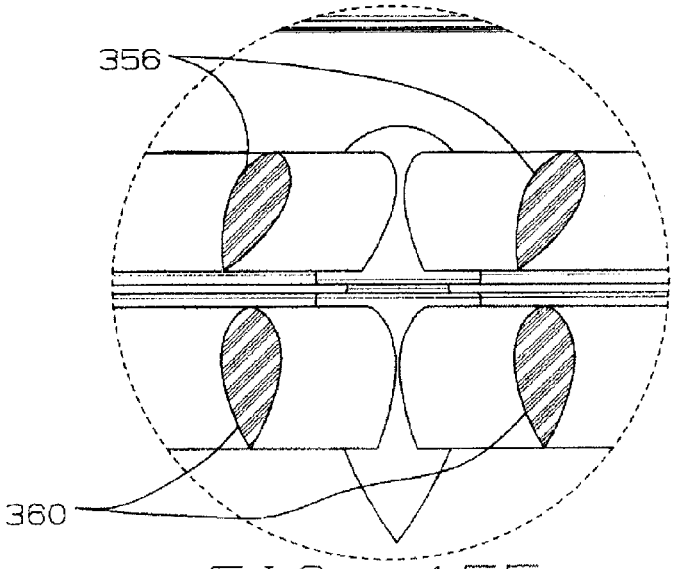
Figures 15G, 15H, 15J:
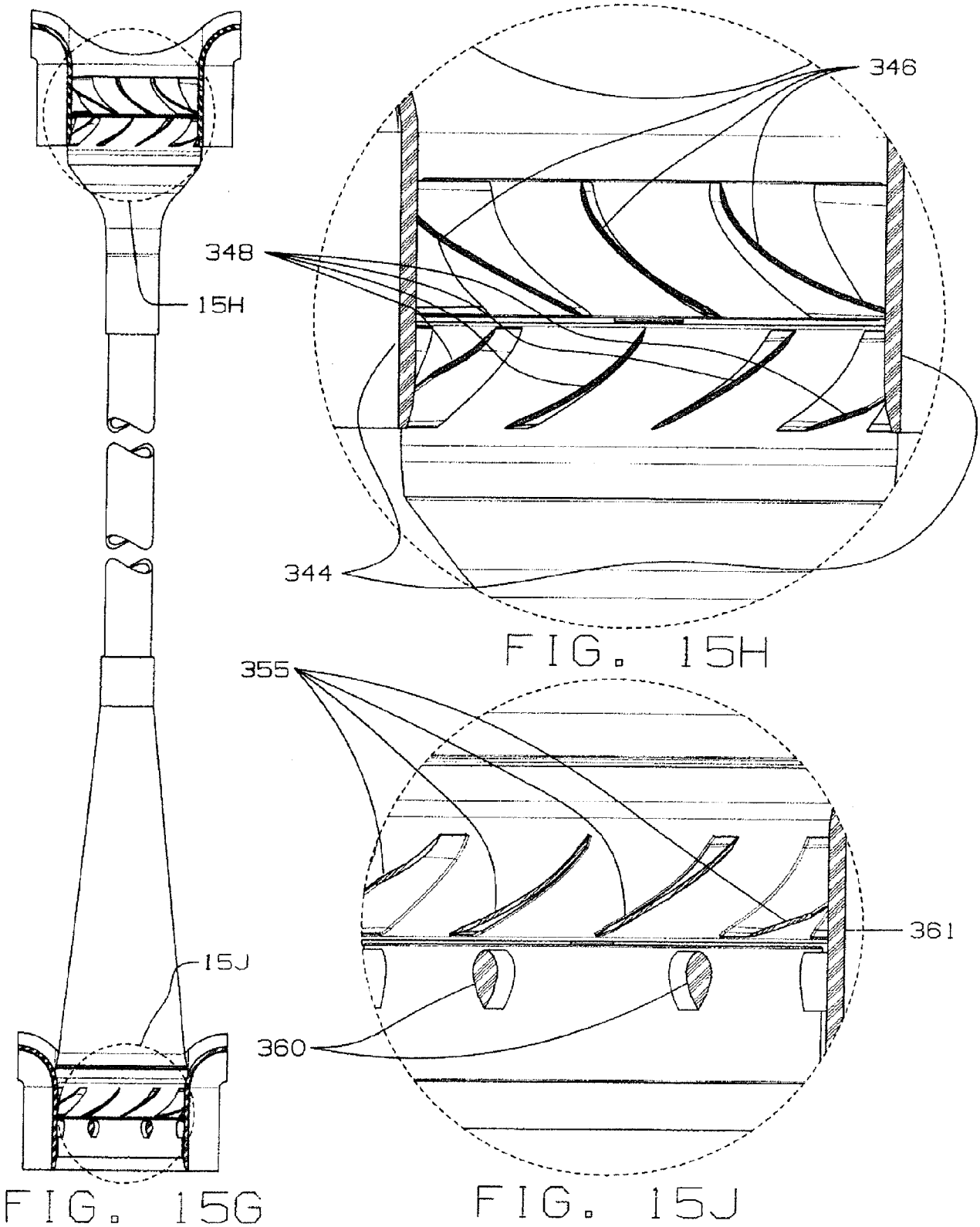
Figure 16A:
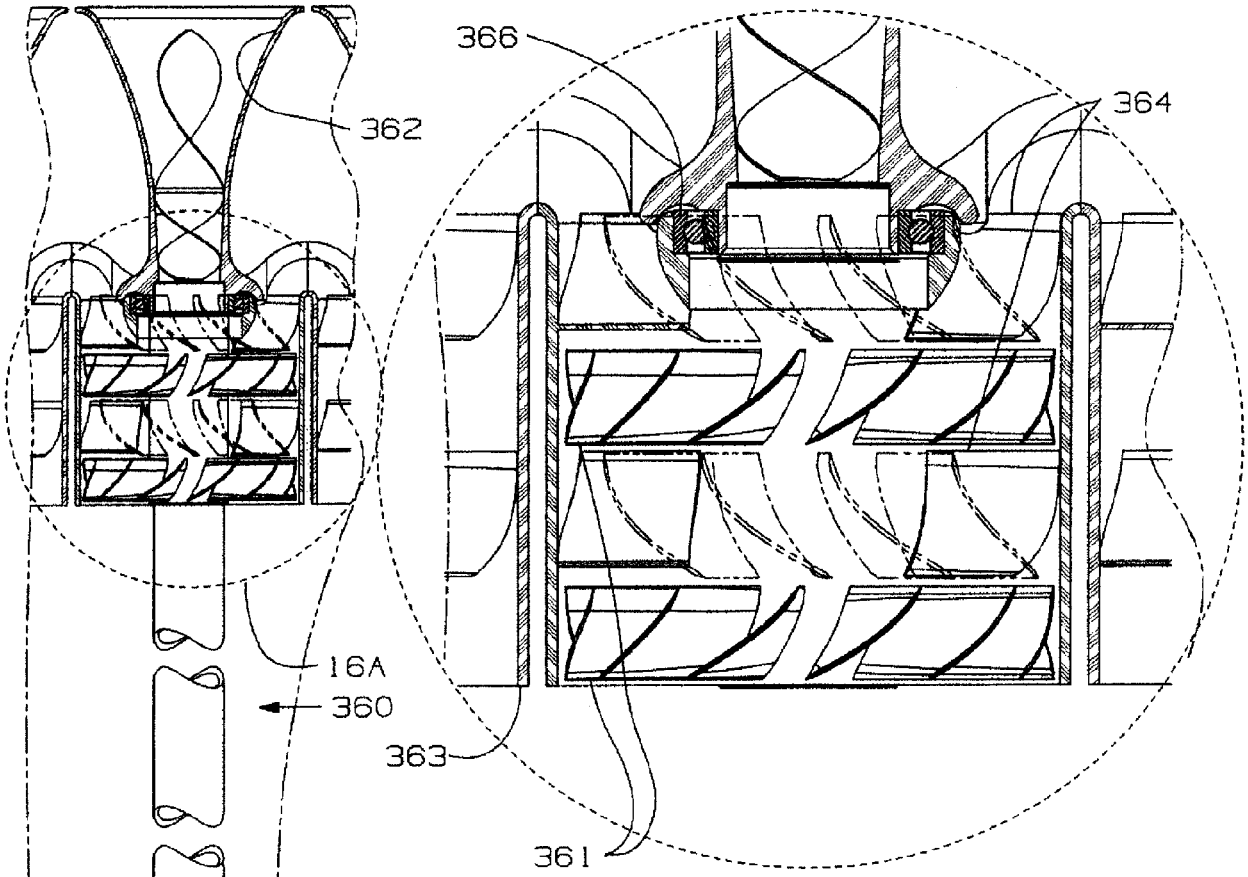
Figure 16:
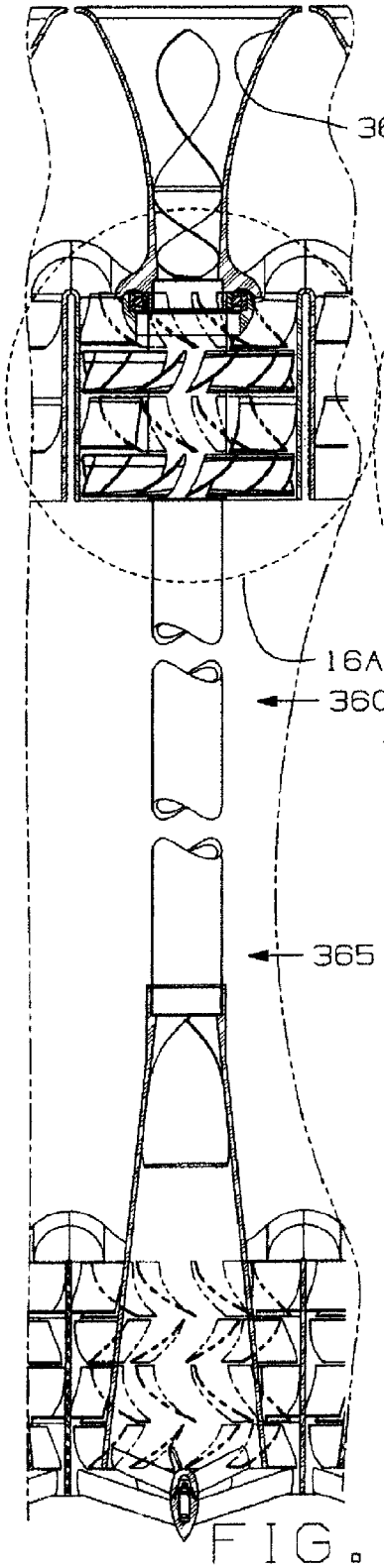
Figure 17:
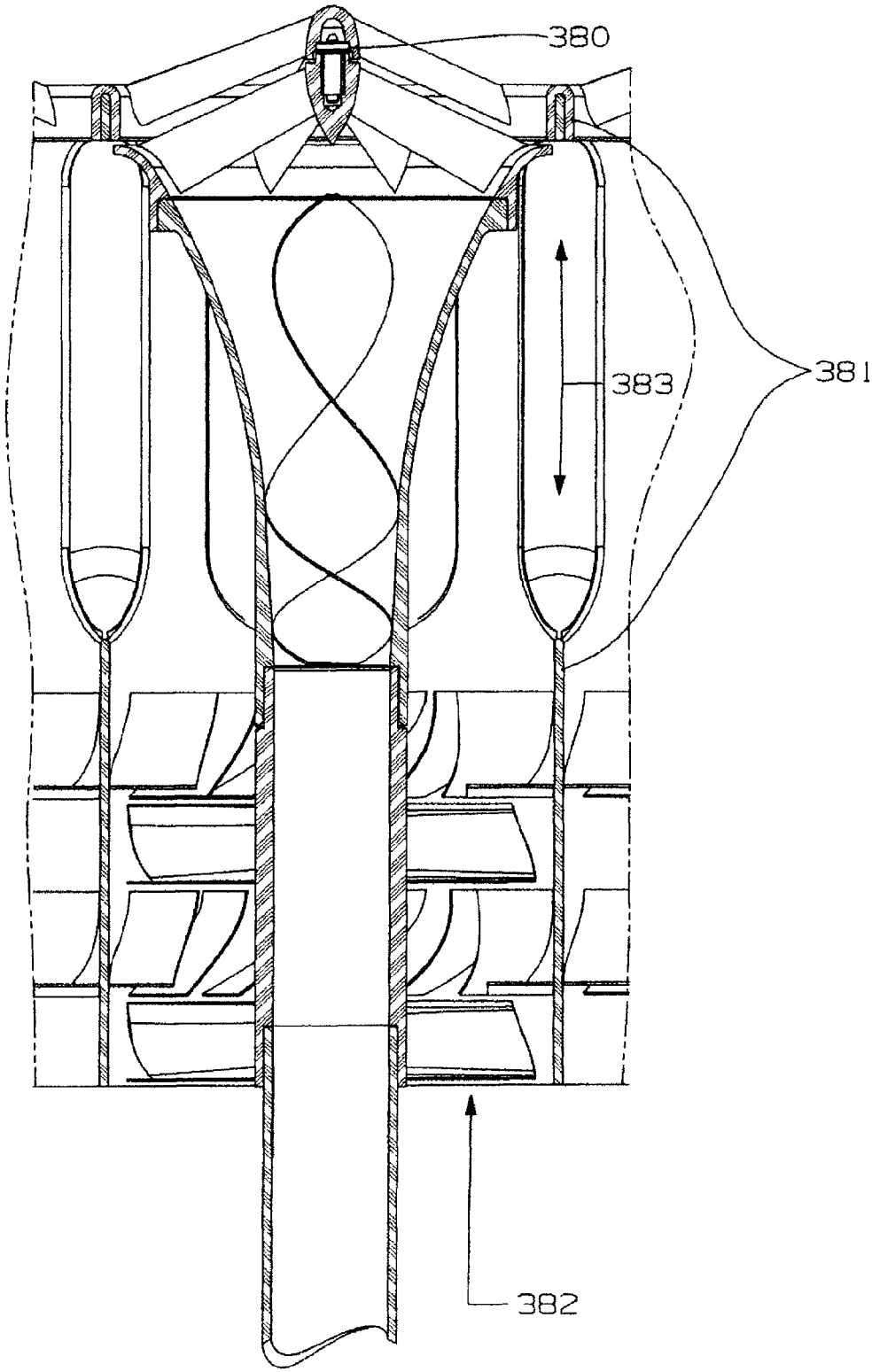

In FIG. 15, the spinning very low pressure drop cyclone 340 has a rotor assembly 345 which is rotatingly mounted on an upper bearing 341 and a lower bearing 342. Upper bearing 341 is housed in a preferably rounded or streamlined-shaped upper bearing pod 343, which is fixed to or integral with a preferably round bored upper stator array member 344 which mounts preferably helicoid configuration inlet vanes 346 that serve to impart rotation about the rotor assembly centerline 347, to incoming air flow before it encounters upper rotor propeller vanes 348 mounted on the periphery of inlet cone assembly 349. Rotor assembly 345 preferably comprises inlet cone assembly 349 whose preferably large inlet flow area upper portion is connected to also preferably rounded or streamlined-shaped upper bearing rotor housing 350 by means of spokes 351 and whose lower portion houses inlet vane 352, a substantially cylindrical body member 353, lower diffuser assembly 354 which preferably mounts lower propeller vanes 355 and spokes 356 to connect with preferably streamlined-shaped lower bearing rotor housing 357, with lower diffuser assembly also containing rectifier vane 358. A preferably streamlined-shaped lower bearing pod 359 is connected by spokes 360 to preferably round bored lower stator array member 361. Upper stator array member 344 with its inlet vanes 346, taken together with rotor assembly 345's propeller vanes 348 comprise a ducted fan array wherein vane curvatures work together efficiently to provide rotational torque to spin rotor assembly as rapidly as possible. Similarly, preferably round bored lower stator array member 361 houses lower propeller vanes 355 in such a way as to efficiently induce rotational torque to rotor assembly 345 from the air flow which upper stator array member and lower stator array member force to pass through their bores by being configured to substantially prevent air passage at locations other than their bores. Inlet vane 352 and rectifier vane 358 preferably have upper (leading) edge inclinations that cause them to efficiently slice, propeller-like into their respective relative winds.

Figure 16:
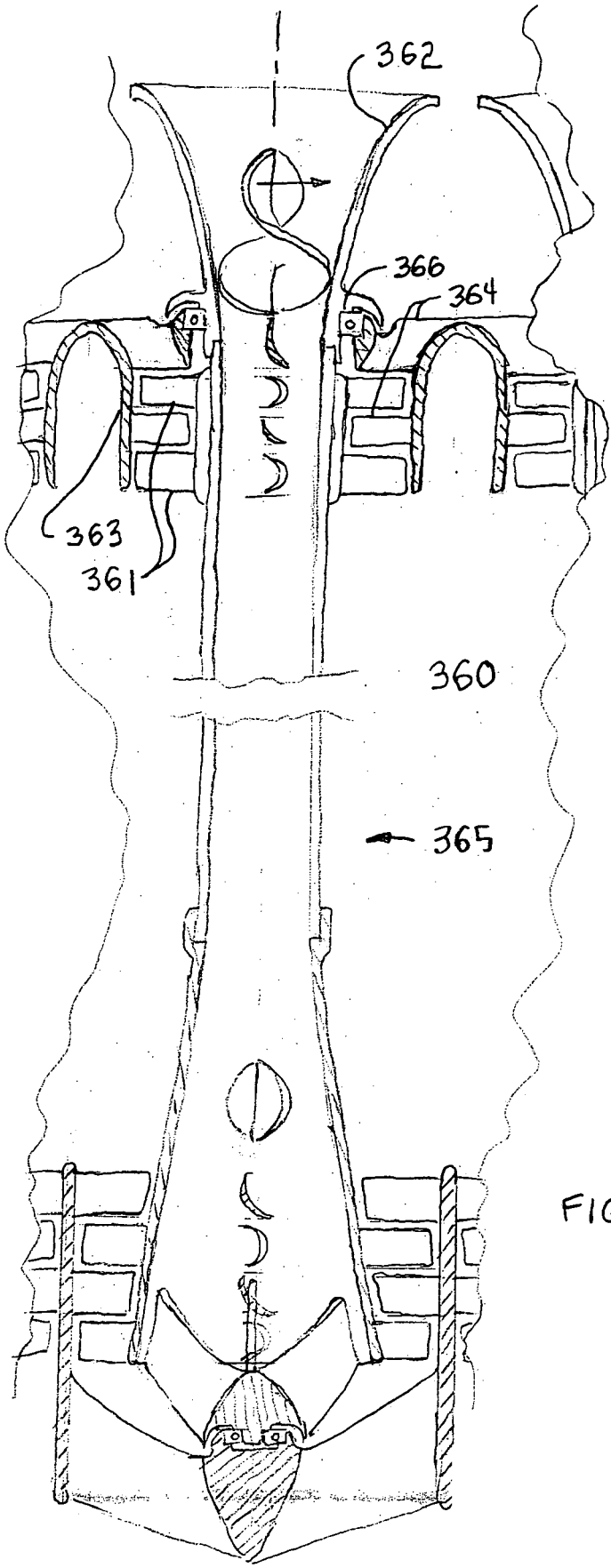
FIG. 16 is a schematic illustration of a more closely spaced version of the spinning very low pressure drop cyclone, in accordance with a preferred embodiment of the present invention.

FIG. 16 is a variation 360 of the spinning VLPD cyclone of FIG. 15, allowing for more compact array spacing and thus increased cloud processing air flow area density within an array. Instead of a preferably double row of upper propeller vanes 361 being arrayed around the largest diameter of the inlet horn 362, they are placed at a lower, smaller diameter location to enable the closer center distance relationship with adjacent cyclones in an array. In conjunction with an upper stator array member 363 having a preferably double row of stator vanes 364, upper propeller vanes 361 form an efficient ducted fan array capable of inducing high spin velocity to rotor assembly 365. An upper bearing 366 is of necessarily larger diameter than that of the FIG. 15 assembly, the principal cost of the denser spacing, but absence of flow modifying stator elements upstream of the inlet horn potentially offers offsetting advantage.

Figure 17:
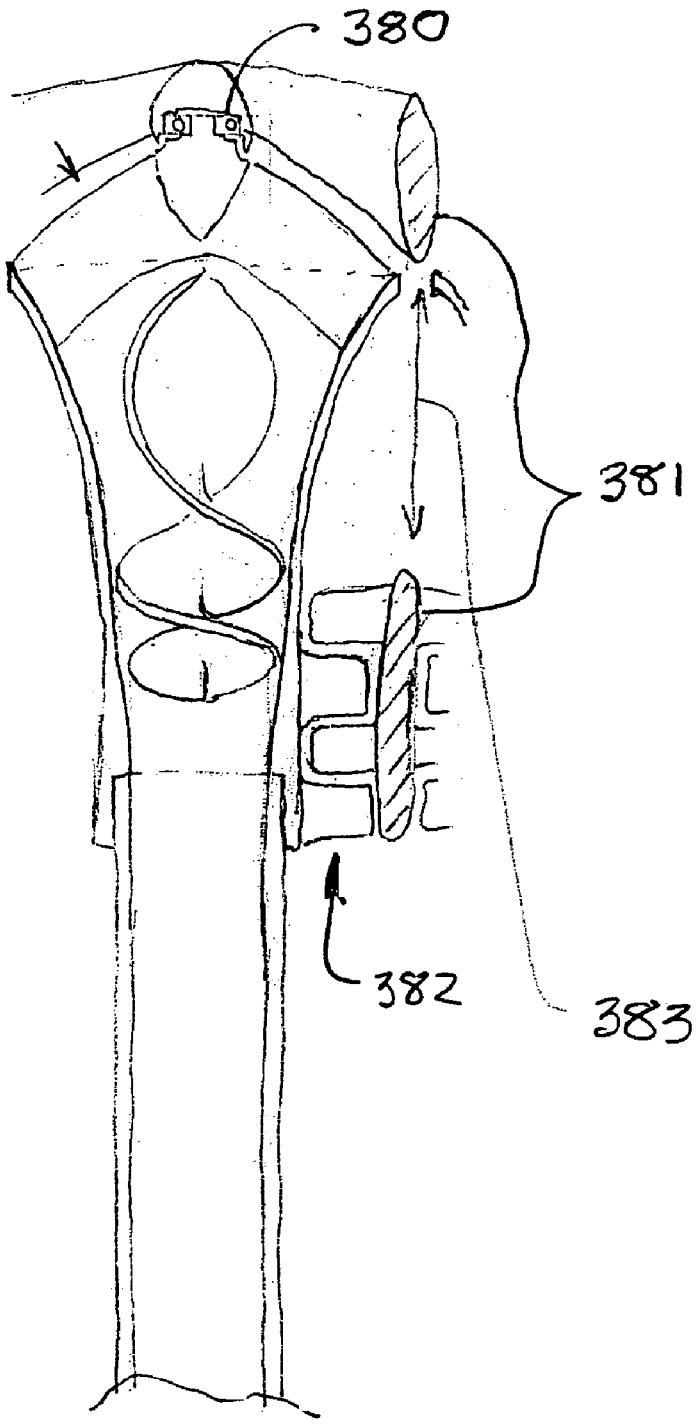
FIG. 17 is a schematic illustration of upper bearing details of a lower cost closely spaced version of the spinning very low pressure drop cyclone, in accordance with a preferred embodiment of the present invention.
Figure 1:
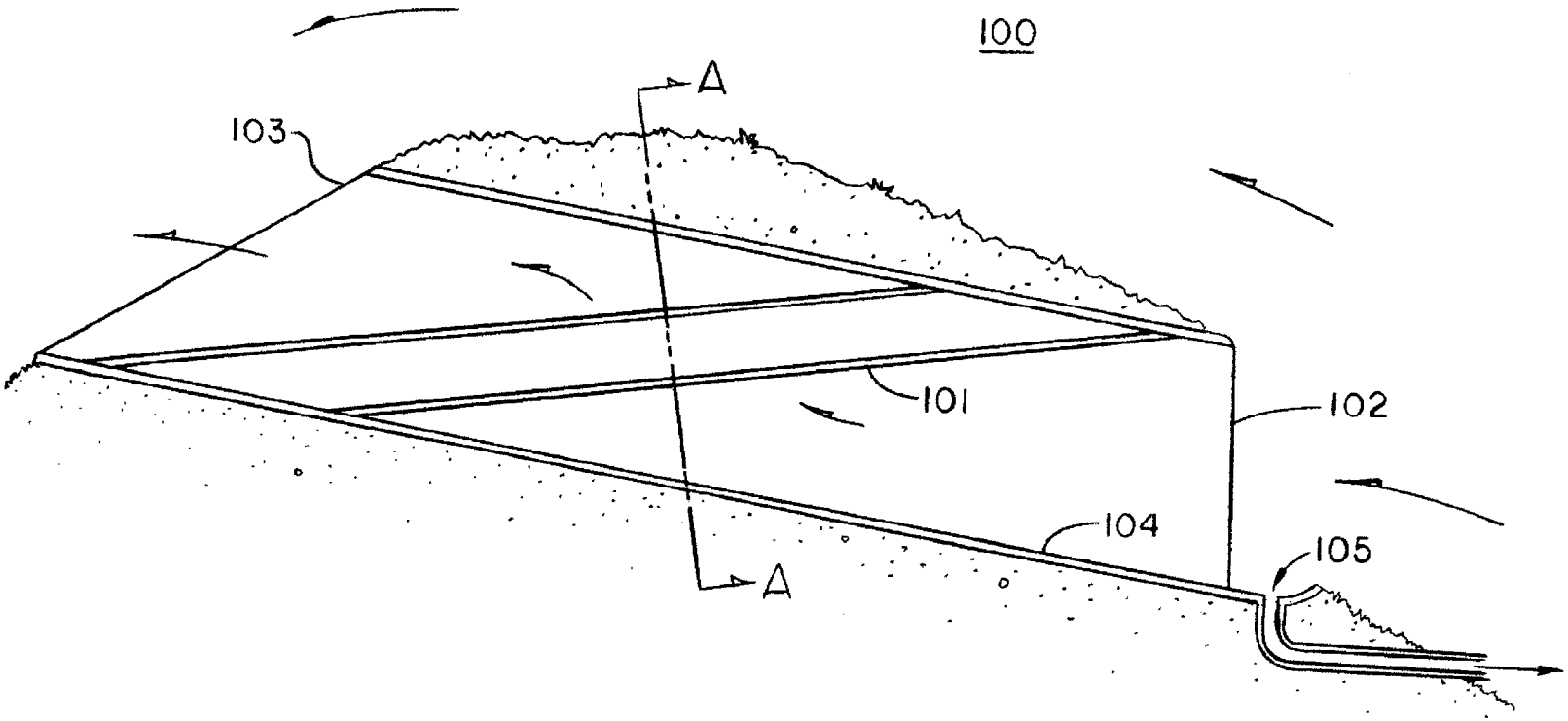
Figure 1A:
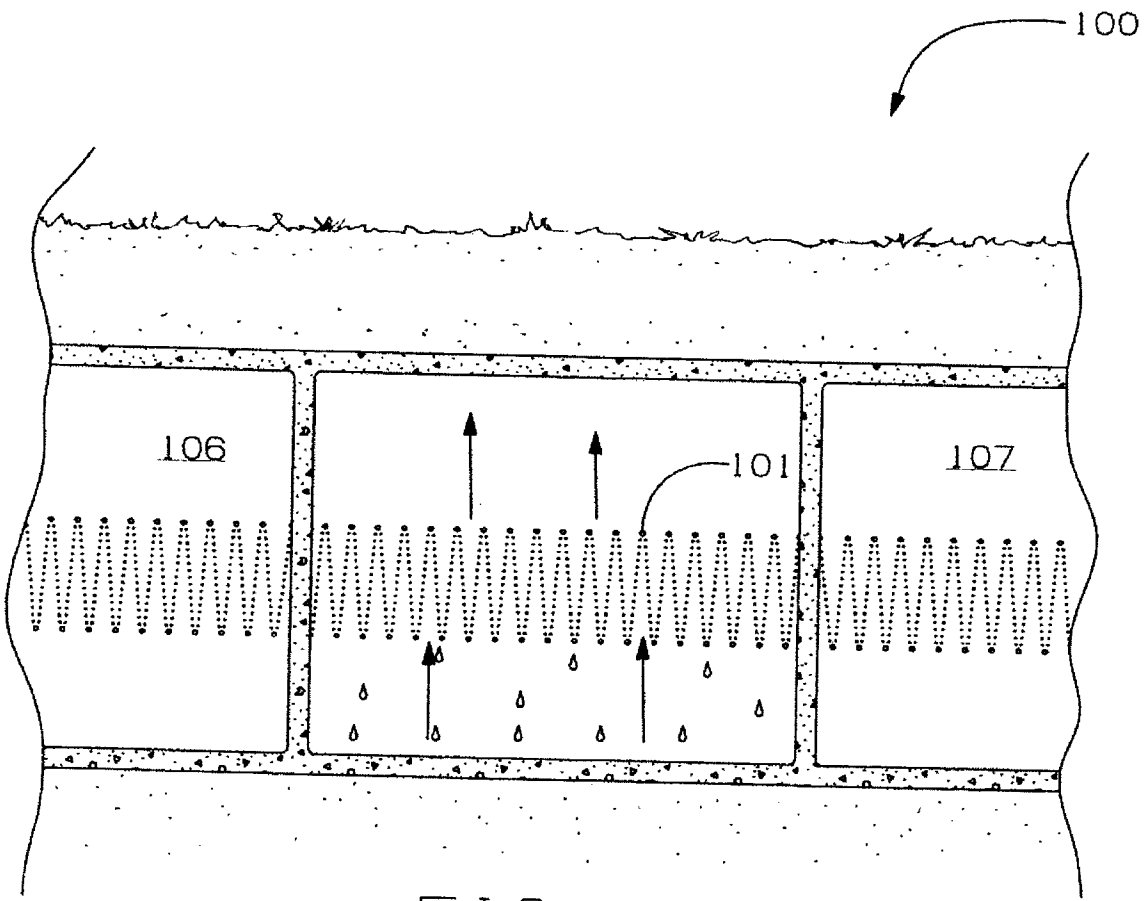
Figure 2:
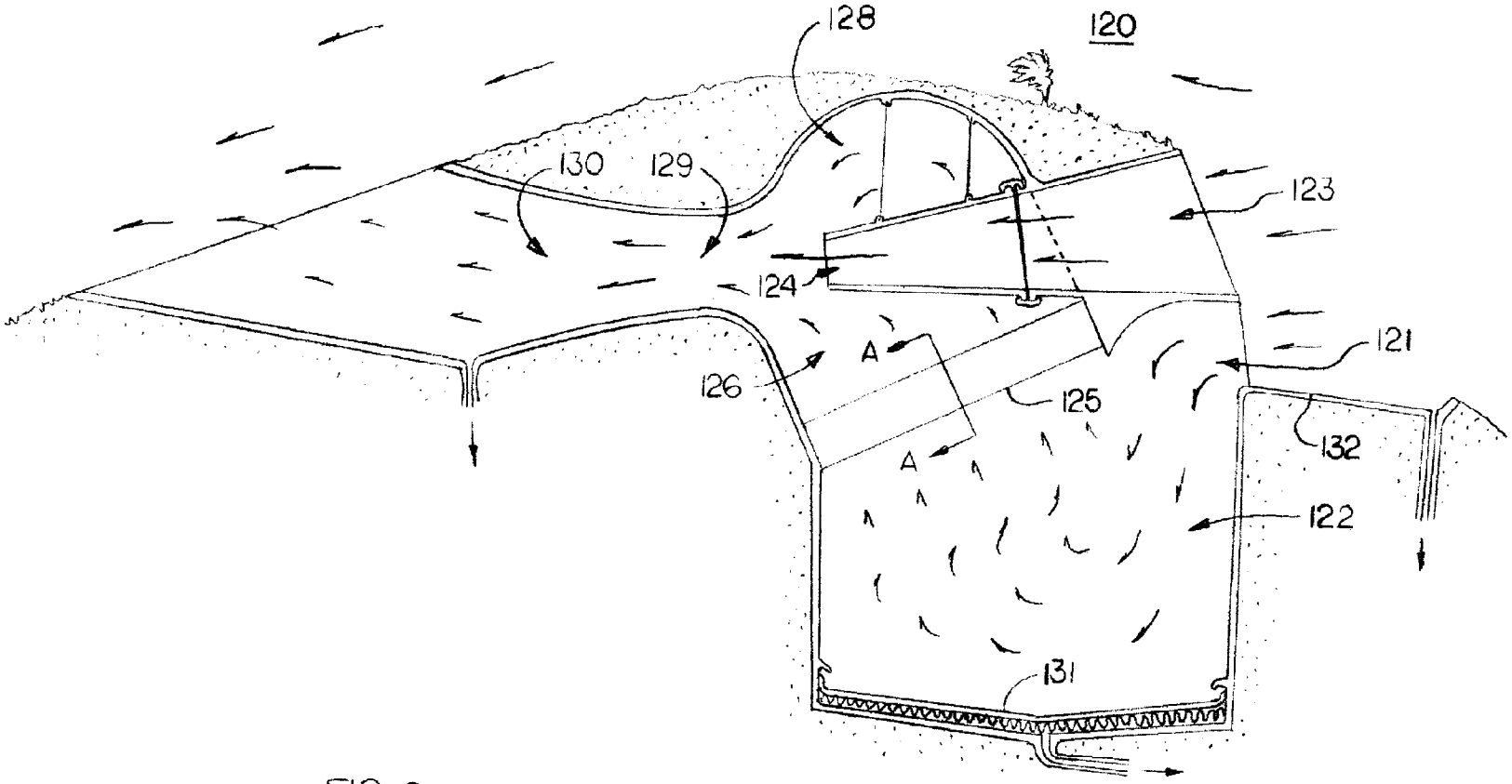
Figure 3:
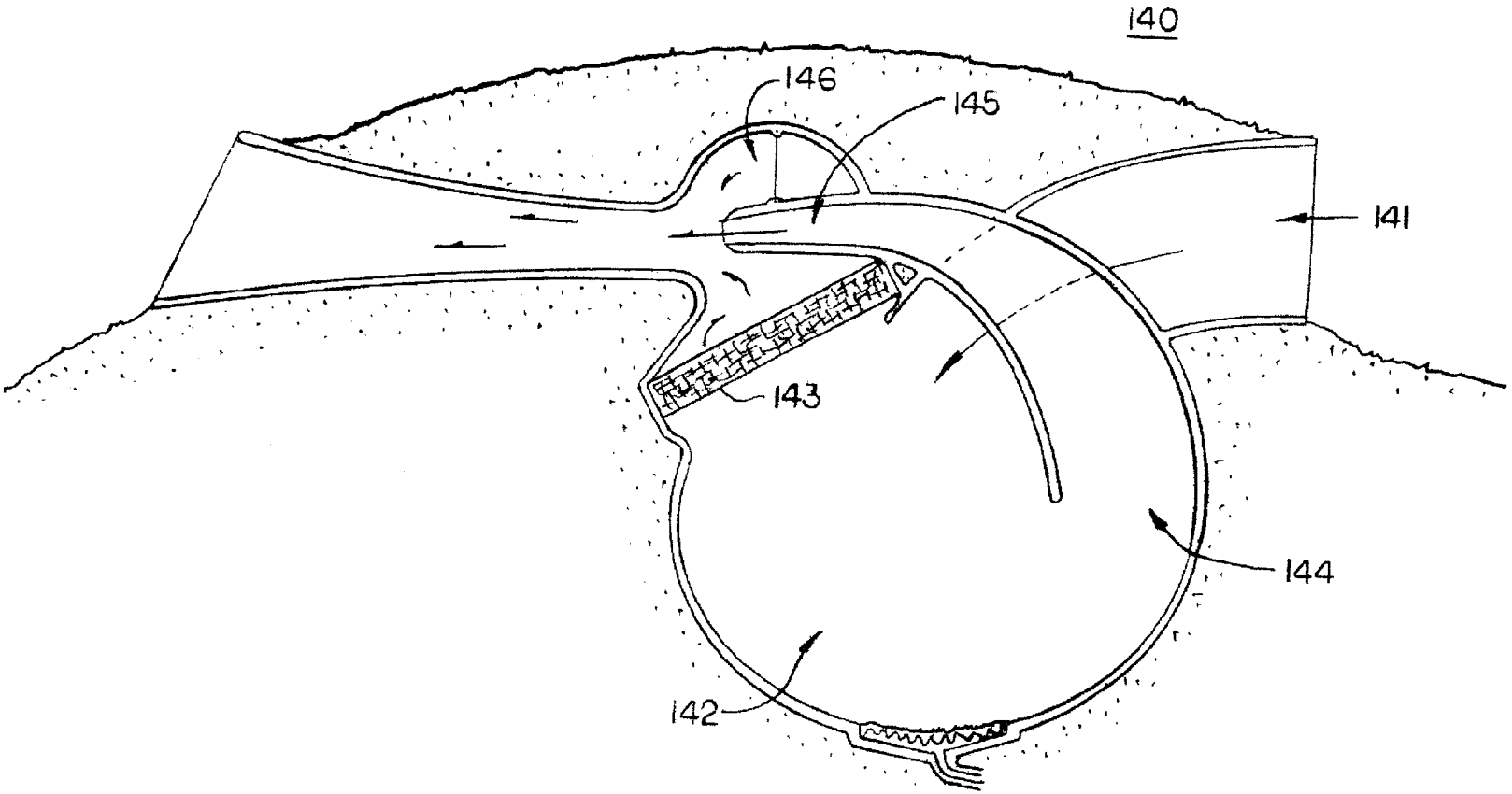
Figures 4, 4B:
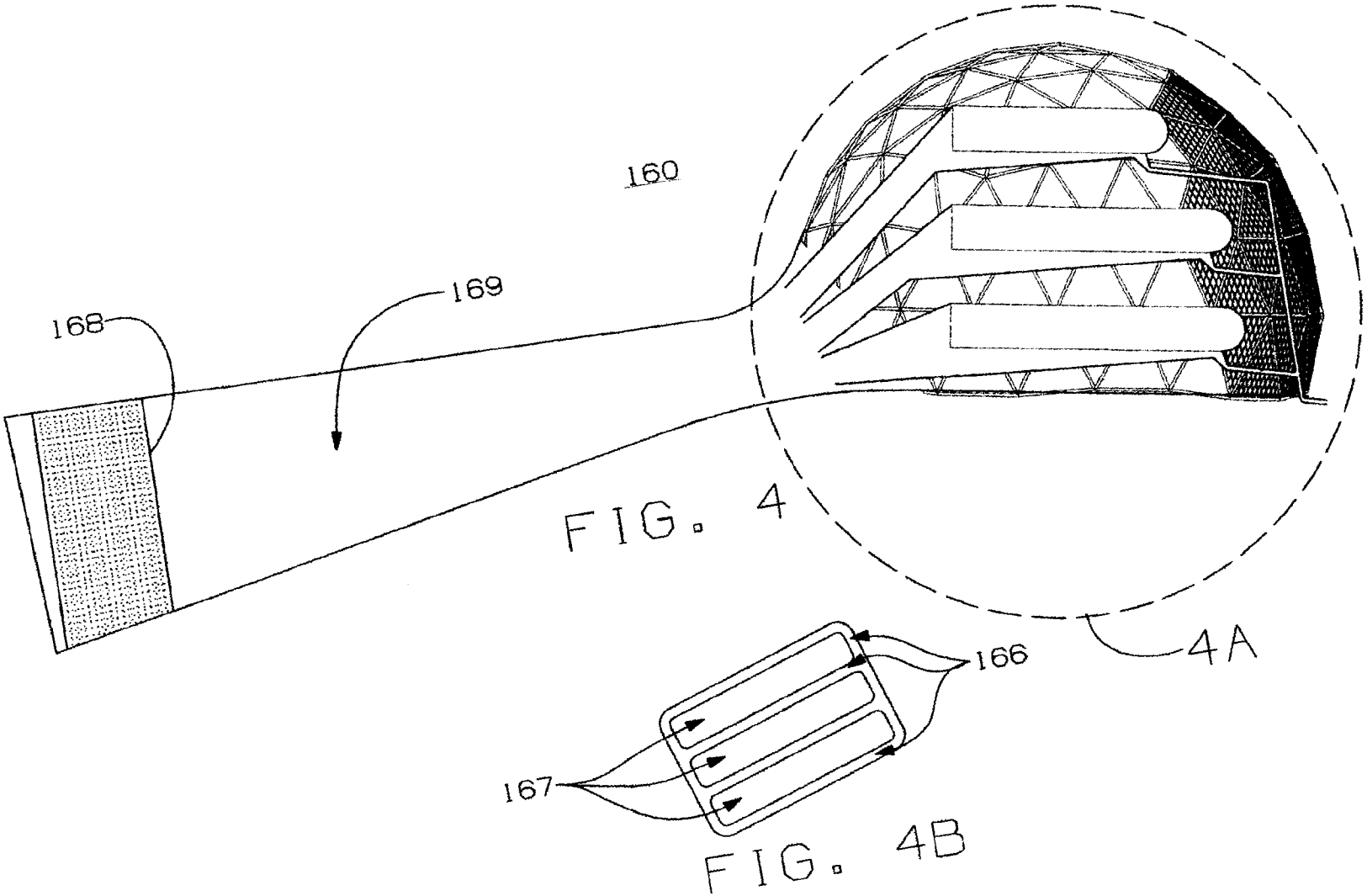
Figure 4A:
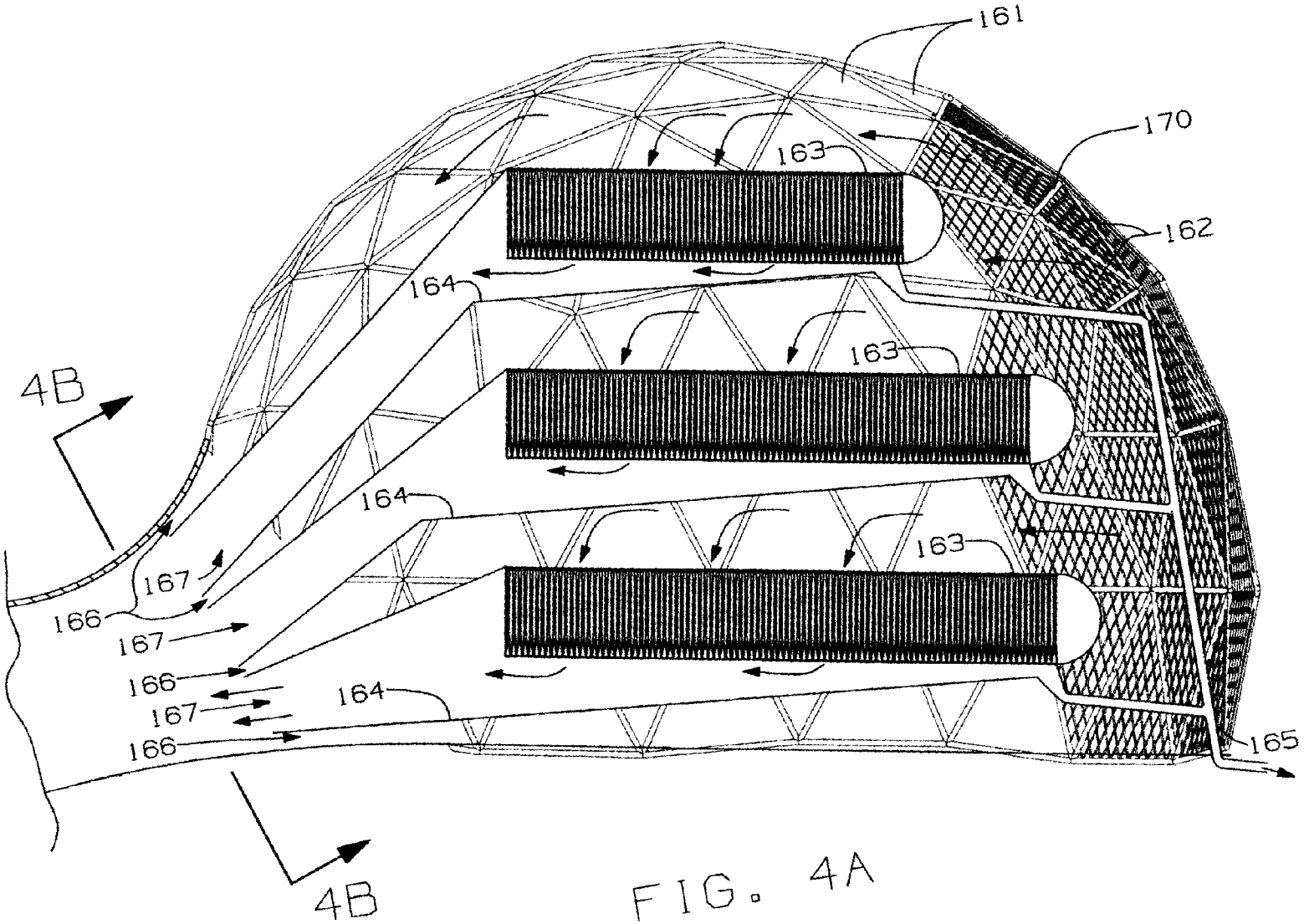
Figure 5:
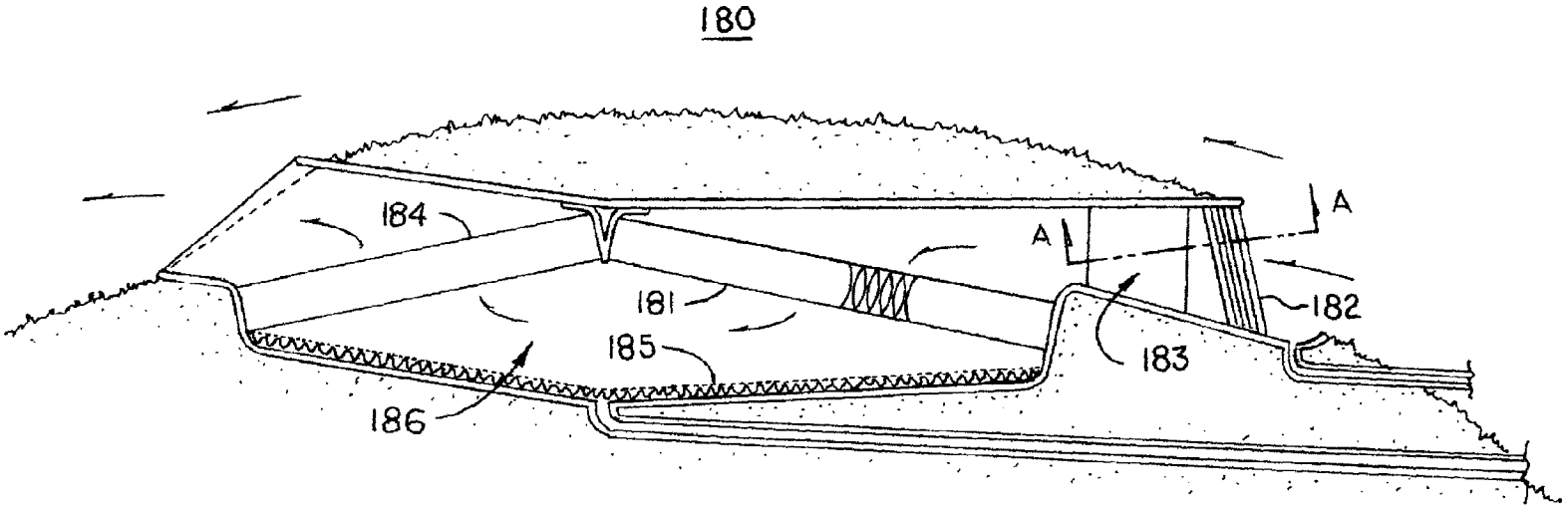
Figure 5A:
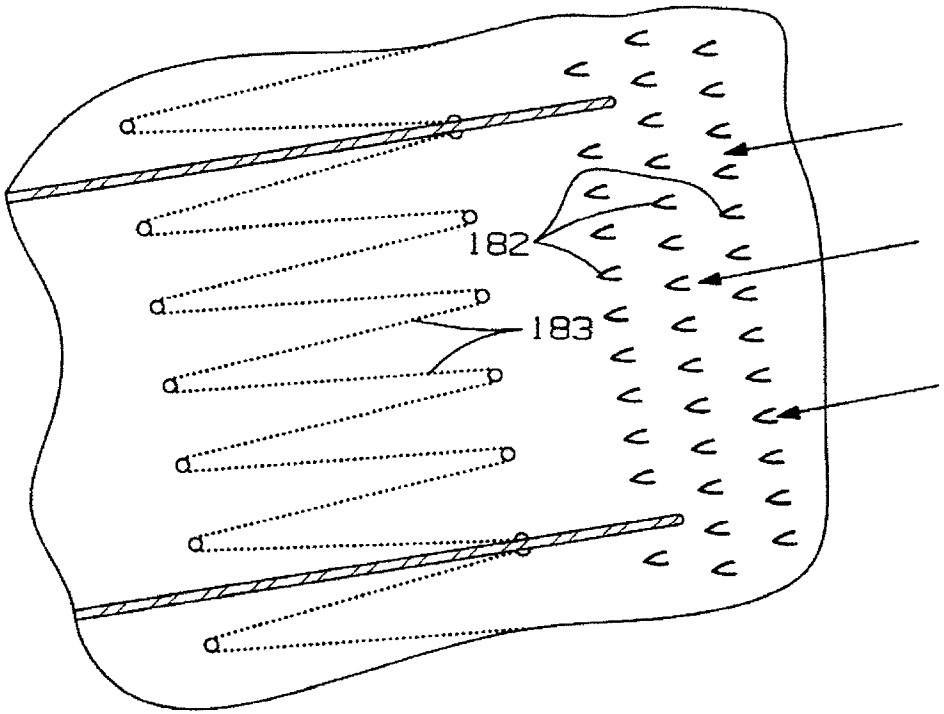
Figure 6:
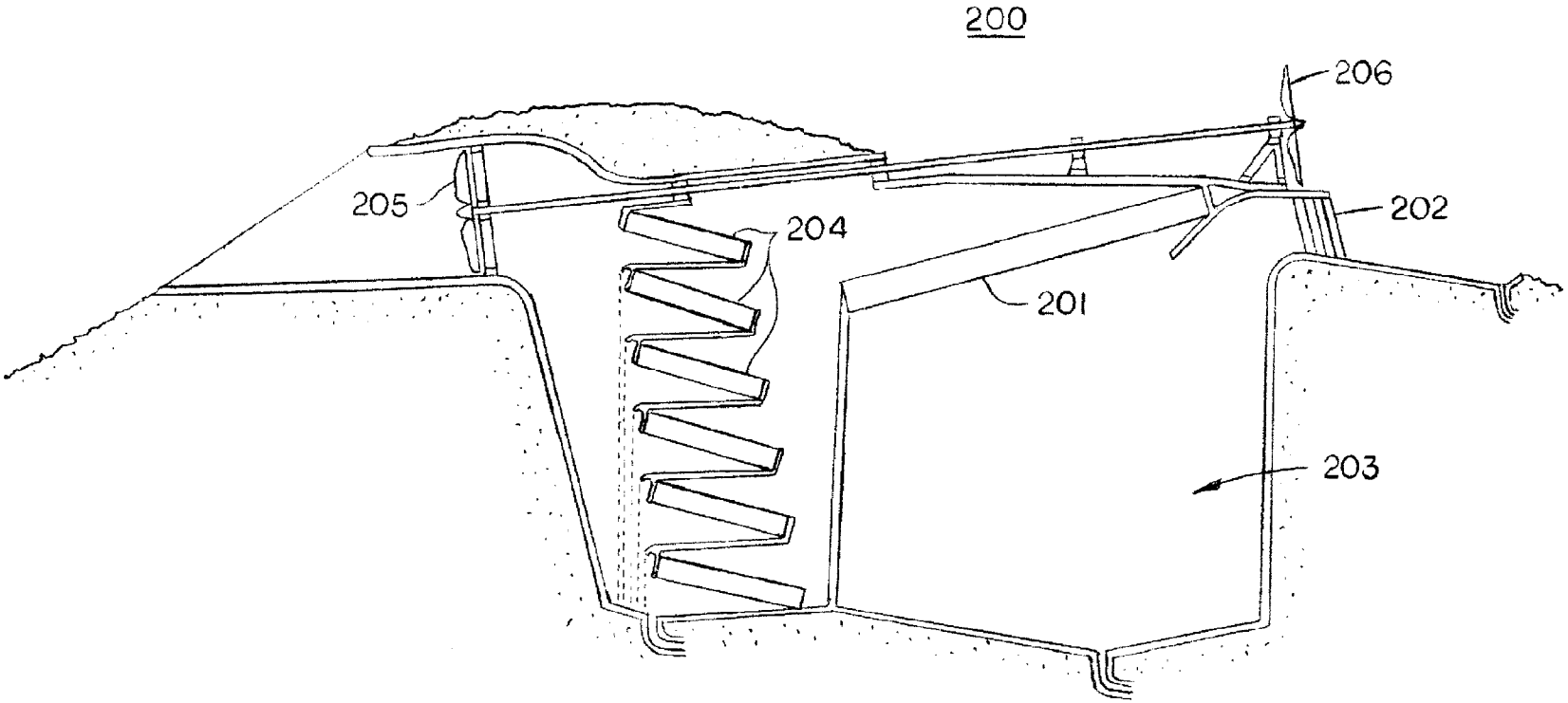
Figure 7:
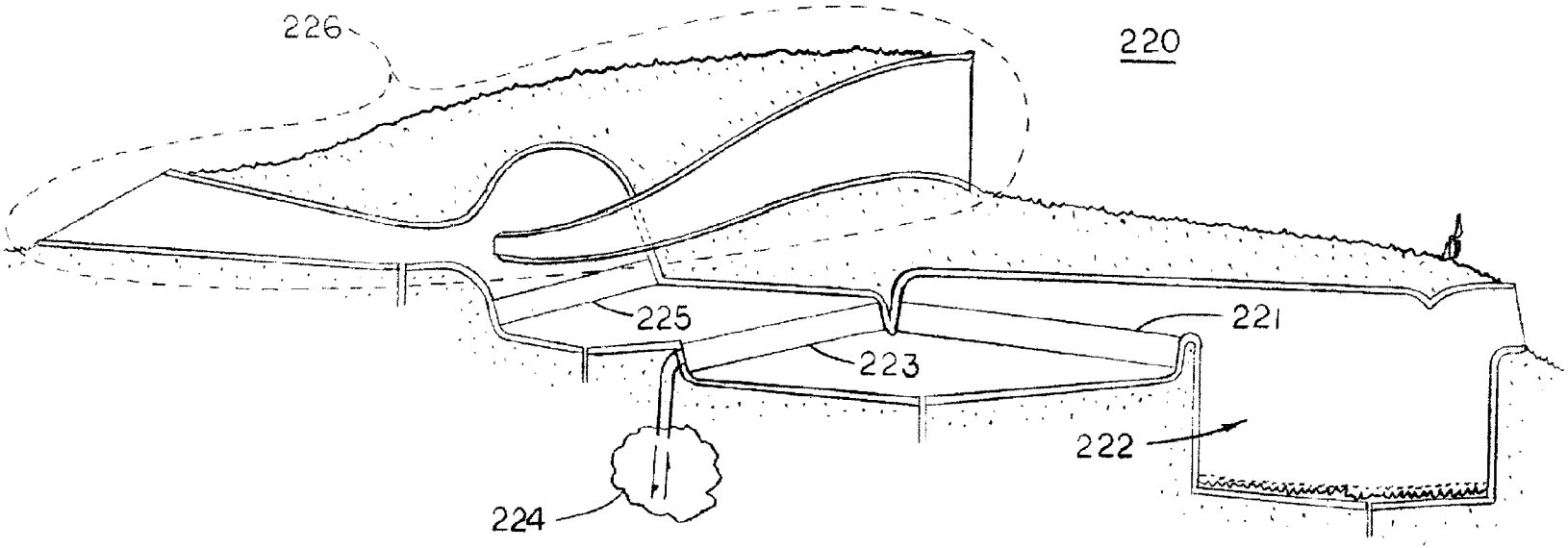
Figure 8:
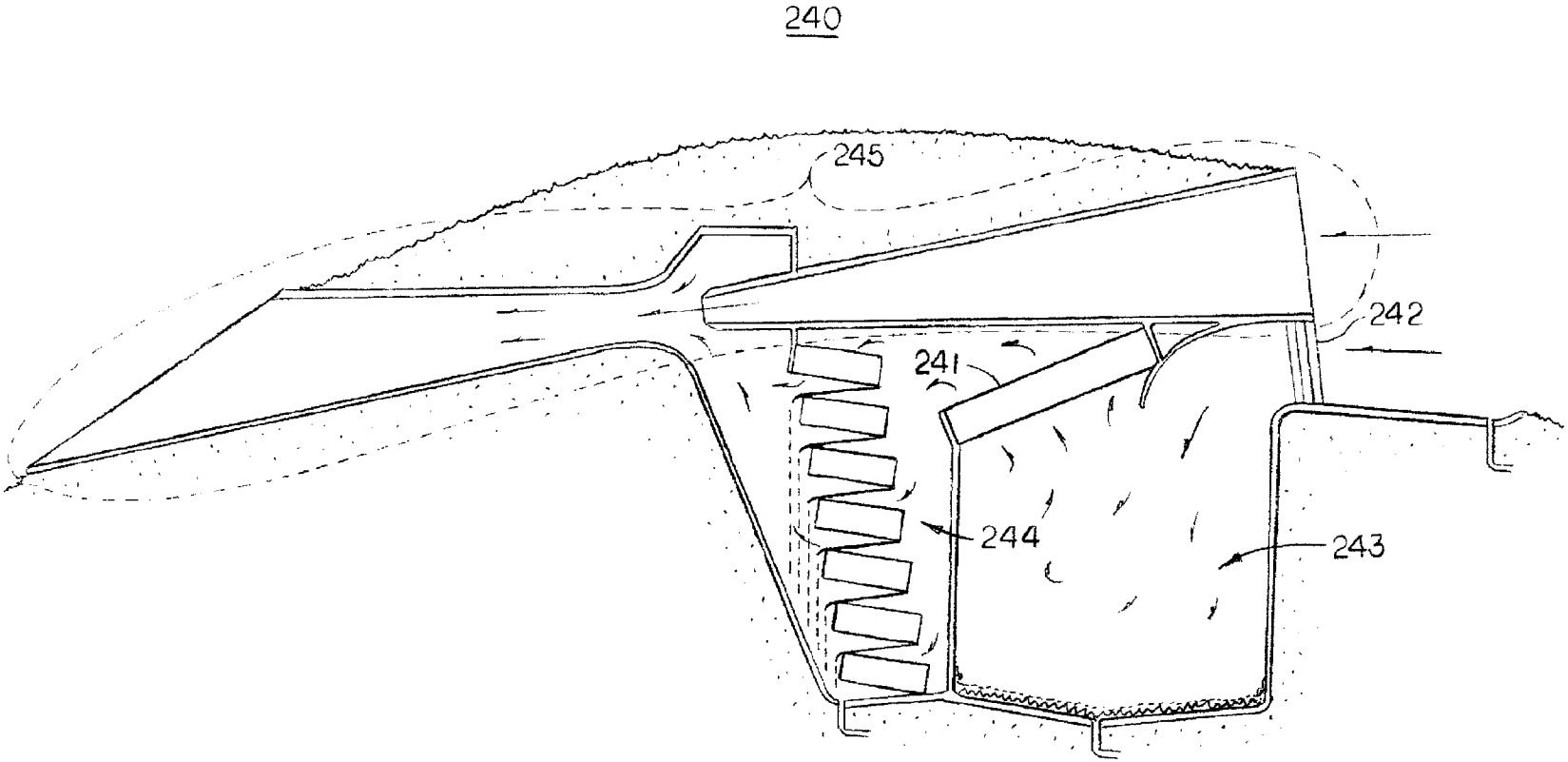
Figure 9:
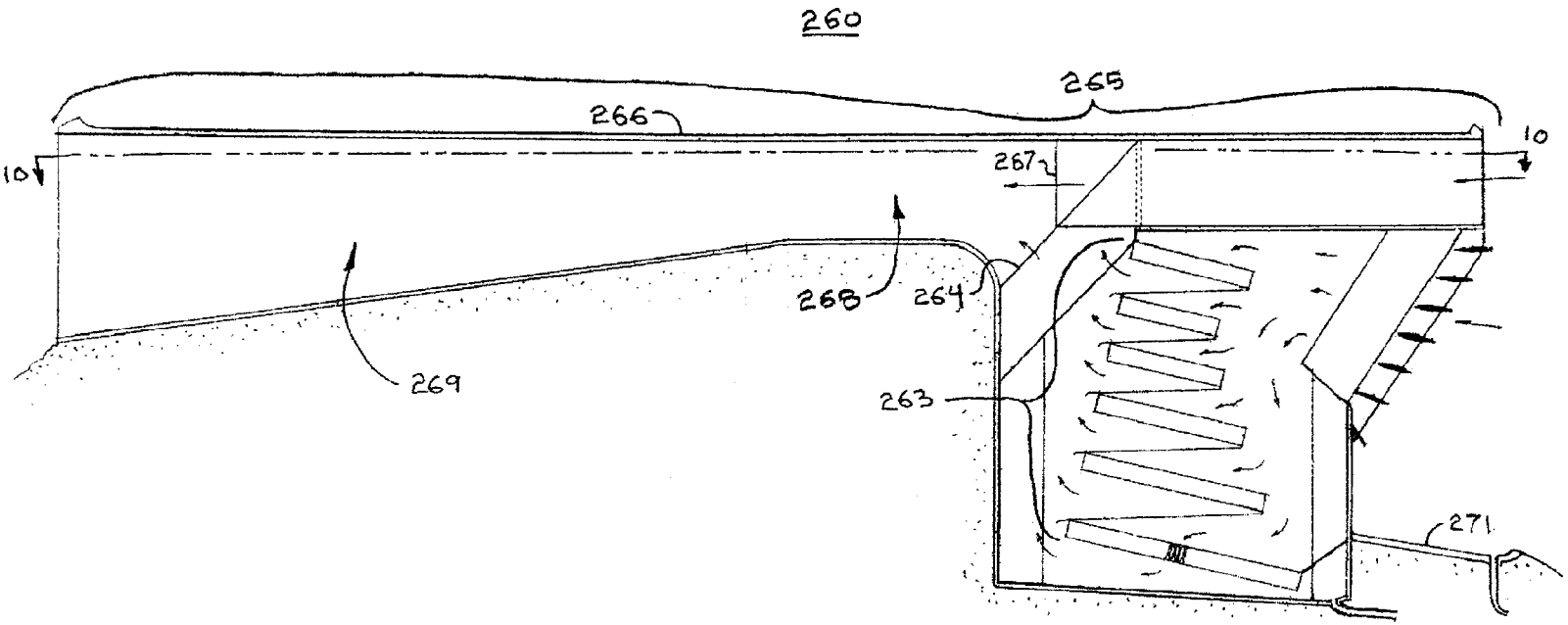
Figure 10:
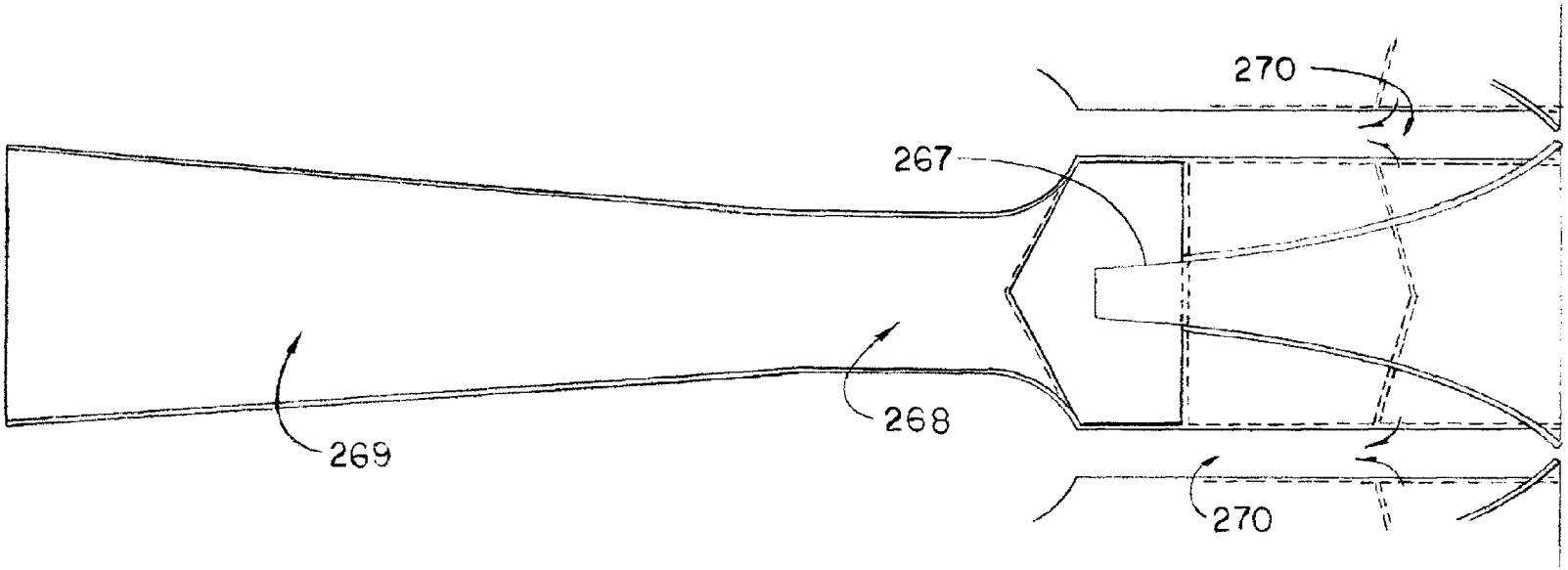
Figure 11:
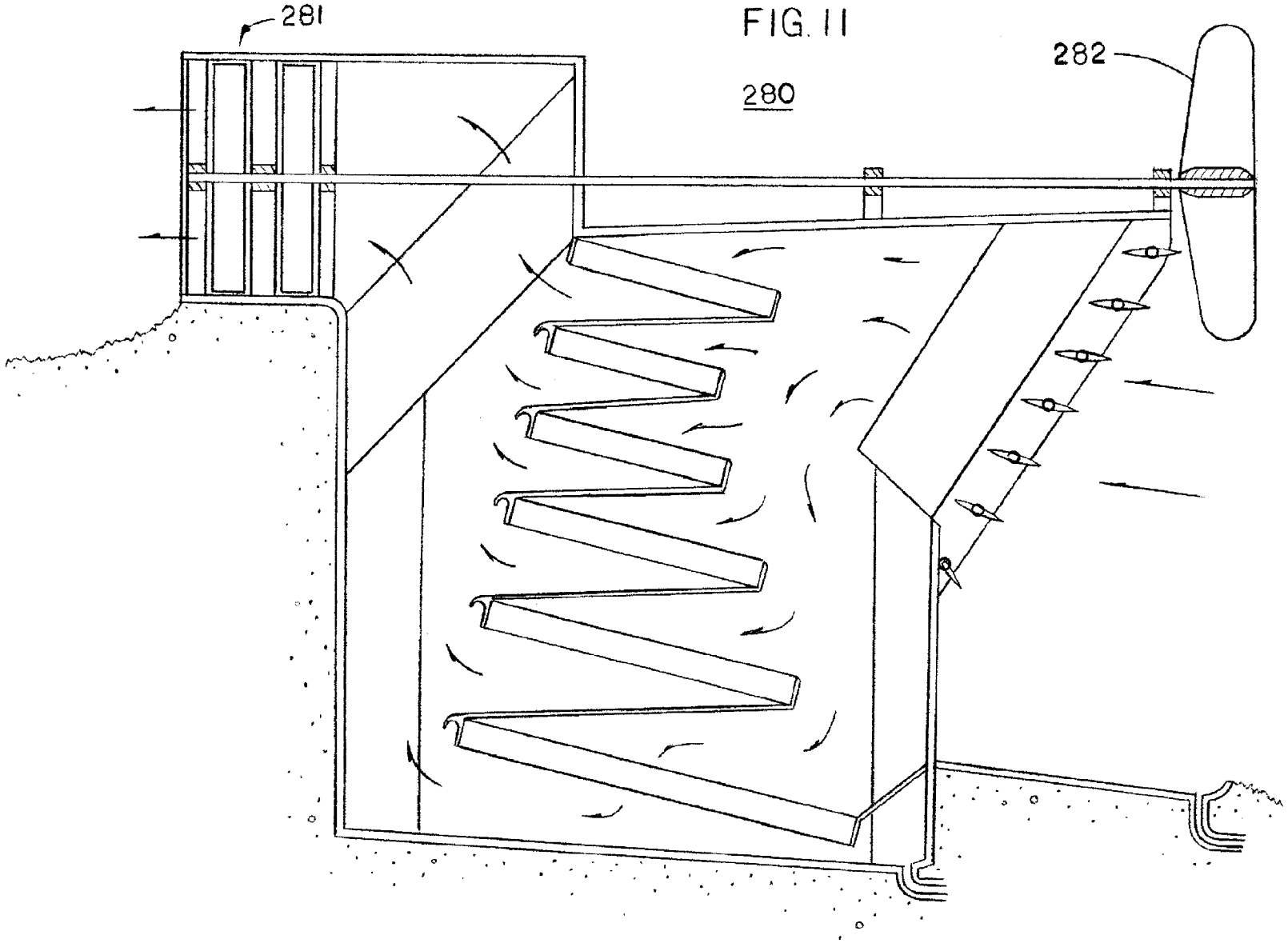
Figure 12:
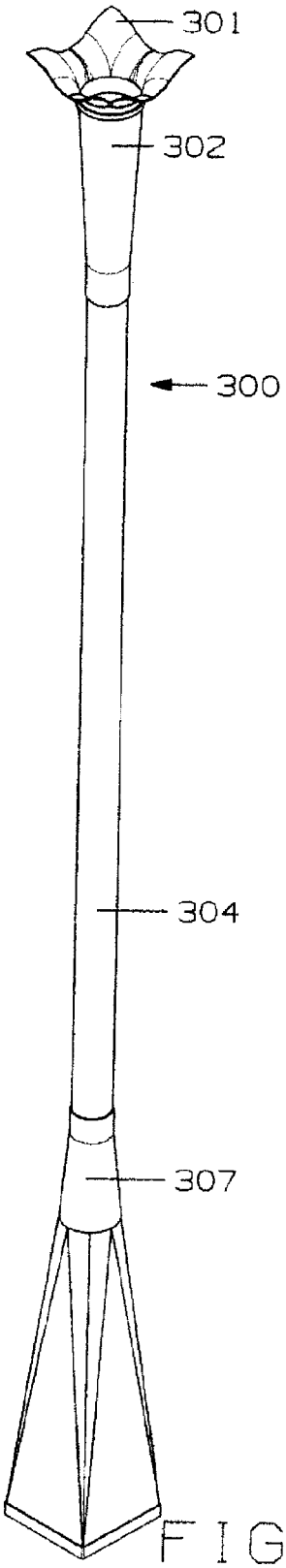
Figure 12A:
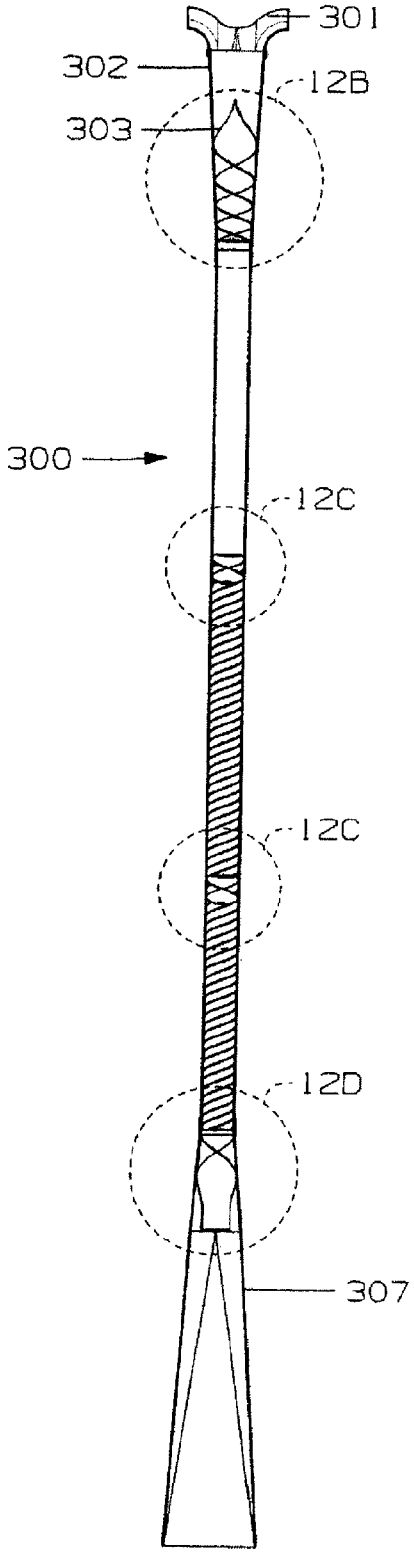
Figure 12B:
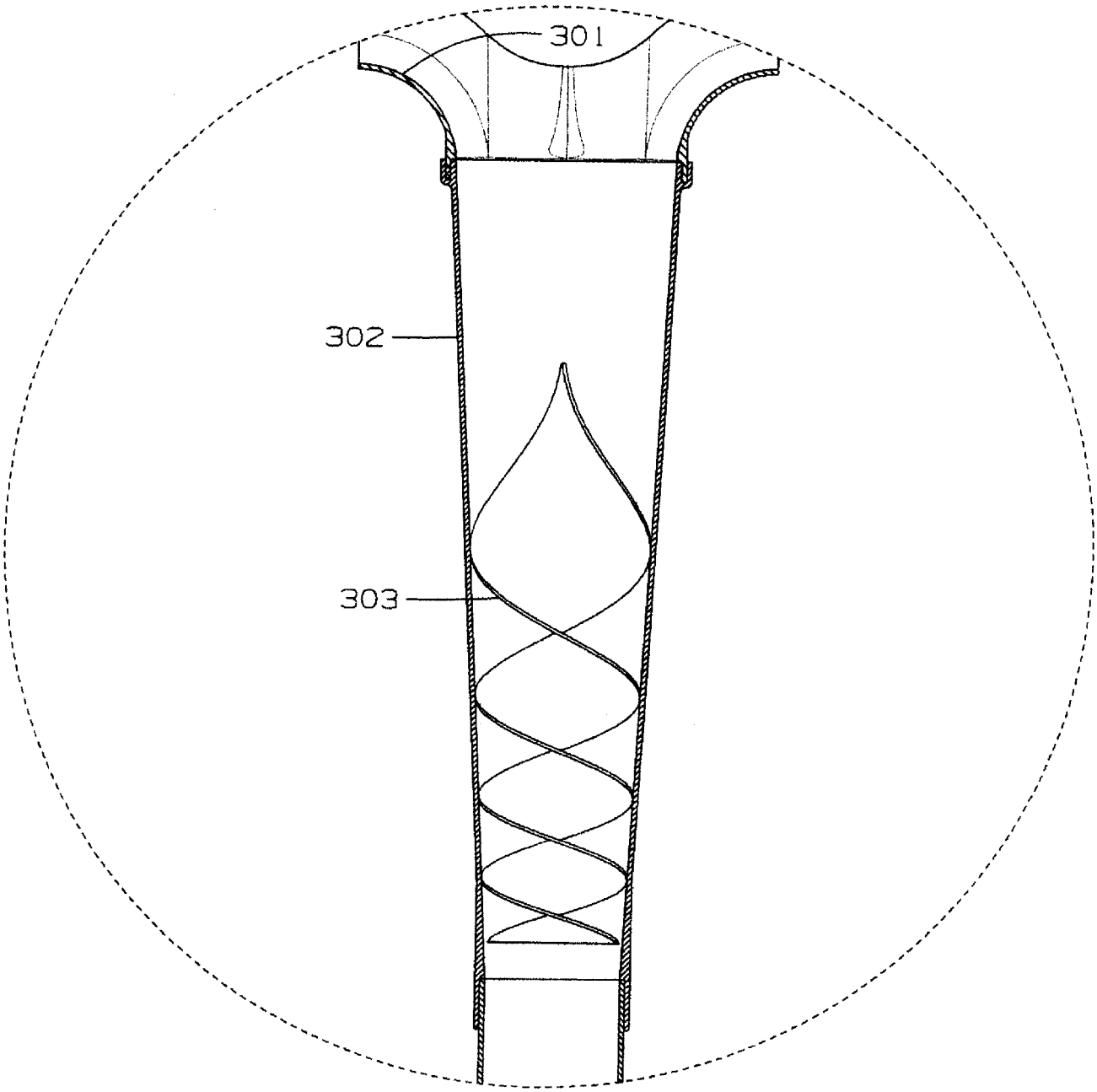
Figure 12C:
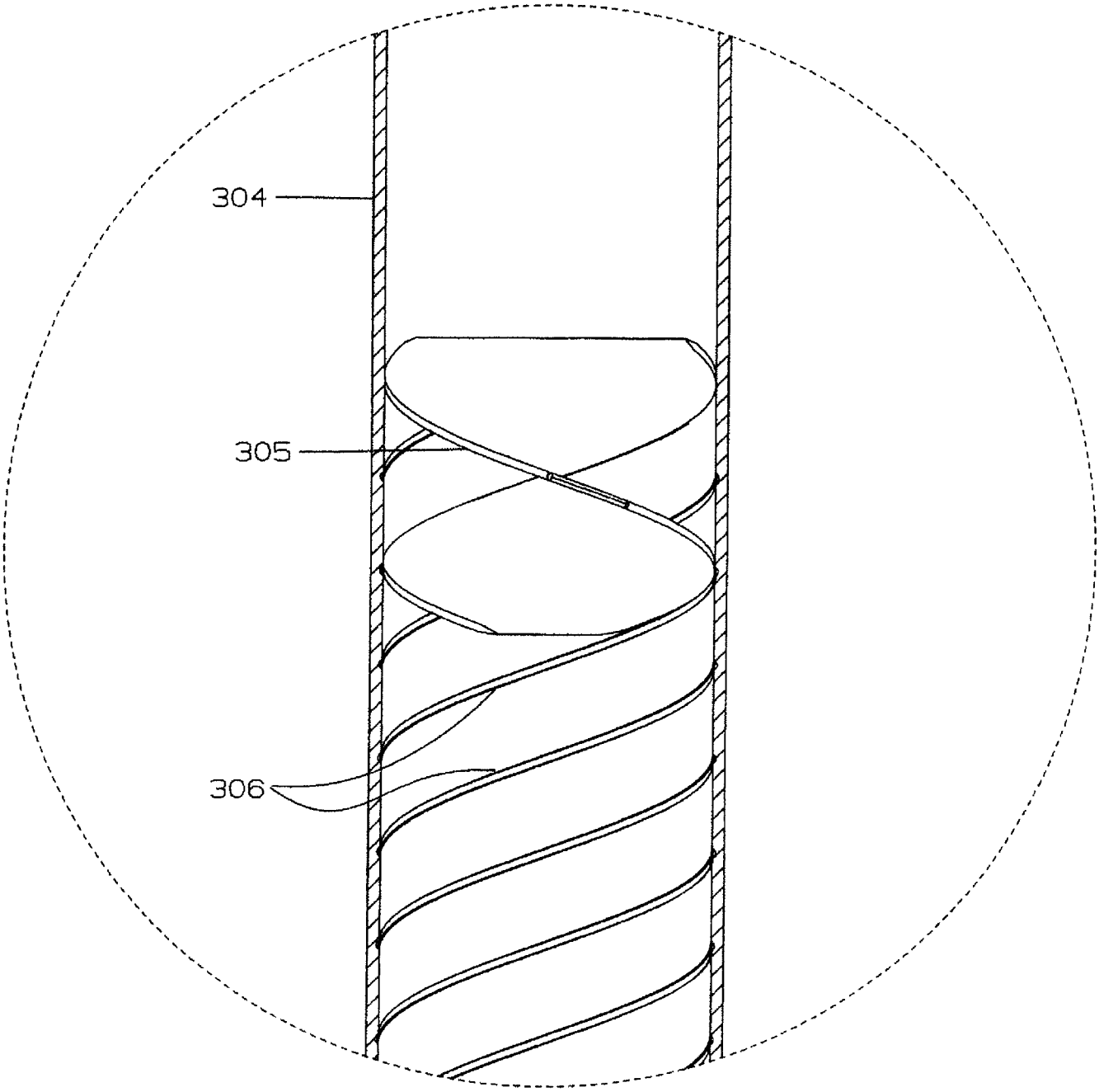
Figure 12D:
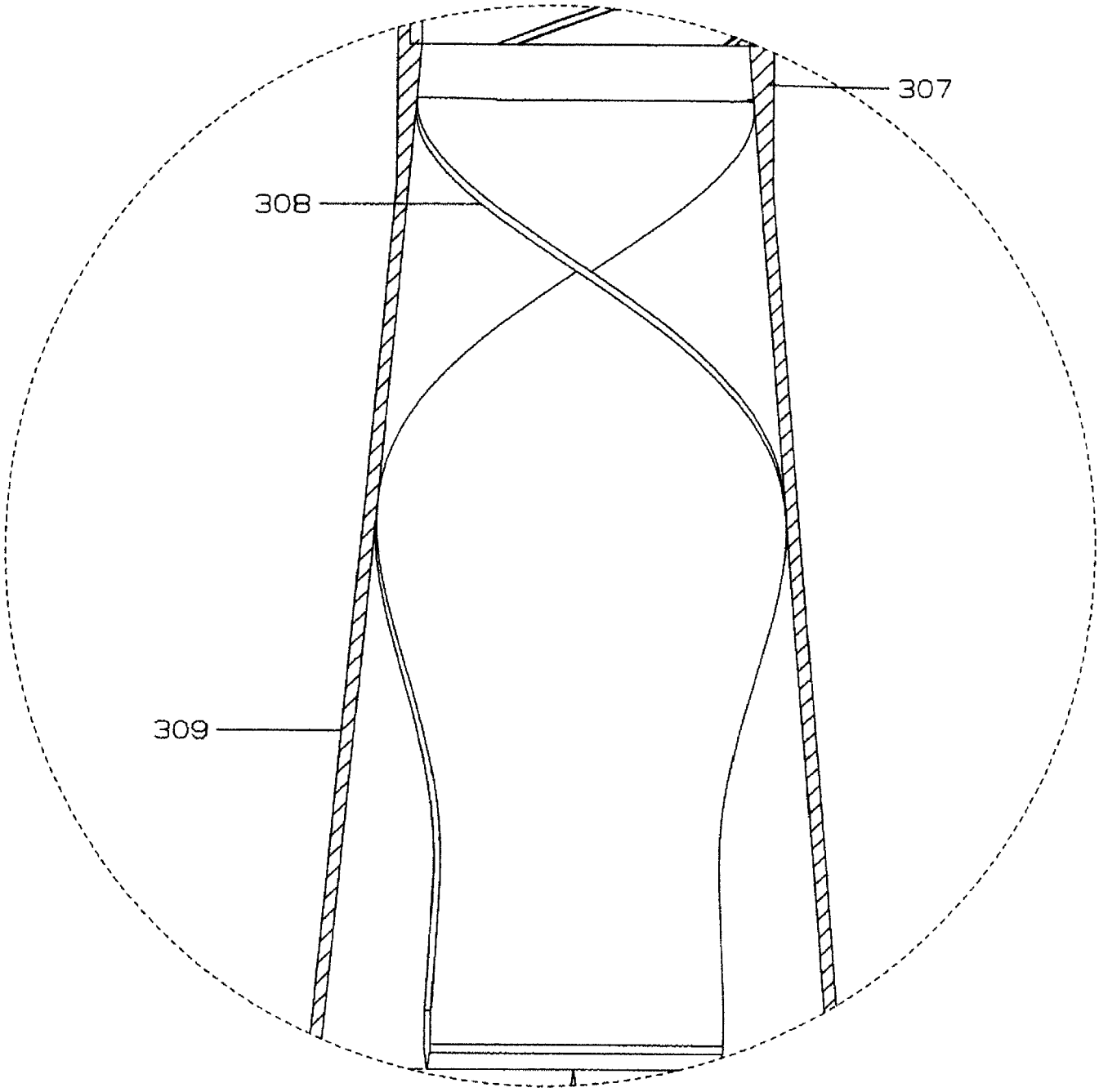
Figure 13A:
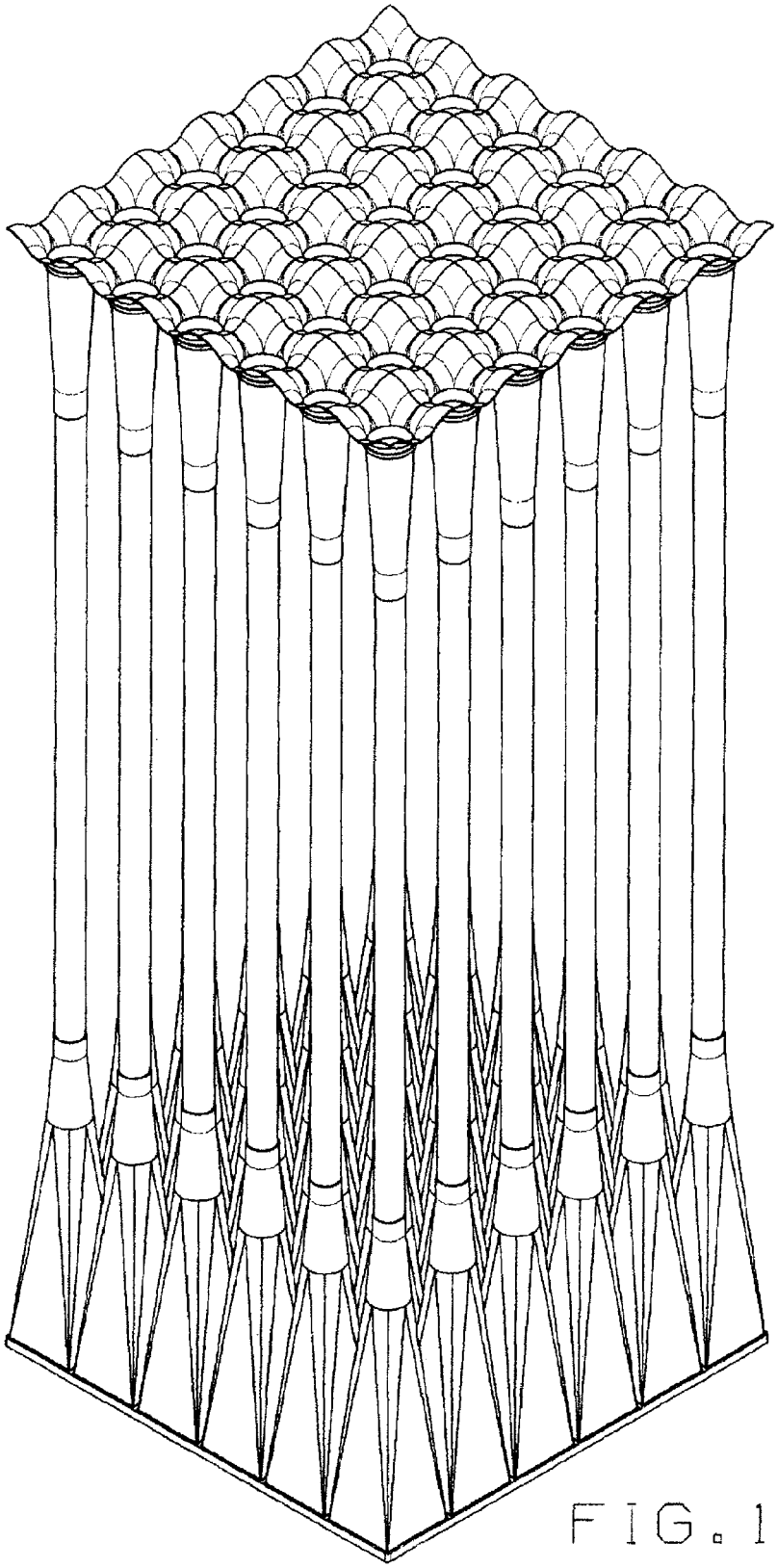
Figure 13B:
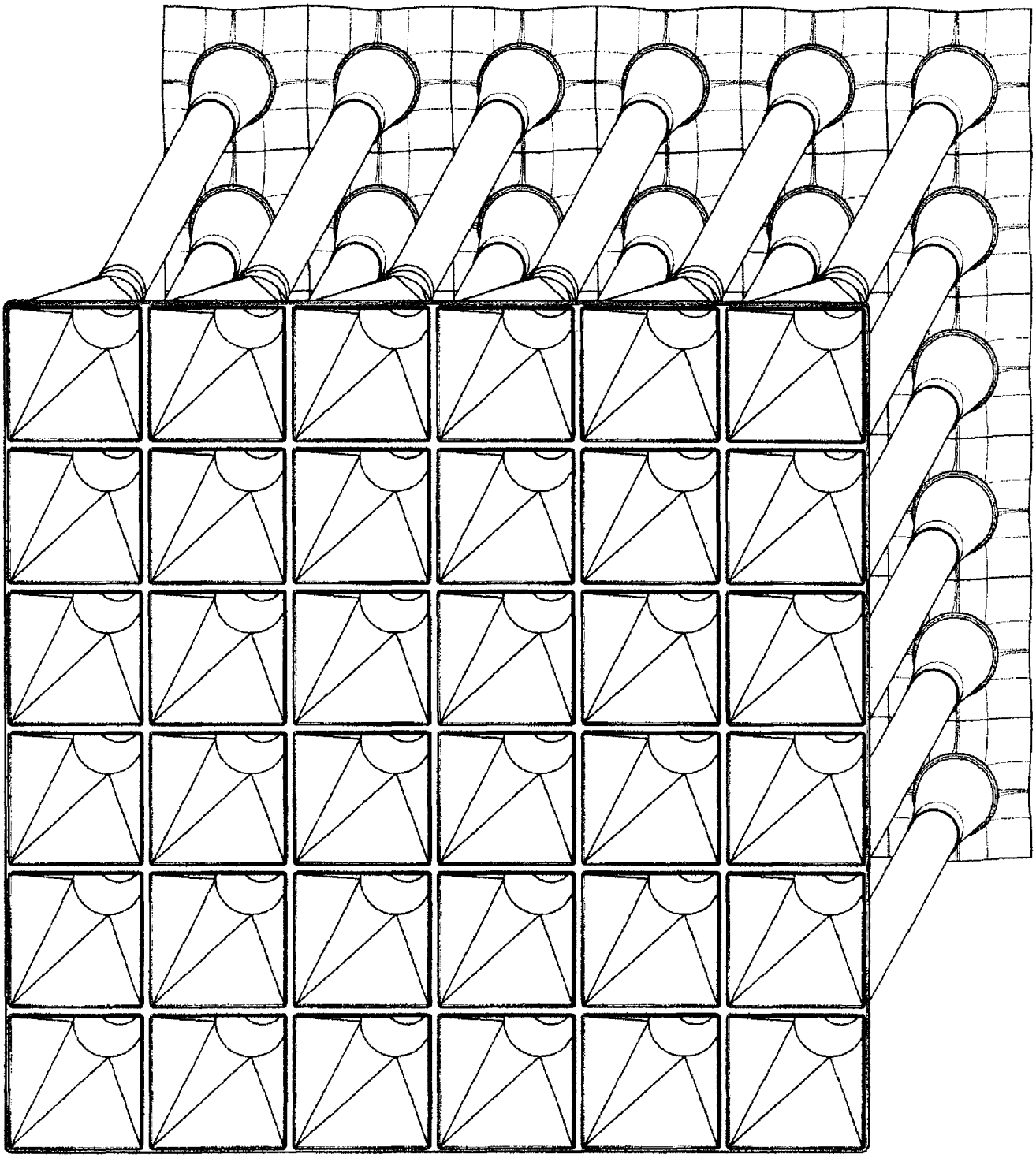
Figure 14:
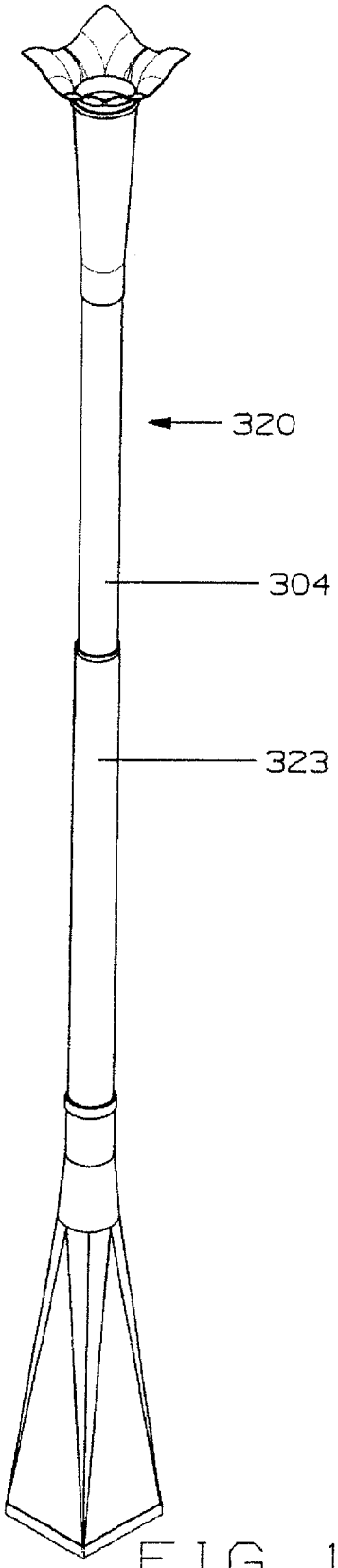
Figure 14A:
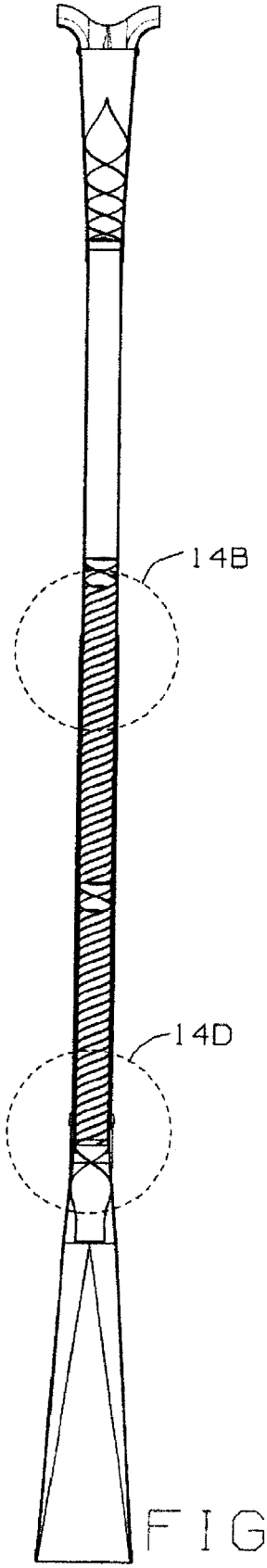
Figure 14B:
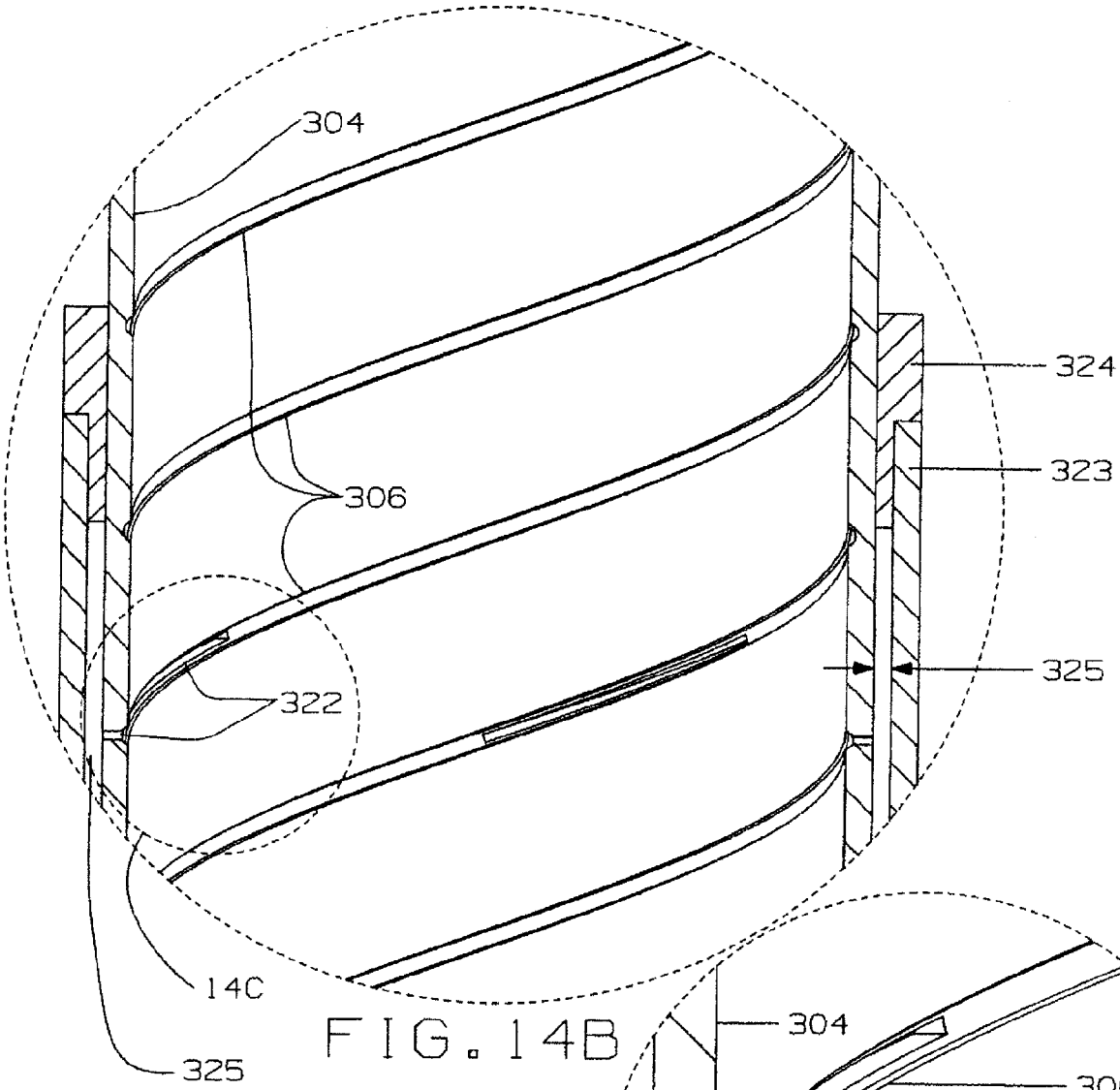
Figure 14C:
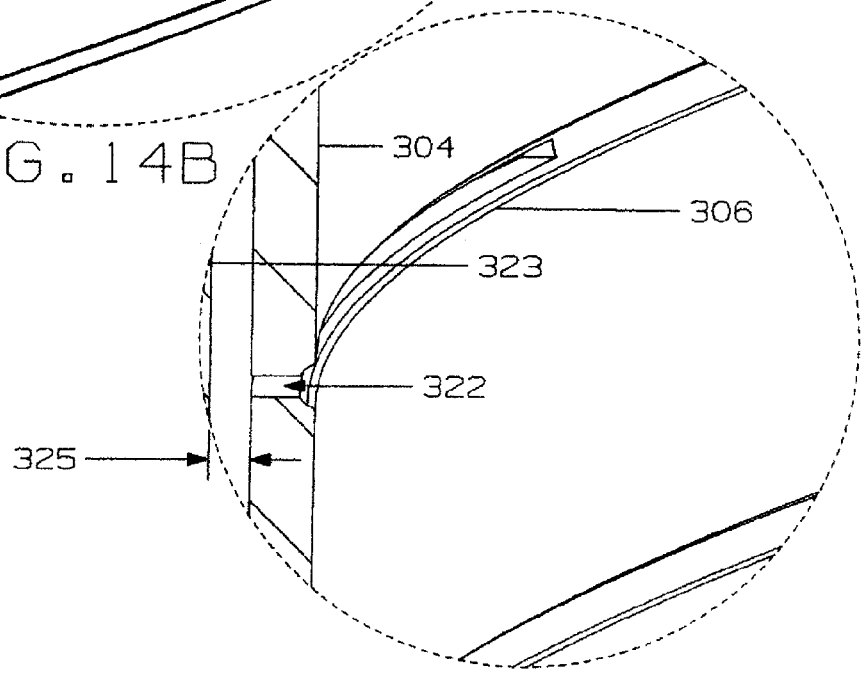
Figure 14D:
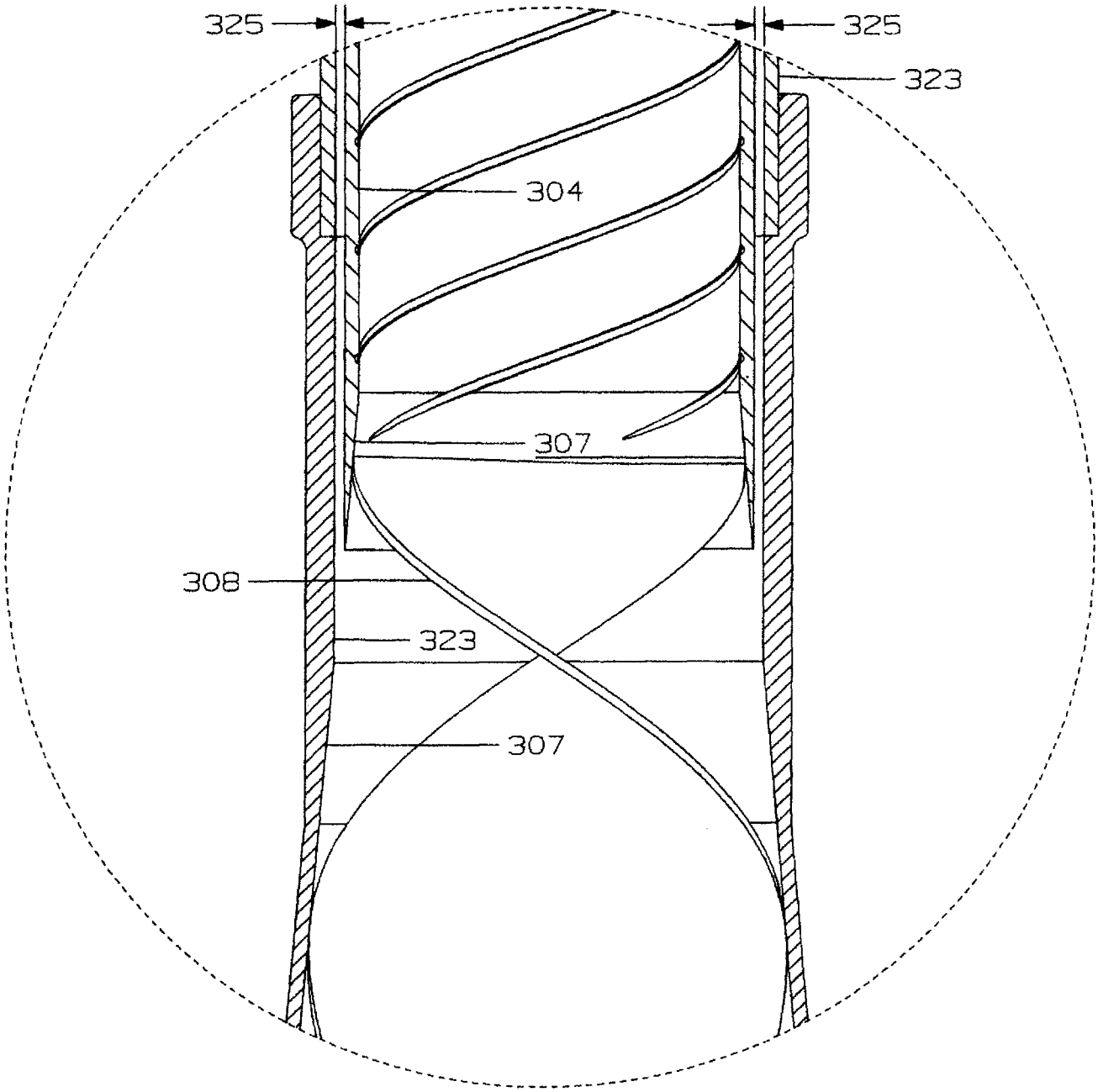

FIG. 17 shows an alternative architecture that provides for a lower cost upper bearing 380, by means of a more spatially complex upper stator array member 381 that both provides for the housing of upper bearing 380 and a lower, smaller diameter ducted fan array 382 by either preferably voids 383 in upper stator array member 381, or alternatively thin wall cross-section in the areas of closest proximity with adjacent cyclones. Upper bearing 380 is preferably, in this case, sufficient distance removed from (or above) the inlet horn to not represent flow restriction and so not force horn enlargement, which would affect array spacing density.

Having now fully described the invention, it will be apparent to one of ordinary skill in the arts that many changes and modifications can be made thereto without departing from the spirit or scope of the invention as set forth herein.

What is claimed is:

1. A wind management enclosure for catching orographic clouds comprising:

air guide surfaces disposed on a geologic formation subject to prevailing winds, at an elevation that is regularly subject to orographic condensation of the water vapor within said prevailing winds because of said elevation, the wind management enclosure having at least one first inlet opening generally facing said prevailing winds, and at least one second discharge opening generally facing away from, or substantially shielded from, said prevailing winds;

a mechanism for capture of liquid water from the aerosol condensation content of the orographic cloud flows being at least partially enclosed by the wind management enclosure;

a mechanism for collection of said captured liquid water;

a mechanism for delivery of said collected liquid water to water filtration, sanitization treatment and/or storage reservoir devices, which in turn are in hydraulic communication with water distribution systems for public, agricultural, or industrial consumption;

wherein jet pump-like features are employed to lower internal pressure by jet pump-like action to hasten discharge flow rates.

2. The enclosure of claim 1 wherein said jet pump's nozzle areas are pressurized by venturi-like air guide surfaces in direct inlet area communication with prevailing winds.

3. The enclosure of claim 1 wherein said jet pump's nozzle areas are pressurized by venturi-like air guide surfaces pressurized by air that, originating from a common inlet flow with that pressurizing said liquid water capture means, bypasses said mechanism for capture of liquid water.

4. The enclosure of claim 1 wherein said jet pump is of inside-out nozzle-throat architecture having nozzle function relocated to at least one boundary layer area annular gap circumscribing a substantially unobstructed throat area.

5. The enclosure of claim 1 wherein said jet pump is of adjustable nozzle configuration.

6. The enclosure of claim 5 wherein adjustment of said adjustable nozzle is actuated by, and thereby responsive to, the air pressure of inlet plenum areas.

7. The enclosure of claim 1 wherein at least one exhaust fan is employed to lower internal air pressure.

8. The enclosure of claim 7 wherein said at least one exhaust fan is powered by wind energy by means of at least one torslonal drive means rotationally connecting said at least one exhaust fan to at least one wind turbine rotor with favorable drive ratio.

9. The enclosure of claim 1 further comprising a settling chamber located downstream of said inlet opening, wherein said settling chamber has an enlarged flow area that allows air flow rates to slow before reaching said mechanism for capture of liquid water in order to provide settling chamber functionally.

10. The enclosure at claim 9 wherein said settling chamber has sufficient size and shape to enable the scavenging of light airborne debris by means of air velocity; and has at least one air flow outlet that by-passes said mechanism for capture of liquid water, in order to pressurize the nozzle of a discharge flow rate-hastening jet pump, whereby said settling chamber self-scavenges airborne debris and blows it out the jet pump discharge, beyond ability to foul said mechanism for capture of liquid water.

11. The enclosure of claim 1 wherein said mechanism for capture of liquid water comprises at least one fibrous mesh array having normally projected surface area, as embodied by mesh anchoring and suspension boundaries, substantially greater than the effective inlet air flow area projected normal to the oncoming wind; and wherein means for capture of water drops over large area, substantially the vertically projected area of said at least one mesh array, is provided.

12. The enclosure of claim 11 wherein airflows in communication with said mesh array are subjected to acoustic excitation.

13. The enclosure of claim 1 wherein said liquid water capture means comprises at least one heat exchanger in series combination with at least one mesh array.

14. The enclosure of claim 1 wherein means for rainwater collection, in addition to the separation and collection of liquid water from the aerosol form, are provided.

15. The enclosure of claim 1 wherein said mechanism for collection incorporates at least one replaceable filter element.

16. The enclosure of claim 1 wherein said at least one first inlet opening includes at least one moveable lower panel to enable effective closure of inlet areas in case of storm or need for service.

17. The enclosure of claim 7 wherein said at least one first inlet opening as rotatably moveable with respect to stationary mounting structures in order to enable said inlet opening to face the prevailing wind direction, and said discharge opening to face generally away from said prevailing wind direction in order to minimally be disadvantaged by shifting wind direction.

18. A wind management enclosure for catching orographic clouds comprising:

air guide surfaces disposed on a geologic formation subject to prevailing winds, at an elevation that is regularly subject to orographic condensation of the water vapor within said prevailing winds because of said elevation, the wind management enclosure having at least one first inlet opening generally facing said prevailing winds, and at least one second discharge opening generally facing away from, or substantially shielded from, said prevailing winds;

a mechanism for capture of liquid water from the aerosol condensation content of the orographic cloud flows being at least partially enclosed by the wind management enclosure;

a mechanism for collection of said captured liquid water, a mechanism for delivery of said collected liquid water to water filtration, sanitization treatment and/or storage reservoir devices, which in turn are in hydraulic communication with water distribution systems for public, agricultural, or industrial consumption;

wherein at least one exhaust fan is employed to lower internal air pressure.

19. A wind management enclosure for catching orographic clouds comprising:

air guide surfaces disposed on a geologic formation subject to prevailing winds, at an elevation that is regularly subject to orographic condensation of the water vapor within said prevailing winds because of said elevation, the wind management enclosure having at least one first inlet opening with a flow area generally facing said prevailing winds, internal flow areas, and at least one second discharge opening with a flow area generally facing away from, or substantially shielded from, said prevailing winds;

a mechanism for capture of liquid water from the aerosol condensation content of the orographic cloud flows being at least partially enclosed by the wind management enclosure, wherein said mechanism for capture of liquid water comprises at least one fibrous mesh array;

a mechanism for collection of said captured liquid water falling from said at least one fibrous mesh array, and a mechanism for delivery of said collected liquid water to water filtration, sanitization treatment and/or storage reservoir devices, which in turn are in hydraulic communication with water distribution systems for public, agricultural, or industrial consumption, said at least one fibrous mesh array comprising fibrous mesh panels comprising at least one fibrous mesh filtration layer and having normally projected flow areas, said normally projected flow areas having inlet side in fluid communication, with said first inlet opening and discharge side in fluid communication with said discharge opening;

said fibrous mesh panels being arrayed across said internal flow areas of said wind management enclosure such that substantially all airflows passing through said wind management enclosure from its said first inlet opening towards its said second discharge opening necessarily pass through or across said fibrous mesh panels from its inlet side to its discharge side, said normally projected flow areas of said fibrous mesh panels being extended longitudinally to orient said normally projected flow areas at angles with said internal flow area such that the sum of said normally projected flow areas of said fibrous mesh panels is substantially greater than the inlet opening flow area as projected normal to the oncoming wind.

20. The enclosure of claim 19 wherein at least one exhaust fan is employed to lower internal air pressure.

21. The enclosure of claim 20 wherein said at least one exhaust fan is powered by wind energy by means of at least one torsional drive means rotationally connecting said at least one exhaust fan to at least one wind turbine rotor with favorable drive ratio.

22. The enclosure of claim 19 further comprising a settling chamber located downstream of said inlet opening, wherein said settling chamber has an enlarged flow area that allows air flow rates to slow before reaching said mechanism for capture of liquid water in order to provide settling chamber functionality.

23. The enclosure of claim 19 wherein airflows in communication with said mesh array are subjected to acoustic excitation.

24. The enclosure of claim 19 wherein said liquid water capture means comprises at least one heat exchanger in series combination with at least one mesh array.

25. The enclosure of claim 19 wherein means for rainwater collection, in addition to the separation and collection of liquid water from the aerosol form, are provided.

26. The enclosure of claim 19 wherein said mechanism for collection incorporates at least one replaceable filter element.

27. The enclosure of claim 19 wherein said at least one first inlet opening includes at least one moveable lower panel to enable effective closure of inlet areas in case of storm or need for service.

28. The enclosure of claim 19 wherein said at least one first inlet opening is rotatably moveable with respect to stationary mounting structures in order to enable said inlet opening to face the prevailing wind direction, and said discharge opening to face generally away from said prevailing wind direction in order to minimally be disadvantaged by shifting wind direction.

* * * * *

UNITED STATES PATENT AND TRADEMARK OFFICE

CERTIFICATE OF CORRECTION

PATENT NO. : 7,404,837 B2
APPLICATION NO. : 10/855051
DATED : July 29, 2008
INVENTOR(S) : David Killion et al.

It is certified that error appears in the above-identified patent and that said Letters Patent is hereby corrected as shown below:

Delete title page showing an illustrative figure and substitute the attached Title page therefor.

Delete formal drawings figures 1-17 and substitute the attached formal drawing figures 1-17 therefor.

Replace Informal Drawings with the attached Formal Drawings.

Column 20, line 62: "The enclosure at" should be --The enclosure of--.

Signed and Sealed this

Thirteenth Day of April, 2010

David J. Kappos

David J. Kappos
*Director of the United States Patent and Trademark Office*

(12) United States Patent
Killion et al.

(10) Patent No.: US 7,404,837 B2
(45) Date of Patent: Jul. 29, 2008

(54) MOUNTAIN CLOUDWATER

(75) Inventors: David L. Killion, 8550 Allen Rd., Clarkston, MI (US) 48348; James E. Carr, Waterford, MI (US); Jesse D. Killion, Clarkston, MI (US); Joan A. Killion, Clarkston, MI (US); Steven L. Bruno, Clarkston, MI (US)

(73) Assignee: David L. Killion, Clarkston, MI (US)

( * ) Notice: Subject to any disclaimer, the term of this patent is extended or adjusted under 35 U.S.C. 154(b) by 0 days.

(21) Appl. No.: 10/855,051

(22) Filed: May 27, 2004

(65) Prior Publication Data

US 2005/0223719 A1 Oct. 13, 2005

Related U.S. Application Data

(60) Provisional application No. 60/473,531, filed on May 27, 2003.

(51) Int. Cl.
*B01D 47/00* (2006.01)

(52) U.S. Cl. ..... 55/421; 55/423; 55/466; 55/468; 55/495

(58) Field of Classification Search ..... 96/188; 55/421, 423, 466, 467, 468, 495; 62/93
See application file for complete search history.

(56) References Cited

U.S. PATENT DOCUMENTS 3,616,615 A * 11/1971 Woodbury ..... 96/395

OTHER PUBLICATIONS

Mukerji, Sitoo, et al., Fogwater Collection System, International Development Research Centre, Canada website, 1997, Ottawa, Canada.

U.S. Department of the Interior, Standard Fog Collector, U.S. Geological Survey website, Reston, Virginia, Apr. 23, 2002.

U.S. Department of the Interior, "Harp" type Fog Collector, U.S. Geological Survey website, Reston, Virginia, Nov. 13, 2001.

Patrick Wilson, News Release, University of East London website, May 27, 2002.

* cited by examiner

*Primary Examiner*—Robert A. Hopkins
(74) *Attorney, Agent, or Firm*—Dickinson Wright PLLC

(57) ABSTRACT

A method and apparatus for completing a natural solar distillation cycle (comprised of maritime trade winds being elevated over mountain formations to form orographic clouds) includes enabling the low cost harvesting of freshwater during time periods when weather conditions permit, despite the absence of rain. The cloud-catching wind management structures preferably incorporate minimal pressure drop gas cyclones to centrifuge condensate particles out of the air stream, and jet pump-like flow guide structures to help overcome pressure drop, for efficient, energy-passive production of freshwater utilizing only the stagnation pressure of natural wind velocity. The permanence (design and anchoring against natural disasters) of the structures provides for incorporation of water treatment means, and connection with permanent collection reservoirs and distribution systems, for large volume supply of potable freshwater for public and industrial use.

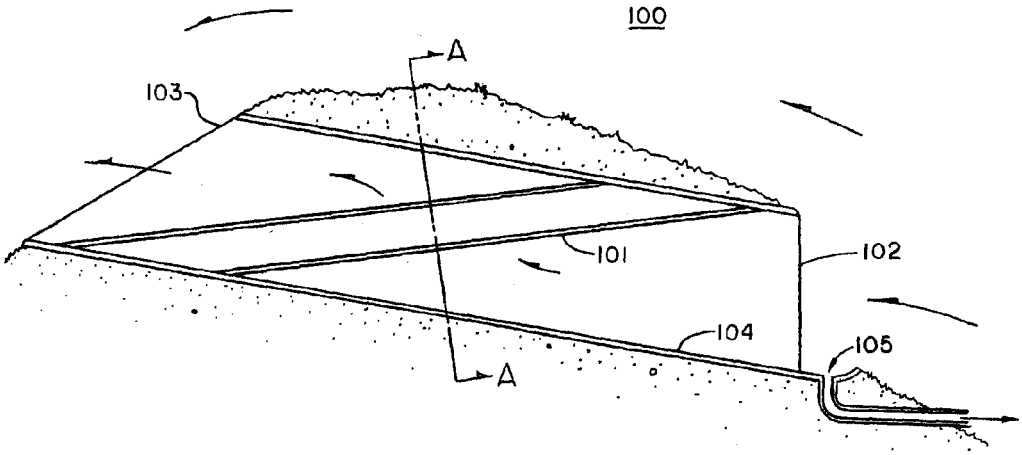

28 Claims, 27 Drawing Sheets